US008382073B2

(12) United States Patent
Tsuda et al.

(10) Patent No.: US 8,382,073 B2
(45) Date of Patent: Feb. 26, 2013

(54) HUMIDIFIER, FILTER UNIT AND ROTATION DRIVE STRUCTURE

(75) Inventors: Tsutomu Tsuda, Osaka (JP); Yoshihiko Matsubara, Osaka (JP); Naoyuki Shigemoto, Osaka (JP); Hiroshi Kitagaito, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/436,127

(22) Filed: Mar. 30, 2012

(65) Prior Publication Data

US 2012/0187586 A1 Jul. 26, 2012

Related U.S. Application Data

(62) Division of application No. 12/669,430, filed as application No. PCT/JP2008/062711 on Jul. 14, 2008.

(30) Foreign Application Priority Data

Jul. 18, 2007 (JP) ..... 2007-187474
Jul. 20, 2007 (JP) ..... 2007-190012
Jul. 25, 2007 (JP) ..... 2007-193572

(51) Int. Cl.
*B01F 3/04* (2006.01)

(52) U.S. Cl. ..... 261/92

(58) Field of Classification Search ..... 261/92, 261/94, 100, 119.1
See application file for complete search history.

(56) References Cited

U.S. PATENT DOCUMENTS 2,432,755 A * 12/1947 Hanson ..... 261/92
2,454,594 A * 11/1948 Christensen ..... 239/7
3,190,624 A 6/1965 McElreath
3,325,868 A * 6/1967 Kalwaites ..... 28/106
3,352,297 A * 11/1967 Martin et al. ..... 126/113
3,411,718 A * 11/1968 Wagner ..... 239/214.25
3,610,589 A * 10/1971 Paulin ..... 261/150
3,754,378 A * 8/1973 Christensen et al. ..... 95/8
4,127,620 A * 11/1978 Sherman et al. ..... 261/26
5,415,541 A 5/1995 Kastingschafer et al.
5,505,754 A 4/1996 Gasser

FOREIGN PATENT DOCUMENTS

JP 54-008871 1/1979
JP 54-172568 U 12/1979
JP 55-069642 U 5/1980
JP 60-178729 U 11/1985
JP 2-303556 A 12/1990
JP 10-015070 A 1/1998
JP 10-090956 4/1998
JP 2000-074429 A 3/2000
JP 2002-106899 A 4/2002
JP 2003-294277 A 10/2003

(Continued)

*Primary Examiner* — Charles Bushey
(74) *Attorney, Agent, or Firm* — Birch, Stewart, Kolasch & Birch, LLP

(57) ABSTRACT

A disc-shaped filter unit including a filter main body having a water absorbability and a holder having a non water absorbability is disposed in a vertical orientation, with a part of a circumferential portion thereof immersed in water reserved in a water tank, and is rotated by a rotation drive mechanism in a circumferential direction. The filter unit has an absorptive region and a non-absorptive region arranged adjacent to each other in the circumferential direction. Therefore, in accordance with rotation of the filter unit in the circumferential direction, a state where the absorptive region is immersed and the filter main body of the filter unit absorbs water through a water-conduction hole and a state where the non-absorptive region is immersed and water absorption of the filter main body is prevented by a watertight section having a non water absorbability are continuously alternated.

6 Claims, 24 Drawing Sheets

FOREIGN PATENT DOCUMENTS

| | | | |
|---|---|---|---|
| JP | 2003-302077 | A | 10/2003 |
| JP | 2004-045033 | A | 2/2004 |
| JP | 2004-144410 | A | 5/2004 |
| JP | 2004-338234 | | 12/2004 |
| JP | 2005-037011 | A | 2/2005 |
| JP | 2005-037076 | A | 2/2005 |
| JP | 2005-274096 | A | 10/2005 |
| JP | 2005-282980 | A | 10/2005 |
| JP | 2005-315554 | A | 11/2005 |
| JP | 2006-017271 | A | 1/2006 |
| JP | 2006-97922 | A | 4/2006 |
| JP | 2008-224170 | A | 9/2008 |
| KR | 101997-0001129 | | 1/1997 |
| KR | 10-0274266 | | 9/2000 |

* cited by examiner (a)

(b)

HUMIDIFIER, FILTER UNIT AND ROTATION DRIVE STRUCTURE

This application is a Divisional Application of co-pending U.S. patent application Ser. No. 12/669,430 filed on Jan. 15, 2010, which is a National Phase of PCT/JP2008/62711 filed on Jul. 14, 2008, which claims priority under 35 USC 119(a) to Patent Application No. JP 2007-190012 filed in Japan on Jul. 20, 2007, and to Patent Application No. JP 2007-193572 filed in Japan on Jul. 25, 2007 and to Patent Application No. JP 2007-187474 filed in Japan on Jul. 18, 2007, all of which are hereby expressly incorporated by reference in their entirety.

TECHNICAL FIELD

The present invention relates to a vaporizing type humidifier including a disc-shaped filter unit, the filter unit included in the humidifier and a rotation drive structure including a rotating body for holding a filter main body with a water absorbability and a roller for rotating the rotating body.

DESCRIPTION OF RELATED ART

A vaporizing type humidifier includes a filter having a water absorbability and air permeability, and air of the outside of the humidifier (for example, a room where the humidifier is installed) is sent to the filter having absorbed water, so as to transpire the water having been absorbed by the filter and to send air including the transpired water (namely, moistened air) to the outside of the humidifier (see Japanese Utility Model Application Laid-Open No. 54-172568 (1979), Japanese Patent Application Laid-Open No. 2000-74429, Japanese Patent Application Laid-Open No. 2003-302077, Japanese Patent Application Laid-Open No. 2005-37076).

In general, a filter is composed of a filter main body having a water absorbability and air permeability and a frame-shaped holder for holding the filter main body, is in a shape of a rectangle, a cylinder or a disc, and is immersed in water or sprayed with water for absorbing the water. Furthermore, in order to efficiently absorb water in the whole filter and/or in order to switch the filter between an immersion state and a non-immersion state, the filter may be rotatably provided.

First, a humidifier in which a disc-shaped filter provided in a vertical orientation is rotated for efficiently absorbing water in the whole filter (specifically, a humidifier as one disclosed in Japanese Utility Model Application Laid-Open No. 54-172568 (1979) will be described.

Such a humidifier includes a water tank for reserving water, and a filter of the humidifier is provided in a vertical orientation with a part of a circumferential portion thereof immersed in water within the water tank so as to be rotatable in the circumferential direction around a rotation shaft part disposed in a horizontal orientation perpendicular at the center of the filter. Through the rotation in the circumferential direction, the filter is continuously immersed in water in the circumferential direction and the water is sucked up from the immersed portion to a portion not immersed, and therefore, the water diffuses all over the filter. As a result, the filter efficiently absorbs water overall.

Furthermore, when air is sent to one face side of the filter having absorbed water, the air passing through the filter absorbs moisture, and the thus moistened air is sent to the outside of the humidifier.

Next, a humidifier in which a rectangular filter provided in a vertical orientation is rotated for switching the filter between an immersion state and a non-immersion state (specifically, a humidifier as one disclosed in Japanese Patent Application Laid-Open No. 2003-302077) will be described.

Such a humidifier includes a rotation mechanism for rotating the filter around a rotation shaft part disposed in a horizontal orientation extending along the filter. When humidification is performed, the filter is provided in a vertical orientation with its lower end immersed in water within a water tank, and when the humidification is not performed, the rotation mechanism pulls up the filter from the water by rotating it until the filter is placed in a horizontal orientation. When the filter is pulled up from the water, it is dried up and does not absorb water any more, and therefore, air coming into contact with the filter does not absorb moisture.

Particularly when a filter is used for a long period of time, water-soluble impurities (namely, scales), such as calcium and magnesium, included in the water absorbed by the filter are deposited and adhered onto the filter, which causes a problem that the water absorbability of the filter is degraded. When the humidification is not performed, namely, when the filter is not used, however, the filter is placed in the non-immersion state, so as to minimize adhesion of such scales.

Furthermore, when the filter is placed in the non-immersion state, the filter can be easily dried up, which prevents growth of mold.

SUMMARY

Incidentally, in the case where the immersion and the non-immersion of a disc-shaped filter as one included in the humidifier of Japanese Utility Model Application Laid-Open No. 54-172568 (1979) is to be switched in a similar manner to a rectangular filter as one included in the humidifier of Japanese Patent Application Laid-Open No. 2003-302077, it is necessary to provide a rotation shaft part for switching the immersion/non-immersion of the disc-shaped filter and a rotation shaft part for rotating the disc-shaped filter in the circumferential direction. In other words, it is necessary to provide both a rotation shaft part used for rotation along the filter and a rotation shaft part used for rotation perpendicular to the filter. Therefore, the structure for rotating the filter in the respective directions is very complicated.

If a filter is provided with the two rotation shaft parts for realizing the rotation for the water absorption and the rotation for switching the immersion/non-immersion, when the filter is placed in a horizontal orientation for placing it in the non-immersion state, the dimensions of a water tank in a plan view (for example, dimensions in the depth direction and the lateral direction) should be larger than the diameter of the filter so as not to allow water dropped from the filter to leak outside. Furthermore, in order to house the filter placed in a horizontal orientation, the dimensions in a plan view of a housing of the humidifier should be larger than the diameter of the filter. As a result, there arises a problem that the humidifier is increased in its size.

In order to switch the immersion/non-immersion without rotating a filter, the filter may be moved in a vertical direction for switching the immersion/non-immersion of the filter. In this case, however, it is necessary to provide a space where the filter is moved, and hence the vertical dimension of the humidifier tends to be increased, and also, a moving mechanism for moving the filter in the vertical direction should additionally provided.

Nevertheless, if a filter is allowed to be immersed in water without switching the immersion/non-immersion, there arise a problem of adhesion of scales and growth of mold on the filter.

Moreover, in the case where air is desired to be simply sent without performing humidification, even when the rotation of the filter is stopped, the filter placed in an immersion state continuously absorbs water, and hence, the sent air passes through the filter and there arises a problem that the thus moistened air is discharged from the humidifier.

In order to overcome this problem, an air duct for allowing air to pass through the filter and an air duct for not allowing air to pass through the filter may be separately provided so as to switch the two air ducts depending upon whether the humidification is to be performed or not. For this purpose, however, the humidifier should be provided with two different air ducts and means for switching the air ducts, which makes the structure of the humidifier complicated. Furthermore, in order to provide the two air ducts without increasing the size of the humidifier, each air duct tends to be formed in a complicated shape, and as a result, noise caused by air passing through the air ducts tends to be large.

Incidentally, in the humidifier disclosed in Japanese Patent Application Laid-Open No. 2003-302077, in the case where air passing through the filter or water reserved in the water tank includes dust, the dust is adhered onto the filter or incrustations (scales) are adhered onto the filter through the absorption of the water. The filter on which the dust or the incrustations are adhered cannot sufficiently transmit air or cannot sufficiently suck the water reserved in the water tank, resulting in degrading the performance of the humidifier. Therefore, in order to keep the effectiveness of the humidifier, it is necessary to periodically exchange or clean the filter.

In the humidifier disclosed in Japanese Patent Application Laid-Open No. 2003-302077, however, the filter is directly connected to a gear motor for the rotation, and hence, a user cannot easily attach/remove the filter. Therefore, maintenance such as exchange or cleaning of the filter cannot be performed.

The present invention was devised in consideration of the aforementioned circumstances, and a principal object of the invention is providing a humidifier with a simple structure in which a filter unit having an absorptive region and a non absorptive region disposed adjacent to each other in the circumferential direction is rotated in the circumferential direction by a rotation drive mechanism so that the filter unit may be allowed to absorb water or prevented from absorbing water while keeping the disc-shaped filter unit in a vertical orientation, and providing the filter unit.

Another object of the invention is providing a humidifier with a simple structure in which a filter unit including a filter main body having an immersion region and a non immersion region disposed adjacent to each other in the circumferential direction is rotated in the circumferential direction by a rotation drive mechanism so that the filter unit may be allowed to absorb water or prevented from absorbing water while keeping the disc-shaped filter unit in a vertical orientation, and providing the filter unit.

Still another object of the invention is providing a rotation drive structure for a rotating body and a humidifier in which a rotation shaft of a rotating body removably provided for holding a filter main body and a rotation shaft of a roller in contact with the outer circumferential face of the rotating body for rotating the rotating body are disposed on a substantially vertical line and the rotating body is movable horizontally from a position in contact with the roller, so that the rotating body can be removed/attached from/to the roller used for rotation drive by simply moving the rotating body in a horizontal direction for easing the maintenance of the filter main body.

The humidifier of the present invention is a humidifier comprising: a disc-shaped filter unit having a water absorbability and air permeability; a rotation drive mechanism for rotating the filter unit in a circumferential direction; a water tank for reserving water; and a fan for causing air to pass through the filter unit in a direction crossing the filter unit, wherein the filter unit is disposed in a vertical orientation in such a manner that a part of a circumferential portion of the filter unit is immersible in the water reserved in the water tank, and the filter unit has an absorptive region that absorbs water when immersed and a non absorptive region that does not absorb water even when immersed arranged adjacent to each other in the circumferential direction.

The humidifier of the invention is characterized in that the filter unit includes a disc-shaped filter main body having a water absorbability and air permeability and a holder having a non water absorbability for holding the filter main body, the holder has a water-conduction hole for immersing the filter main body correspondingly to the absorptive region and has a watertight section for preventing immersion of the filter main body correspondingly to the non absorptive region.

The humidifier of the invention is characterized by further comprising: a detection target provided on the filter unit and a detector fixed to face a rotation position of the detection target for detecting approach/departure of the detection target; and rotation control means for stopping an operation of the rotation drive mechanism on the basis of a detection result obtained by the detector in order to stop the filter unit in a state where the non absorptive region is immersed in the water stored reserved in the water tank.

The humidifier of the invention is characterized in that the detector includes a lead switch or a Hall IC, the detection target includes a magnet, and the rotation control means stops the operation of the rotation drive mechanism on the basis of an on/off state of the lead switch or the Hall IC.

The humidifier of the invention is characterized in that the filter unit is rotatable around a rotation shaft part disposed in a horizontal orientation protruding from both faces of the filter unit, a one end of the rotation shaft part has a different diameter from a diameter of the other end of the rotation shaft part, and the humidifier further comprises two bearings with dimensions corresponding to the diameters of the one end and the other end for respectively rotatably supporting the one end and the other end.

The filter unit of the present invention is a disc-shaped filter unit having a water absorbability and air permeability comprising an absorptive region that absorbs water when immersed and a non-absorptive region that does not absorb water even when immersed arranged adjacent to each other in a circumferential direction.

The humidifier of the invention includes the filter unit, the rotation drive mechanism, the water tank and the fan, and the filter unit is in a disc shape and has a water absorbability and air permeability.

The filter unit is disposed in a vertical orientation, so that a part of a circumferential portion of the filter unit may be immersed in the water reserved in the water tank. Also, the rotation drive mechanism rotates the filter unit placed in the vertical orientation in the circumferential direction, and the fan causes air to pass through the filter unit in the direction crossing the filter unit.

Incidentally, the absorptive region and the non absorptive region are arranged adjacent to each other in the circumferential direction of the filter unit. Therefore, in accordance with the rotation in the circumferential direction of the filter unit caused by the rotation drive mechanism, a state where the absorptive region is immersed and a state where the non absorptive region is immersed are continuously alternated.

The absorptive region absorbs water when immersed, and the filter unit sucks the water from the absorptive region immersed up to a portion not immersed, and hence, the water diffuses all over the filter unit. In other words, the filter unit of the present invention efficiently absorbs the water overall. Accordingly, when air passes through the filter unit by the fan, the air passing through the filter unit sufficiently absorbs moisture, and the thus moistened air is sent to the outside of the humidifier.

On the other hand, the non absorptive region does not absorb water even when immersed. Therefore, the filter unit does not absorb water any more, and furthermore, the filter unit is dried up due to drop, evaporation and the like of the water having been absorbed by the filter unit. Even when air passes through the dried filter unit by the fan, the air passing through the filter unit does not absorb moisture, and hence, moistened air is never sent to outside the humidifier. Moreover, since the filter unit does not absorb water wastefully, adhesion of scales, growth of mold, and the like onto the filter unit are prevented.

In such a humidifier, the filter unit itself is always immersed in water, and immersion/non-immersion is not switched. However, the absorption/non-absorption of the filter unit is switched, and therefore, the filter unit is prevented from continuously wastefully absorbing water in the same manner as in the case where the immersion/non-immersion is switched, resulting in preventing the problems derived from the wasteful water absorption.

Furthermore, since the absorption/non-absorption of the filter unit is switched through the rotation in the circumferential direction of the filter unit, there is no need to separately provide a rotation mechanism, movement mechanism or the like for switching the absorption/non-absorption of the filter unit. In other words, the humidifier has a simple structure.

Furthermore, the filter unit remains to be disposed in the vertical orientation and there is no need to rotate the filter unit to a horizontal orientation or move it upward for switching the absorption/non-absorption. Therefore, with respect to the dimensions of the water tank in a plan view and the dimensions of the housing of the humidifier in a plan view, although, for example, the length in the lateral direction should be larger than the diameter of the filter unit, the length in the depth direction may be larger than merely the thickness of the filter unit. Also, there is no need to provide a space for moving the filter unit in the vertical direction. As a result, the humidifier can be constructed in a compact size.

Moreover, since there is no need to switch an air duct for allowing sent air to pass through the filter unit and an air duct for not allowing the air to pass through the filter unit depending upon whether or not the humidification is to be performed, the humidifier may be provided with merely one air duct for allowing air to pass through the filter unit, and in addition, there is no need to provide means for switching the air duct. Furthermore, since the shape of the air duct is simpler as compared with the case where the humidifier is provided with two air ducts, noise caused by air passing through the air duct may be reduced.

Incidentally, since the non absorptive region is provided in a part of the circumferential portion of the filter unit, the water absorption is prevented when this part is immersed in the water during the rotation of the filter unit. Since the absorptive region is provided in the remaining part of the circumferential portion of the filter unit, however, the filter unit can sufficiently absorb the water overall by minimizing the area of the non absorptive region and continuously rotating the filter unit.

In the humidifier of the invention, the disc-shaped filter unit includes the disc-shaped filter main body and the holder for holding the filter main body. The filter main body has a water absorbability and air permeability, and the holder has a non water absorbability. Furthermore, the holder has the water-conduction hole correspondingly to the absorptive region and the watertight section correspondingly to the non absorptive region. In other words, the water-conduction hole and the watertight section are provided on the holder adjacent to each other in the circumferential direction.

The filter main body absorbs water having passed through the water-conduction hole.

On the other hand, the watertight section prevents the immersion of the filter main body.

Therefore, when the water-conduction hole is immersed in water, the filter main body absorbs the water, and when the watertight section is immersed in water, the filter main body does not absorb the water.

In this manner, according to the humidifier of the present invention, the absorptive region and the non absorptive region may be provided in the circumferential direction of the filter unit with a simple structure.

Furthermore, since the filter main body having a water absorbability and the holder having a non water absorbability are separately provided and the absorptive region and the non absorptive region are obtained by employing an appropriate shape of the holder, the filter main body may be in a simple disc shape, and there is no need to perform complicated processing for providing the filter main body with a portion having a water absorbability and a portion having a non water absorbability. In other words, the filter unit may be easily fabricated.

The humidifier of the present invention further includes the detector and the detection target, and the rotation control means.

The detection target is provided on the filter unit. Therefore, in accordance with the rotation of the filter unit in the circumferential direction, the detection target rotatively moves in the circumferential direction.

The detector is fixed so as to face the rotation position of the detection target, and the detection target approaches to or departs from the detector in accordance with the rotation in the circumferential direction of the filter unit. The detector detects the approach/departure of the detection target.

The rotation control means stops the operation of the rotation drive mechanism on the basis of the detection result of the detector. Specifically, in accordance with the positional relationship between the detector and the detection target and the positional relationship between the non absorptive region and the water tank, the rotation control means is set to stop the operation of the rotation drive mechanism, for example, when the detector detects the closest approach of the detection target or when a predetermined period of time has elapsed after the detection of the approach of the detection target by the detector. As a result, the filter unit stops with the non absorptive region immersed in the water reserved in the water tank.

In other words, by employing a simple structure including the detector, the detection target and the rotation control means, the rotation of the filter unit may be stopped not in a state where the absorptive region is immersed but in a state where the non absorptive region is immersed. Therefore, the rotation of the filter unit may be appropriately controlled so that the filter unit may be continuously rotated when the humidification is performed and that the rotation of the filter unit may be stopped with the non absorptive region immersed when the humidification is not performed.

The humidifier of the present invention includes the detector using the lead switch (or the Hall IC), the detection target using the magnet and the rotation control means that stops the operation of the rotation drive mechanism on the basis of an on/off state of the lead switch (or the Hall IC). Although the lead switch is assumed in the following description, the Hall IC is similarly applicable.

The magnet is provided on the filter unit. Therefore, the magnet moves in the circumferential direction in accordance with the rotation in the circumferential direction of the filter unit. Accordingly, the magnet is sometimes immersed in the water, whereas no problem is caused even when the magnet resistant to water is immersed in water.

The lead switch is fixed so as to face the rotation position of the detection target, and the magnet approaches to or departs from the lead switch in accordance with the rotation in the circumferential direction of the filter unit. The lead switch is turned on or turned off in accordance with the approach/departure of the magnet.

Since the lead switch may be turned on/off in accordance with the approach/departure of the magnet in a non-contact manner, there is no need to provide the lead switch, which is vulnerable to water, for example, on a portion within the water tank easily exposed to the water.

The rotation control means stops the operation of the rotation drive mechanism, for example, when the lead switch is turned on or when a predetermined period of time has elapsed after the lead switch is turned off. As a result, the filter unit stops with the non absorptive region immersed in the water reserved in the water tank.

In other words, by employing a simple structure including the lead switch, the magnet and the rotation control means, the rotation of the filter unit may be stopped not in a state where the absorptive region is immersed but in a state where the non absorptive region is immersed.

The humidifier of the present invention further includes the rotation shaft part and the two bearings for respectively rotatably supporting the one and other ends of the rotation shaft part.

The rotation drive mechanism rotates the filter unit in the circumferential direction around the rotation shaft part disposed in a horizontal orientation protruding from the both faces of the filter unit.

The one end and the other end of the rotation shaft part have different diameters, and the two bearings have dimensions respectively corresponding to the diameters of the one end and the other end. In other words, the two bearings have different dimensions. Therefore, at least one of the ends having a larger diameter is never easily supported by one of the bearings for supporting the end having a smaller diameter (specifically, for example, the end having the larger diameter does not fit in the bearing or even when it is forcedly fit, the rotation shaft part does not smoothly rotate).

In general, a filter unit is removed and attached by a user of the humidifier for exchange, cleaning or the like. The filter unit of the present invention includes, however, the detection target, and hence, it is necessary to set the rotation shaft part of the filter unit in the bearings so that the detection target rotatively moving in accordance with the rotation of the filter unit may pass a detectable range of the detector.

If the both ends of the rotation shaft part have the same diameters, a user should check the positional relationship between the detector and the detection target before setting the filter unit in the proper direction. Therefore, the user may set the filter unit in a wrong direction, which causes a problem that the detector cannot detect the detection target.

On the other hand, when the filter unit of the present invention is used, there is no need for a user to check the positional relationship between the detector and the detection target because the user may attach the ends having the different diameters to the bearings having the dimensions corresponding to the respective ends. In other words, a user may easily and accurately attach the filter unit, so that the detector can definitely detect the detection target.

Alternatively, the humidifier of the present invention is a humidifier comprising: a disc-shaped filter unit including a filter main body having a water absorbability and air permeability and a frame for holding the filter main body; a rotation drive mechanism for rotating the filter unit in a circumferential direction; a water tank for reserving water; and a fan for causing air to pass through the filter unit in a direction crossing the filter unit, wherein the filter unit is disposed in a vertical orientation in such a manner that a part of a circumferential portion of the filter unit is immersible in the water reserved in the water tank, and the filter main body has an immersion region for immersing the filter main body with water entering inside the frame and a non immersion region for not immersing the filter main body arranged adjacent to each other in the circumferential direction.

The humidifier of the present invention is characterized in that the immersion region and the non immersion region are respectively provided in a part and a remaining part of an outer circumferential portion of the filter main body, and the immersion region has an outer edge in an arc shape having a central angle exceeding two right angles.

The humidifier of the present invention is characterized in that the non immersion region has an outer edge in a polygonal shape convex along a radial direction of the filter main body.

The humidifier of the present invention is characterized in that the non immersion region has an outer edge in an arc shape having a larger radius than the outer edge of the immersion region.

The humidifier of the present invention is characterized in that the frame is in a ring shape extending along an outer circumferential face of the immersion region, and the rotation drive mechanism includes a roller in contact with an outer circumferential face of the frame for rotating the filter unit and a motor for rotating the roller.

The humidifier of the present invention is characterized in that the frame has a non water absorbability and includes a watertight section, correspondingly to the non immersion region, for preventing water from entering inside the frame.

The humidifier of the present invention is characterized by further comprising: a detection target provided on the filter unit and a detector fixed to face a rotation position of the detection target for detecting approach/departure of the detection target; and rotation control means that stops an operation of the rotation drive mechanism on the basis of a detection result obtained by the detector in order to stop the filter unit with the filter main body not immersed with the water.

The humidifier of the invention is characterized in that the detector includes a lead switch or a Hall IC, the detection target includes a magnet, and the rotation control means stops the operation of the rotation drive mechanism on the basis of an on/off state of the lead switch or the Hall IC.

The humidifier of the invention is characterized in that the filter unit is rotatable around a rotation shaft part disposed in a horizontal orientation and protruding from both faces of the filter unit, a one end of the rotation shaft part has a different diameter from a diameter of the other end of the rotation shaft part, and the humidifier further comprises two bearings with dimensions corresponding to the diameters of the one end and the other end for respectively rotatably supporting the one end and the other end.

The filter unit of the present invention is a disc-shaped filter unit comprising: a filter main body having a water absorbability and air permeability; and a frame for holding the filter main body, wherein the filter main body has an immersion region for immersing the filter main body with water entering inside the frame and a non immersion region for not immersing the filter main body arranged adjacent to each other in a circumferential direction.

The humidifier of the invention includes the filter unit, the rotation drive mechanism, the water tank and the fan, and the filter unit is in a disc shape and includes the filter main body having a water absorbability and air permeability and the frame for holding the filter main body.

The filter unit is disposed in a vertical orientation, so that a part of a circumferential portion of the filter unit may be immersed in the water reserved in the water tank. Also, the rotation drive mechanism rotates the filter unit placed in the vertical orientation in the circumferential direction, and the fan causes air to pass through the filter unit in the direction crossing the filter unit.

Incidentally, the immersion region for immersing the filter main body with water entering inside the frame and the non immersion region for not immersing the filter main body are arranged adjacent to each other in the circumferential direction in the filter main body. Therefore, in accordance with the rotation in the circumferential direction of the filter unit caused by the rotation drive mechanism, a state where a part of the circumferential portion of the filter main body is immersed (namely, a state where the immersion region opposes the bottom of the water tank) and a state where the filter main body is not immersed (namely, a state where the non immersion region opposes the bottom of the water tank) are continuously alternated.

The filter main body with a part of the circumferential portion is immersed in the water sucks the water up from the immersion region immersed in the water to a portion not immersed, and hence, the water diffuses all over the filter main body. In other words, the filter unit of the present invention efficiently absorbs water overall the filter main body. Accordingly, when air passes through the filter unit by the fan, the air passing through the filter unit sufficiently absorbs moisture, and the thus moistened air is sent to the outside of the humidifier.

On the other hand, the filter main body not immersed does not absorb water any more. Furthermore, the filter main body not immersed is dried up due to drop, evaporation and the like of water having been absorbed by the filter main body.

Therefore, even when air passes through the filter unit including the dried filter main body by the fan, the air passing through the filter unit does not absorb moisture, and hence, moistened air is never sent to outside the humidifier. Moreover, since the filter main body does not absorb water wastefully, adhesion of scales, growth of mold, and the like onto the filter main body are prevented.

In such a humidifier, the immersion/non-immersion of the filter main body is switched so as to switch absorption/non-absorption of the filter unit, and therefore, the filter unit is prevented from continuously wastefully absorbing water, resulting in preventing the problems derived from the wasteful water absorption.

Furthermore, the immersion/non-immersion of the filter main body is switched through the rotation in the circumferential direction of the filter unit. As a result, the rotation mechanism for accelerating the water absorption of the filter main body may be commonly used as the rotation mechanism for switching the immersion/non-immersion. Accordingly, there is no need to separately provide, apart from the rotation mechanism for accelerating the water absorption, a rotation mechanism, movement mechanism or the like for switching the immersion/non-immersion of the filter unit (namely, both the filter main body and the frame). Thus, the humidifier has a simple structure.

Furthermore, the filter unit remains to be disposed in the vertical orientation and there is no need to rotate the filter unit to a horizontal orientation or move it upward for switching the absorption/non-absorption of the filter unit. Therefore, with respect to the dimensions of the water tank in a plan view and the dimensions of the housing of the humidifier in a plan view, although, for example, the length in the lateral direction should be larger than the diameter of the filter unit, the length in the depth direction may be larger than merely the thickness of the filter unit. Also, there is no need to provide a space for moving the filter unit in the vertical direction. As a result, the humidifier can be constructed in a compact size.

Moreover, since there is no need to switch an air duct for allowing air to pass through the filter unit and an air duct for not allowing the air to pass through the filter unit depending upon whether or not the humidification is to be performed, the humidifier may be provided with merely an air duct for allowing air to pass through the filter unit, and in addition, there is no need to provide means for switching the air duct. Furthermore, since the shape of the air duct is simpler as compared with the case where the humidifier is provided with two air ducts, noise caused by air passing through the air duct may be reduced.

Incidentally, since the non immersion region is provided in a part of the circumferential portion of the filter main body, the water absorption is prevented when this part is immersed in the water during the rotation of the filter unit. Since the immersion region is provided in the remaining part of the circumferential portion of the filter main body, however, the whole filter unit can sufficiently absorb the water overall by minimizing the area of the non immersion region and continuously rotating the filter unit.

According to the present invention, the immersion region for immersing the filter main body with water entering inside the frame and the non immersion region for not immersing the filter main body are provided adjacent to each other in the circumferential direction respectively in a part and a remaining part of the circumferential portion of the filter main body. Furthermore, the immersion region has the outer edge in an arc shape having a central angle exceeding two right angles. In other words, the filter main body is in a shape of a chipped circle. Such a filter main body may be easily fabricated by, for example, partially chipping a filter material in a disc shape or punching a filter material in a rectangular plate shape into a desired shape.

Moreover, since the immersion region has the outer edge in the arc shape, even when any part of the immersion region is immersed, the depth by which the filter main body is immersed in the water is constant and the amount of absorbed water is regarded constant. Accordingly, the immersion region is never uneven in the amount of absorbed water. Therefore, the amount of moisture absorbed by the air passing through the filter unit is prevented from being uneven as much as possible.

FIGS. 21A and 21B are front views for schematically illustrating a shape of a filter main body with a linear outer edge to be included in the humidifier of the present invention.

In the drawing, a reference numeral 91 denotes a filter main body, which is obtained by cutting a disc-shaped filter material into a D shape, a part of the outer circumferential portion of the filter main body 91 is an immersion region 91*a* with an outer edge in an arc shape having a central angle B91 exceeding two right angles, and the remaining part of the outer circumferential portion of the filter main body 91 is a non immersion region 91*b* with a linear outer edge extending between the both ends in the circumferential direction of the outer edge of the immersion region 91*a*. At this point, the central angle B91=$\theta_{91}$° (wherein $\theta_{91}$>180).

A rotation center position 91*o* of the filter main body 91 accords with the center of the disc-shaped filter material. Also, the filter main body 91 is in a line symmetrical shape having a symmetry axis of a virtual line extending as a straight line between the rotation center position 91*o* and the center in the circumferential direction of the non immersion region 91*b*.

Since the filter unit including the filter main body 91 is disposed in a vertical orientation, the filter main body 91 is also disposed in a vertical orientation. In other words, it is disposed to be perpendicular to a still water surface WS of water reserved in a water tank.

Furthermore, a distance between the rotation center position 91*o* of the filter main body 91 and the still water surface WS is smaller than a distance between the rotation center position 91*o* and the immersion region 91*a* and is larger than a distance between the rotation center position 91*o* and the non immersion region 91*b*. Therefore, when the rotating filter unit is stopped with the center in the circumferential direction of the non immersion region 91*b* positioned directly below the rotation center position 91*o* (which position is hereinafter described simply as directly below) as illustrated in FIG. 21A, the filter main body 91 is placed in a non-immersion state. Since the filter main body 91 does not absorb water in the non-immersion state, the filter main body 91 is dried up, and the moisture absorption of air passing through the filter main body 91 is prevented.

However, it is difficult to accurately stop the rotating filter unit with the center in the circumferential direction of the non immersion region 91*b* positioned directly below, and the filter unit may be stopped in a state, for example, where the center in the circumferential direction of the non immersion region 91*b* is shifted in the rotation direction (or in the direction opposite to the rotation) from the position directly below.

FIG. 21B illustrates a state where the filter unit including the filter main body 91 having been rotated in a direction of an arrow C of FIG. 21B is stopped in a position shifted in the rotation direction. In this case, a head of the immersion region 91*a* disposed forward in the rotation direction is immersed in the water. In other words, a part of the circumferential portion of the filter main body 91 is immersed in the water. Since the filter main body 91 absorbs water when immersed, air passing through the filter unit absorbs moisture.

Furthermore, even when the filter unit is stopped in an accurate position, when, for example, the humidifier is installed in an inclined orientation, the water reserved in the water tank may be relatively inclined against the filter unit, and the filter main body 91 may be immersed in the water because of the inclined water surface.

Now, the positional shift in the stop position of the filter unit will be mainly described.

In order to prevent unwanted immersion of the filter main body derived from the positional shift in the stop position of the filter unit, it is necessary to change the shape of the filter main body.

FIG. 22 is a front view schematically illustrating another shape of the filter main body with a linear outer edge to be included in the humidifier of the present invention.

In the drawing, a reference numeral 92 denotes a filter main body, and the filter main body 92 is obtained by cutting a disc-shaped filter material into a D shape in the same manner as the filter main body 91 of FIG. 21A and FIG. 21B. In this case, it is assumed that disc-shaped filter materials having the same radius and the same thickness are used for fabricating the filter main bodies 91 and 92.

The filter main body 92 illustrated with a solid line in FIG. 22 corresponds to a state where a filter unit including the filter main body 92 is stopped with the center in the circumferential direction of a non immersion region 92*b* described below positioned directly below a rotation center position 92*o* (which position is hereinafter described simply as directly below) after rotating in a direction indicated by an arrow C in FIG. 22, and in this case, the filter main body 92 is placed in a non-immersion state. On the other hand, the filter main body 92 illustrated with a broken line in FIG. 22 corresponds to a state where the filter unit including the filter main body 92 is stopped with the center in the circumferential direction of the non immersion region 92*b* shifted in the rotation direction beyond the position directly below.

A part of the outer circumferential portion of the filter main body 92 is an immersion region 92*a* with an outer edge in an arc shape having a central angle B92 exceeding two right angles, and the remaining part of the outer circumferential portion of the filter main body 92 is a non immersion region 92*b* with a linear outer edge extending between the both ends in the circumferential direction of the outer edge of the immersion region 92*a*. At this point, the central angle B92=$\theta_{92}$° (wherein 180<$\theta_{92}$<$\theta_{91}$).

Therefore, a distance between the rotation center position 92*o* and the non immersion region 92*b* is smaller than the distance between the rotation center position 91*o* and the non immersion region 91*b* of the filter main body 91, and accordingly, a distance between the non immersion region 92*b* and a still water surface WS is larger than the distance between the non immersion region 91*b* and the still water surface WS.

As a result, as illustrated in FIG. 22 with the broken line, even when the filter unit is stopped with the center in the circumferential direction of the non immersion region 92*b* shifted in the rotation direction beyond the position directly below, unwanted immersion of the filter main body 92 can be prevented.

Furthermore, in the case where the filter unit is stopped in the accurate position, when the water surface of the water reserved in the water tank is relatively inclined against the filter unit because, for example, the humidifier is installed in an inclined orientation, the problem of the unwanted immersion of the filter main body 92 due to the inclined water surface can be prevented.

The filter main body 92 has a smaller area than the filter main body 91, however, and the circumferential length of the immersion region 92*a* (or the non immersion region 92*b*) of the filter main body 92 is smaller (or longer) than the circumferential length of the immersion region 91*a* (or the non immersion region 91*b*) of the filter main body 91.

As a result, when the filter unit including the filter main body 92 and the filter unit including the filter main body 91 are rotated at the same speed, the amount of water absorbed by the filter main body 92 is smaller than that absorbed by the filter main body 91. Accordingly, the filter main body 92 is inferior to the filter main body 91 in the efficiency for moistening air.

In the humidifier of the present invention, the immersion region has an outer edge in an arc shape with a central angle exceeding two right angles, and the non immersion region has an outer edge in a polygonal shape convex in the radial direction of the filter main body or in an arc shape having a larger radius (namely, a smaller curvature) than that of the immersion region. Such a filter main body is in substantially D shape and can attain a maximum area while keeping a non water absorbability of the non immersion region as compared with a filter main body including, for example, a non immersion region with a linear outer edge or a polygonal or arc shape concave in the radial direction of the filter main body.

FIG. 23 is a front view schematically illustrating a shape of a filter main body having an outer edge in a polygonal shape to be included in the humidifier of the present invention, and FIG. 24 is a front view schematically illustrating another shape of the filter main body to be included in the humidifier of the present invention.

In these drawings, reference numerals 93 and 94 denote filter main bodies, and each of the filter main bodies 93 and 94 is fabricated by cutting a part of a circumferential portion of a disc-shaped filter material with the same radius and the same thickness as the disc-shaped filter material used for fabricating the filter main bodies 91 and 92 and is in a substantially D shape in a front view.

In the filter unit including the filter main body 91 of FIGS. 21A and 21B, although the filter main body 91 has a shape and an area suitable for attaining a sufficient amount of absorbed water, it has the problem that the filter main body 91 cannot be kept in a non-immersion state when the positional shift is caused in the stop position of the filter unit. On the other hand, in the filter unit including the filter main body 92 of FIG. 22, although the filter main body 92 can be kept in a non-immersion state even when the positional shift is caused in the stop position of the filter unit, it has the problem that the filter main body 92 does not have a shape and an area suitable for attaining a sufficient amount of absorbed water.

In order to solve these problems, it is necessary to devise suitable shapes as those of the filter main bodies 93 and 94.

The filter main body 93 (or the filter main body 94) illustrated with a solid line in FIG. 23 (or FIG. 24) corresponds to a state where a filter unit including the filter main body 93 (or the filter main body 94) is stopped with the center in the circumferential direction of a non immersion region 93*b* (or a non immersion region 94*b*) described below positioned directly below a rotation center position 93*o* (or a rotation center position 94*o*) (which position is hereinafter described simply as directly below), and in this case, the filter main body 93 (or the filter main body 94) is placed in a non-immersion state.

On the other hand, the filter main body 93 (or the filter main body 94) illustrated with a broken line in FIG. 23 (or FIG. 24) corresponds to a state where the filter unit including the filter main body 93 (or the filter main body 94) is stopped with the center in the circumferential direction of the non immersion region 93*b* (or the non immersion region 94*b*) shifted in the rotation direction (or in the direction opposite to the rotation) beyond the position directly below. At this point, the rotation direction of the filter unit is indicated with an arrow C in FIG. 23 (or FIG. 24).

A part of the outer circumferential portion of the filter main body 93 (or the filter main body 94) is an immersion region 93*a* (or an immersion region 94*a*) with an outer edge in an arc shape having a central angle B93 (or a central angle B94) exceeding two right angles, and the remaining part of the outer circumferential portion of the filter main body 93 (or the filter main body 94) is the non immersion region 93*b* (or the non immersion region 94*b*) with an outer edge extending between the both ends in the circumferential direction of the outer edge of the immersion region 93*a* (or the immersion region 94*a*). At this point, the central angle B93 or B94=$\theta_{92}$°.

Furthermore, the non immersion region 93*b* has an outer edge in a polygonal shape convex in the radial direction of the filter main body 93 (i.e., a trough shape as illustrated in FIG. 23), and the non immersion region 94*b* has an outer edge in an arc shape with a larger radius than the immersion region 94*a* (see FIG. 24). In other words, the non immersion region 93*b* or 94*b* is in a V or U shape.

The filter main body 93 (or the filter main body 94) is in a line symmetrical shape having a symmetry axis of a virtual line extending as a straight line between the rotation center position 93*o* and the center in the circumferential direction of the non immersion region 93*b* (or the rotation center position 94*o* and the center in the circumferential direction of the non immersion region 94*b*).

Accordingly, the circumferential length of each of the immersion regions 93*a* and 94*a* of the filter main bodies 93 and 94 is equal to the circumferential length of the immersion region 92*a* of the filter main body 92 but each of the filter main bodies 93 and 94 has a larger area than the filter main body 92.

As a result, when the filter units respectively including the filter main bodies 93 and 94 and the filter unit including the filter main body 92 are rotated at the same speed, the amount of water absorbed by each of the filter main bodies 93 and 94 is larger than that absorbed by the filter main body 92, and the efficiency for moistening air is improved.

Moreover, in each of the filter main bodies 93 and 94, a distance between the center in the circumferential direction of the non immersion region 93*b* or 94*b* and a still water surface WS is equal to the distance between the non immersion region 91*b* of the filter main body 91 and the still water surface WS, and a distance between each end in the circumferential direction of the non immersion region 93*b* or 94*b* and the still water surface WS is equal to the distance between the non immersion region 92*b* of the filter main body 92 and the still water surface WS. As a result, as illustrated in FIGS. 23 and 24 with broken lines, even when the filter units are stopped with the centers in the circumferential direction of the non immersion regions 93*b* and 94*b* shifted in the rotation direction (or in the direction opposite to the rotation) beyond the position directly below, the unwanted immersion of the filter main bodies 93 and 94 can be prevented.

Furthermore, in the case where the filter unit is stopped in the accurate position, even when the water surface of the water reserved in the water tank is relatively inclined against the filter unit because, for example, the humidifier is installed in an inclined orientation, the unwanted immersion of the filter main bodies 93 and 94 due to the inclined water surface can be prevented.

In the humidifier of the present invention, the filter unit includes the ring-shaped frame extending along the outer circumferential face of the immersion region having the outer edge in an arc shape and the filter main body held by the frame. The rotation drive mechanism includes the roller and the motor, the motor rotates the roller and the roller in contact with the outer circumferential face of the frame rotates the filter unit.

If the frame is in a shape extending along the outer circumferential faces of both the immersion region and the non immersion region of the filter main body, the shape of the frame is not a ring shape, and therefore, the roller in contact with a portion of the outer circumferential face of the frame corresponding to the immersion region cannot come into contact with a portion of the outer circumferential face of the frame corresponding to the non immersion region, and therefore, the roller cannot rotate the filter unit.

In other words, since the frame in a ring shape is included, the rotation drive mechanism can rotate the filter unit smoothly regardless of the shape of the filter main body.

In the humidifier of the present invention, the disc-shaped filter unit includes the filter main body and the frame for holding the filter main body, and the filter main body has a water absorbability and air permeability, and the frame has a non water absorbability. Furthermore, the watertight section for preventing water from entering inside the frame is provided on the frame correspondingly to the non immersion region of the filter main body. On the contrary, a portion of the frame where the watertight section is not provided does not prevent water from entering inside the frame.

When the immersion region of the filter main body opposes the bottom of the water tank, the filter main body is immersed and absorbs water, and when the non immersion region of the filter main body opposes the bottom of the water tank, the filter main body is not immersed, and moreover, the watertight section prevents the water from entering inside the frame, and thus, unwanted water absorption of the filter main body is further prevented.

Furthermore, the watertight section may be used as a margin for attaching the detection target described below, and alternatively, the watertight section may be disposed so as to cover a portion of the filter main body corresponding to a lack as a complete disc from the sight of a user of the humidifier for improving the appearances of the filter unit and the humidifier.

The humidifier of the present invention further includes the detection target provided on the filter unit and the detector fixed to face the rotation position of the detection target for detecting the approach/departure of the detection target; and the rotation control means.

Since the detection target is provided on the filter unit, the detection target is rotatively moved in the circumferential direction in accordance with the rotation in the circumferential direction of the filter unit. Furthermore, the detection target approaches to or departs from the detector fixed to face the rotation position of the detection target in accordance with the rotation in the circumferential direction of the filter unit. The detector detects the approach/departure of the detection target.

The rotation control means stops the operation of the rotation drive mechanism on the basis of a detection result obtained by the detector. Specifically, in accordance with the positional relationship between the detector and the detection target and the positional relationship between the non immersion region of the filter main body and the water tank, the rotation control means is set to stop the operation of the rotation drive mechanism, for example, when the detector detects the closest approach of the detection target or when a predetermined period of time has elapsed after the detection of the approach of the detection target by the detector. As a result, the filter unit stops in a state where the filter main body is not immersed in the water and the filter unit does not absorb the water (namely, a state where the non immersion region opposes the bottom of the water tank).

In other words, by employing a simple structure including the detector, the detection target and the rotation control means, the rotation of the filter unit may be stopped not in a state where the filter main body is immersed but in a state where the filter main body is not immersed. Therefore, the rotation of the filter unit may be appropriately controlled so that the filter unit may be continuously rotated when the humidification is performed and that the rotation of the filter unit may be stopped with the filter main body not immersed when the humidification is not performed.

The humidifier of the present invention includes the detector using a lead switch (or a Hall IC), the detection target using a magnet and the rotation control means that stops the operation of the rotation drive mechanism on the basis of an on/off state of the lead switch (or the Hall IC). Although the lead switch is assumed in the following description, the Hall IC is similarly applicable.

The magnet is provided on the filter unit. Therefore, the magnet moves in the circumferential direction in accordance with the rotation in the circumferential direction of the filter unit. Accordingly, the magnet is sometimes immersed in the water, whereas no problem is caused even when the magnet resistant to water is immersed in water.

The lead switch is fixed so as to face the rotation position of the detection target, and the magnet approaches to or departs from the lead switch in accordance with the rotation in the circumferential direction of the filter unit. The lead switch is turned on or turned off in accordance with the approach/departure of the magnet.

Since the lead switch may be turned on/off in accordance with the approach/departure of the magnet in a non-contact manner, there is no need to provide the lead switch, which is vulnerable to water, for example, on a portion within the water tank easily exposed to the water.

The rotation control means stops the operation of the rotation drive mechanism, for example, when the lead switch is turned on or when a predetermined period of time has elapsed after the lead switch is turned off. As a result, the filter unit stops with the filter main body not immersed in the water.

In other words, by employing a simple structure including the lead switch, the magnet and the rotation control means, the rotation of the filter unit may be stopped not in a state where the filter main body is immersed but in a state where the filter main body is not immersed.

The humidifier of the present invention further includes the rotation shaft part and the two bearings for respectively rotatably supporting the one and other ends of the rotation shaft part.

The rotation drive mechanism rotates the filter unit in the circumferential direction around the rotation shaft part disposed in a horizontal orientation protruding from the both faces of the filter unit.

The one end and the other end of the rotation shaft part have different diameters, and the two bearings have dimensions respectively corresponding to the diameters of the one end and the other end. In other words, the two bearings have different dimensions. Therefore, at least the end having a larger diameter is never easily supported by one of the bearings for supporting the end having a smaller diameter (specifically, for example, the end having the larger diameter does not fit in the bearing or even when it is forcedly fit, the rotation shaft part does not smoothly rotate).

In general, a filter unit is removed and attached by a user of the humidifier for exchange, cleaning or the like. The filter unit of the present invention includes, however, the detection target, and hence, it is necessary to set the rotation shaft part of the filter unit in the bearings so that the detection target rotatively moving in accordance with the rotation of the filter unit may pass a detectable range of the detector.

If the both ends of the rotation shaft part have the same diameters, a user should check the positional relationship between the detector and the detection target before setting the filter unit in the proper direction. Therefore, the user may set the filter unit in a wrong direction, which causes a problem that the detector cannot detect the detection target.

On the other hand, when the filter unit of the present invention is used, there is no need for a user to check the positional relationship between the detector and the detection target because the user may attach the ends having the different diameters to the bearings having the dimensions corresponding to the respective ends. In other words, a user may easily and accurately attach the filter unit, so that the detector can definitely detect the detection target.

The humidifier of the present invention is a humidifier comprising: a roller to be rotatively driven; a rotating body that holds a filter main body with a part thereof immersed in water reserved in a water reservoir and has a circular outer circumferential face, the rotating body being rotated by rotatively driving the roller with the outer circumferential face of the rotating body in contact with an outer circumferential face of the roller, air being sent by a fan through the filter main body to be blown out; and an attaching part for removably attaching the rotating body in such a manner that a rotation shaft of the rotating body is positioned substantially directly below a rotation shaft of the roller by moving the rotating body vertically to the rotation shaft of the rotating body and substantially horizontally.

The humidifier of the present invention is characterized by further comprising: a housing for housing the rotating body and the roller, wherein the fan allows air introduced from the outside of the housing to pass through the filter main body, the filter main body is held within the rotating body with a rotation shaft of the filter main body according with the rotation shaft of the rotating body, and the attaching part is integrated with the water reservoir, holds the rotating body with a lower portion of the filter main body immersed in the water reserved in the water reservoir and is removably provided on the housing.

The rotation drive structure of the present invention is a rotation drive structure comprising: a roller to be rotatively driven; a rotating body with a circular outer circumferential face for holding a filter main body, the rotating body being rotated with the outer circumferential face of the rotating body in contact with an outer circumferential face of the roller, and an attaching part for removably attaching the rotating body in such a manner that a rotation shaft of the rotating body is positioned substantially directly below a rotation shaft of the roller by moving the rotating body vertically to the rotation shaft of the rotating body and substantially horizontally.

The rotation drive structure of the present invention is characterized in that the outer circumferential face of the rotating body and/or the outer circumferential face of the roller are subjected to knurl processing.

Furthermore, the rotation drive structure of the present invention is characterized in that the roller is held vertically movably.

The rotation drive structure of the present invention is characterized by further comprising a pressurizing part for applying a downward pressure to the roller.

In the rotation drive structure of the present invention, the rotating body holding the filter main body is rotated with a turning force applied by rotatively driving the roller in contact with the circular outer circumferential face of the rotating body. Furthermore, the rotating body is horizontally moved to the position where the rotation shaft of the rotating body is disposed substantially directly below the rotation shaft of the roller, and thus, the rotating body is brought into contact with the roller. In other words, the rotating body is removably attached to the roller for rotating the rotating body by horizontally moving the rotating body. In this case, a filter unit of a humidifier includes a filter main body and a rotating body for holding the filter main body.

In the rotation drive structure of the present invention, the rotating body is held with the rotation shaft of the filter main body and the rotation shaft of the rotating body according with each other and with the lower portion of the filter main body immersed in water reserved in the water reservoir. The fan causes air to pass through such a filter main body. Since a part of the filter main body is always immersed in the water because the filter main body is rotated with its lower portion immersed in the water, the filter main body is never dried up and hence the air is moistened.

Furthermore, in the rotation drive structure of the present invention, the outer circumferential face of the rotating body and/or the outer circumferential face of the roller are subjected to the knurl processing for preventing slip on a contact point there between.

In the rotation drive structure of the present invention, the roller in contact with the rotating body is vertically moved for attaining definite contact.

In the rotation drive structure of the present invention, since the downward pressure is applied to the roller, the roller in contact with the rotating body substantially directly above the rotating body pushes the rotating body for attaining definite contact.

According to the humidifier and the filter unit of the present invention, the absorption/non-absorption of the filter unit can be switched merely through the rotation in the circumferential direction of the filter unit with the disc-shaped filter unit disposed in a vertical orientation and with the filter unit immersed in water. In other words, the problem of the unwanted water absorption of the filter unit can be prevented with a simple structure.

According to the humidifier and the filter unit of the present invention, the absorption/non-absorption of the filter unit can be switched by switching the immersion/non-immersion of the filter main body merely through the rotation in the circumferential direction of the filter unit with the disc-shaped filter unit disposed in a vertical orientation and with the filter unit immersed in the water. In other words, the problem of the unwanted water absorption of the filter unit can be prevented with a simple structure.

According to the humidifier and the rotation drive structure of the present invention, since the rotating body for holding the filter main body is rotatively in contact with the roller for rotating the rotating body, the rotating body and the roller can be easily separated from each other, resulting in attaining an effect that the filter main body can be exchanged or cleaned for maintenance. Furthermore, since the roller is disposed substantially directly above the rotating body, the roller applies the substantially directly downward pressure to the rotating body, and thus, the pressure is uniformly applied to the rotating body. As a result, an effect that the roller transfers a stable turning force to the rotating body for making the rotating body stably rotate is exhibited. Furthermore, since the rotating body is rotatively in contact with the roller substantially directly above the rotating body, when the rotating body is moved horizontally, it can be brought into rotative contact with the roller even when the rotating body is slightly shifted in the horizontal direction. Moreover, when the rotating body is brought into rotative contact with the roller, the rotating body is horizontally moved, and therefore, an effect that variation in contact between the roller and the rotating body is reduced is exhibited.

The above and further objects and features will more fully be apparent from the following detailed description with accompanying drawings.

DETAILED DESCRIPTION

The present invention will now be described with reference to the accompanying drawings illustrating embodiments thereof.

Embodiment 1

Figure 1:
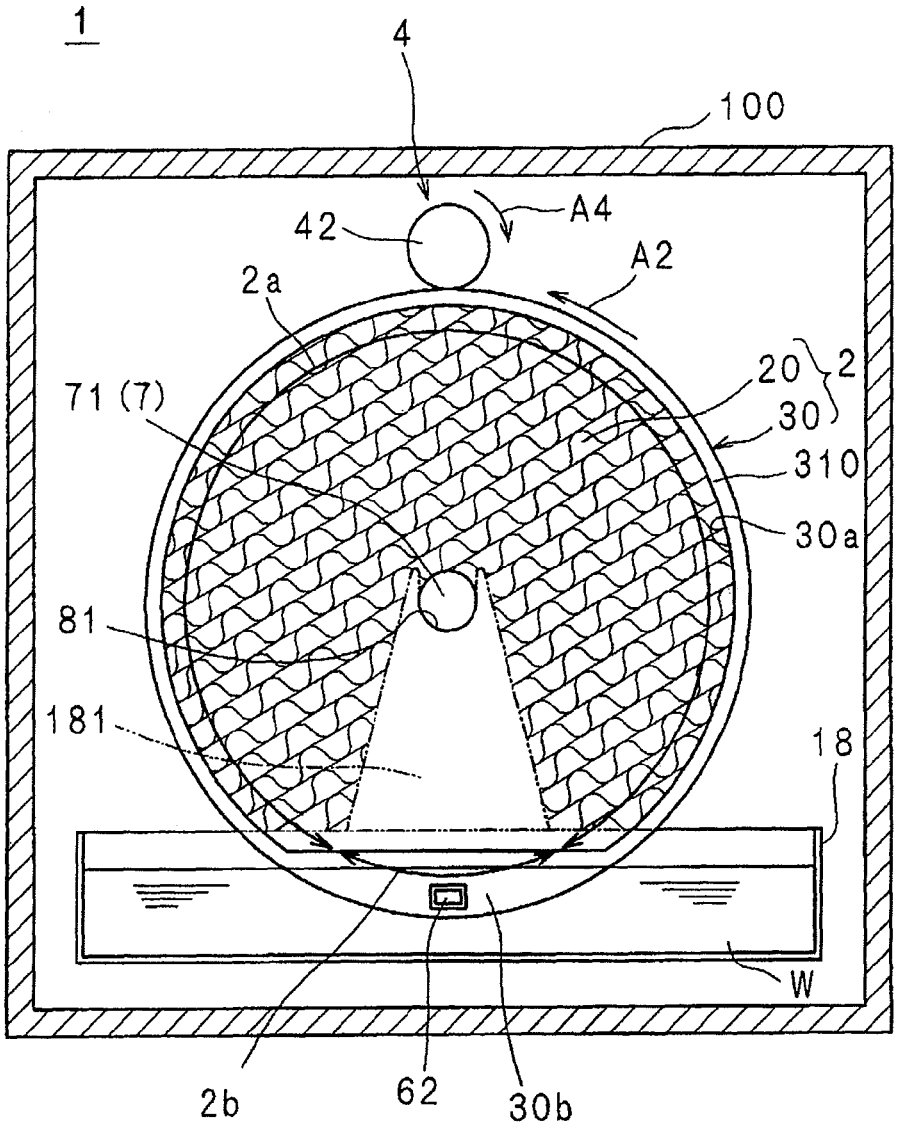
FIG. 1 is a rear view illustrating a one face side of a filter unit included in a humidifier according to Embodiment 1 of the invention.
Figure 2:
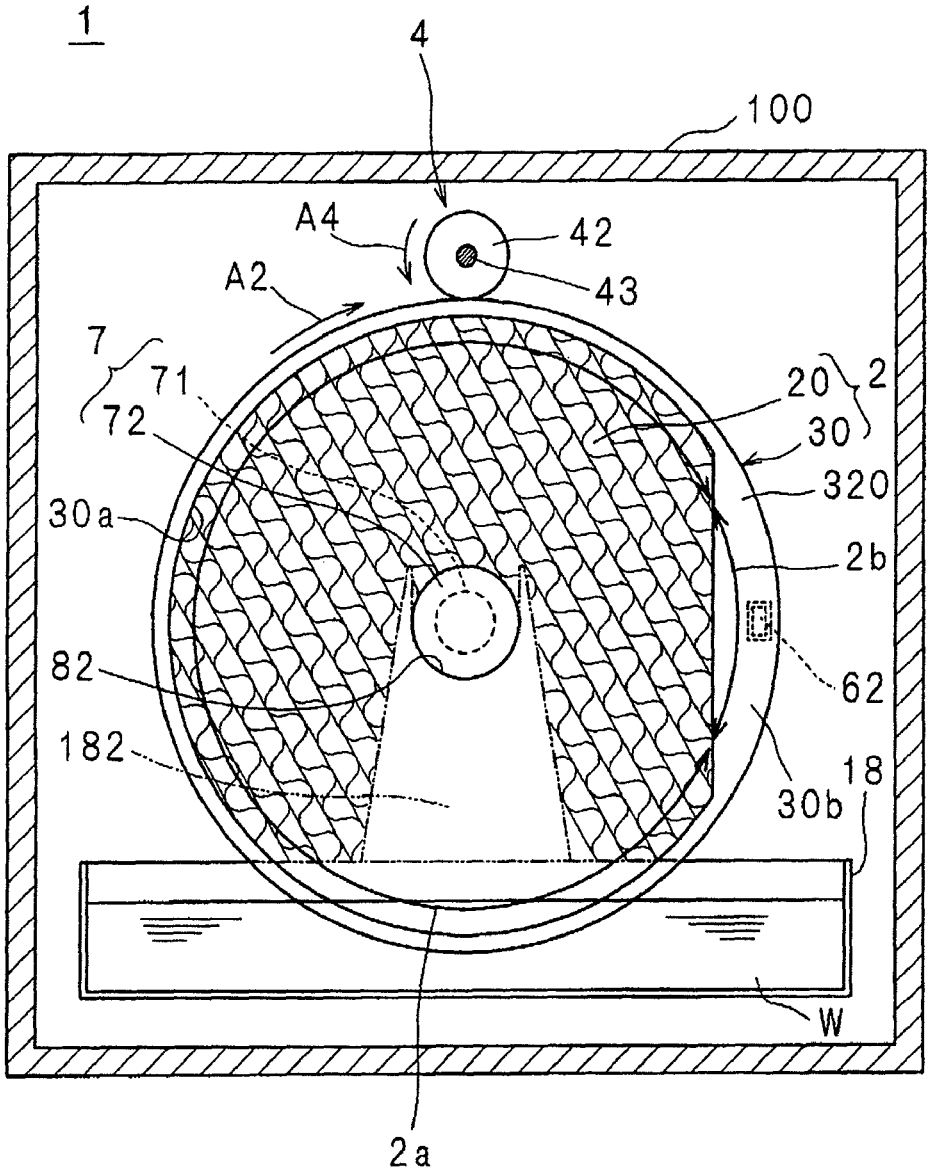
FIG. 2 is a front view illustrating the other face side of the filter unit included in the humidifier according to Embodiment 1 of the invention.
Figure 3:
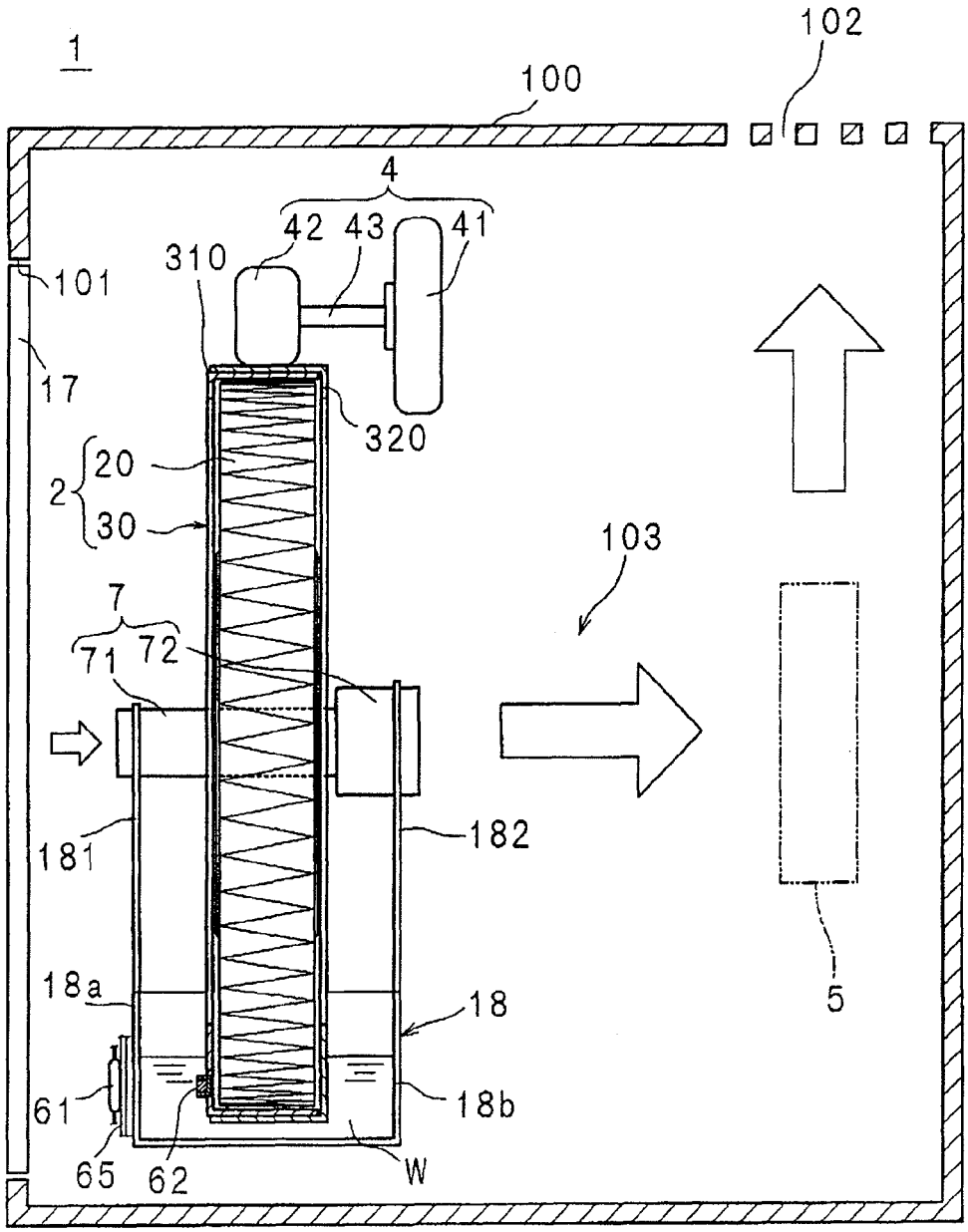
FIG. 3 is a schematic side view illustrating the internal structure of the humidifier according to Embodiment 1 of the invention.

FIG. 1 is a schematic rear view illustrating a one face side of a filter unit included in a humidifier according to Embodiment 1 of the invention, and FIG. 2 is a schematic front view illustrating the other face side of the filter unit. Also, FIG. 3 is a schematic side view illustrating the internal structure of the humidifier, and FIG. 4 is a block diagram illustrating the structure of a principal part of the humidifier.

In these drawings, a reference numeral 1 denotes a humidifier, and the humidifier 1 includes, as illustrated in FIGS. 1 through 4, a housing 100, a CPU 10, a ROM 11, a RAM 12, an EEPROM 13, a display section 14, an operation section 15, a humidity sensor 16, an air cleaning filter 17, a water tank 18, a filter unit 2 having a water absorbability and air permeability, a rotation drive mechanism 4, a fan 5, a detector 61 and a magnet 62. The filter unit 2 is in a disc shape with an appropriate thickness and includes a filter main body 20 with a honeycomb structure having a water absorbability and air permeability and a holder 30 having a non water absorbability for holding the filter main body 20. Also, the filter unit 2 is provided with a rotation shaft part 7, and the rotation shaft part 7 is supported by bearings 81 and 82.

Figure 4:
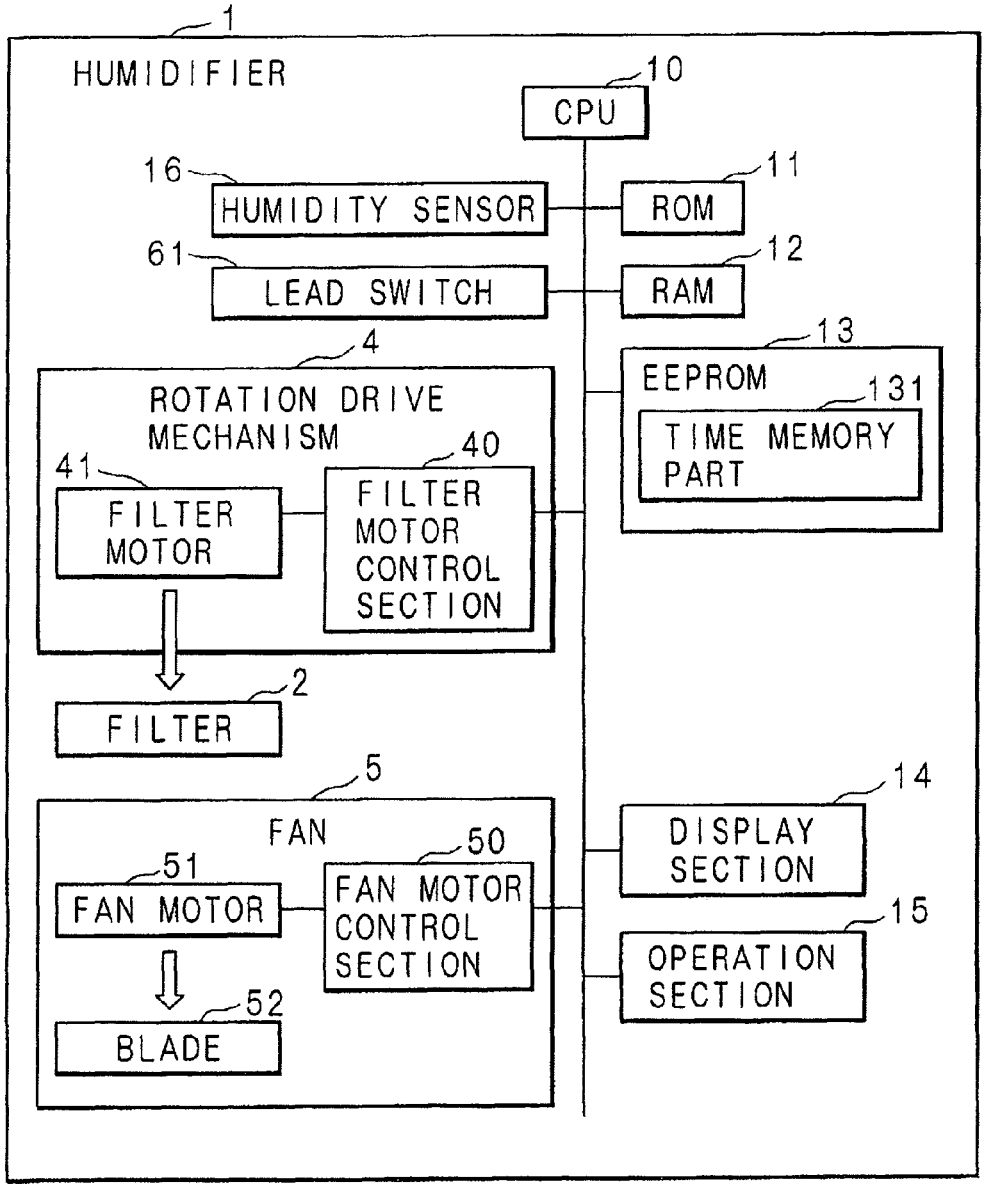
FIG. 4 is a block diagram illustrating the structure of a principal part of the humidifier according to Embodiment 1 of the invention.

The CPU 10 is a control center of the humidifier 1 and is connected to, as illustrated in FIG. 4, the ROM 11, the RAM 12, the EEPROM 13, the display section 14, the operation section 15, the humidity sensor 16, a filter motor control section 40 of the rotation drive mechanism 4, a fan motor control section 50 of the fan 5, and the detector 61 through internal buses or signal lines. The CPU 10 uses the RAM 12 as a work area for controlling respective parts of the humidifier and executing various processing in accordance with a control program and data stored in the ROM 11 and data stored in the EEPROM 13.

A time memory part 131 is provided as a part of a memory area of the EEPROM 13.

As illustrated in FIGS. 1 through 3, the housing 100 has a vertical rectangular parallelepiped shape to be allowed to stand on a floor, has an intake port 101 on its rear face and an outlet port 102 on its top face, includes an air duct 103 for connecting the intake port 101 to the outlet port 102, and in the air duct 103, the air cleaning filter 17, the filter unit 2, the rotation drive mechanism 4, the water tank 18 and the fan 5 are arranged in this order from upstream to downstream of air flow.

The air cleaning filter 17 includes a filter main body with air permeability working for both dust collection and deodorization and a synthetic resin holder for holding the filter main body, and is in a rectangular shape entirely covering the intake port 101, so as to filtrate air passing through the air cleaning filter 17 itself for filtering out fine floating motes and dust and for deodorizing.

The air cleaning filter 17 has a structure that the filter main body is easily manually attached to or removed from the holder by a manufacturer operator or a user of the humidifier 1.

The water tank 18 is provided on the bottom of the housing 100, is in a rectangular tray shape having an opened upper face and reserves water W supplied from a water feeding tank not shown. The water feeding tank is constructed to automatically feed water to the water tank 18 for keeping a predetermined water level in the water tank 18.

The water tank 18 is disposed to have two opposing sidewalls 18*a* and 18*b* thereof along the rear face and the front face of the humidifier 1, and the water tank 18 is in a narrow rectangular shape extending in the lateral direction in a plan view. More specifically, the inner dimension of the water tank 18 in the depth direction (that is, the lateral direction in FIG. 3) is sufficiently larger than the thickness of the filter unit 2 but is largely smaller than the outer diameter of the filter unit 2. On the other hand, the inner dimension of the water tank 18 in the lateral direction (that is, the lateral direction in FIGS. 1 and 2) is sufficiently larger than the outer diameter of the filter unit 2. Therefore, the water W dropped from the filter unit 2 is prevented from leaking out of the water tank 18.

The rotation shaft part 7 in a cylindrical shape perpendicular to the filter main body 20 is provided at the center of the filter unit 2, and the filter unit 2 is disposed in a vertical orientation so that a part of a circumferential portion thereof may be immersed in the water reserved in the water tank 18. Accordingly, the rotation shaft part 7 is disposed in a horizontal orientation.

At this point, the rotation shaft part 7 is rotatably supported by the bearings 81 and 82 respectively provided on supporting parts 181 and 182 extending upward respectively from the sidewalls 18*a* and 18*b* of the water tank 18, and as a result, the filter unit 2 is supported rotatably around the rotation shaft part 7 in the circumferential direction. The filter main body 20 is in a disc shape with an appropriate thickness and has a circular through hole at the center thereof, so that a central portion of the rotation shaft part 7 can be fit in the through hole to be fixed with a frictional force.

The rotation shaft part 7 penetrates the center of water-conduction holes 30*a* described later and has a one end 71 and the other end 72 having a larger outer diameter than the one end 71 with the central portion of the rotation shaft part 7 sandwiched there between. The outer diameter of the one end 71 is equal to the outer diameter of the central portion of the rotation shaft part 7, and the one end 71 of the rotation shaft part 7 is inserted into the through hole of the filter main body 20 so that the one end 71 can be disposed on the one face side of the filter main body 20 (and the filter unit 2 in turn) with the other end 72 disposed on the other face side.

The bearing 81 provided on the supporting part 181 is in a U shape with a dimension according to the outer diameter of the one end 71 and rotatably supports the one end 71 inserted from above the U shape. Similarly, the bearing 82 provided on the supporting part 182 has a dimension according to the outer diameter of the other end 72 and rotatably supports the other end 72.

The holder 30 has a structure that can be easily manually assembled or disassembled by a manufacturer operator or a user, and therefore, a manufacturer operator or a user can easily manually attach/remove the filter main body 20 to/from the holder 30. Furthermore, the filter unit 2 obtained by attaching the filter main body 20 to the holder 30 may be easily manually attached/removed to/from the supporting parts 181 and 182 by a manufacturer operator or a user.

As described later, detector switch 61 is provided on the sidewall 18*a* of the water tank 18, and the magnet 62 is provided on the one face side of the filter unit 2 (namely, the face side from which the one end 71 protrudes), and since the detector 61 detects approach/departure of the magnet 62, it is necessary for a user to attach the filter unit 2 with the face side having the magnet 62 opposing the sidewall 18*a*. Therefore, when the one end 71 is supported by the bearing 81 with the dimension according to the diameter of the one end 71 and the other end 72 is supported by the bearing 82 with the dimension according to the diameter of the other end 72, a user can easily and accurately attach the filter unit 2 without considering the positional relationship between the detector 61 and the magnet 62.

If a user tries to make the one end 71 supported by the bearing 82 and the other end 72 supported by the bearing 81, the other end 72 cannot be inserted into the bearing 81, and therefore, the filter unit 2 is never set in a wrong direction.

Incidentally, the holder 30 is made of synthetic resin and has the water-conduction holes 30*a* each in a D shape correspondingly to the both faces of the filter main body 20, the holder 30 is roughly in a frame shape covering the outer circumference (and more specifically, covering the outer circumferential face and a portion in the vicinity of the outer circumferential face) of the filter main body 20. Each water-conduction hole 30*a* is permeable to not only the water W but also air and is formed in an area as wide as possible excluding an area necessary for holding the filter main body 20 and forming a watertight section 30*b* described later.

The holder 30 is composed of a first frame 310 and a second frame 320, and each of the first frame 310 and the second frame 320 is in the shape of, so to speak, a circular dish having the water-conduction hole 30*a* on its bottom, and the filter main body 20 is held by covering the outer circumferential face of the filter main body 20 and a portion of the one face side in the vicinity of the outer circumferential face of the filter main body 20 with the sidewall and the bottom of the first frame 310 and by covering the outer sidewall of the first frame 310 and a portion of the other face side in the vicinity of the outer circumferential face of the filter main body 20 with the sidewall and the bottom of the second frame 320.

As a result, the water W having passed through the water-conduction holes 30*a* reaches the filter main body 20 held inside the holder 30 but the filter main body 20 is never immersed with the water W having entered inside the holder 30 through, for example, the outer circumferential face of the holder 30.

As a principal characteristic of the filter unit 2 of this embodiment of the invention, an absorptive region 2*a* that absorbs water when immersed and a non absorptive region 2*b* that does not absorb water even when immersed are disposed on each of the one face side and the other face side of the filter unit 2 to be arranged adjacent to each other in the circumferential direction. Therefore, in each of the first frame 310 and the second frame 320 of the holder 30 having a non water absorbability, the water-conduction hole 30*a* for immersing the filter main body 20 having a water absorbability is formed correspondingly to the absorptive region 2*a* and the watertight section 30*b* in a bow shape in a front view for preventing the immersion of the filter main body 20 is formed correspondingly to the non absorptive region 2*b*. The watertight section 30*b* is in a shape of a plate provided integrally with a portion of the first frame 310 (or the second frame 320) covering the one face side (or the other face side) of the filter main body 20 and extending along the one face (or the other face) of the filter main body 20.

In each of the non absorptive regions 2*b*, a watertight vessel for making the filter main body 20 watertight is formed by the watertight section 30*b* and the outer circumferential face of the holder 30, and therefore, even when the non absorptive region 2*b* is immersed in water, the water W is prevented from entering the filter main body 20 so as to allow the filter main body 20 to absorb the water. At this point, the water level in the water tank 18 is sufficiently lower than the upper end of the watertight section 30*b* in a state where the watertight section 30*b* is disposed in the lowermost position in the circumferential direction of the filter unit 2 (see FIG. 1) and is a level for definitely immersing the water-conduction hole 30*a* (at least a part of the water-conduction hole 30*a*) in a state where the watertight section 30*b* is disposed in a position other than the lowermost position in the circumferential direction of the filter unit 2 (see FIG. 2).

On the other hand, in each of the absorptive regions 2*a*, the water W easily enters the filter main body 20 through the water-conduction hole 30*a* even though the outer circumferential face of the frame 30 prevents the water, and therefore, the filter main body 20 absorbs the water.

Incidentally, a fine water-conduction hole may be also formed on the outer circumferential face of the holder 30 correspondingly to each of the absorptive regions 2*a*.

Incidentally, the magnet 62 is fixed in the center in the circumferential direction of the watertight section 30*b* of the first frame 310 and is rotatively moved while describing a circular path in accordance with the rotation of the filter unit 2. The detector 61 is fixed so as to face the lowermost point of the rotation position of the magnet 62, and specifically, a printed board 65 is fixed on the sidewall 18*a* of the water tank 18 and the detector 61 is mounted on the printed board 65 (more specifically, in the center of the printed board 65 in the lateral direction of the sidewall 18*a*).

The detector 61 is connected to the CPU 10 through a signal line formed on the printed board 65, so as to be turned on when the magnet 62 comes into a predetermined area in the vicinity of the detector 61 and to be turned off when the magnet 62 goes out of the predetermined area. In other words, when the magnet 62 comes close to the detector 61, the detector 61 is turned on, and when the magnet 62 goes away from the detector 61, it is turned off. As a result, the detector 61 functions as the detector for detecting the approach/departure of the magnet 62 to/from the lead switch 61. Also, the magnet 62 is provided on the filter unit 2 and functions as the detection target to be detected by the detector 61 working as the detector. Note that the detector 61 includes a lead switch or Hall 1C.

When the detector 61 is turned on, it outputs an on signal corresponding to its transition to an on state to the CPU 10, and when the detector 61 is turned off, it stops outputting the on signal. On the other hand, when the on signal is input from the detector 61, the CPU 10 determines that the detector 61 is in an on state, and when the on signal is not input, it determines that the detector 61 is in an off state.

The detector 61 is continuously in an on state while the magnet 62 is positioned within the predetermined area in the circumferential direction of the filter unit 2. The predetermined area is hereinafter designated as a switch-on area. When the magnet 62 is positioned in the center in the circumferential direction of the switch-on area, the non-absorptive regions 2*b* of the filter unit 2 are immersed but the absorptive regions 2*a* are not immersed, and when the magnet 62 is positioned away from the center in the circumferential direction of the switch-on area, at least a part of the absorptive regions 2*a* is immersed. In the case where air humidification is not performed, it is necessary to stop the rotation of the filter unit 2 in a state where the water non-absorptive regions 2*a* are immersed but the absorptive regions 2*a* are not immersed, namely, a state where the filter main body 20 is watertight, and therefore, the detector 61 and the magnet 62 are used for attaining the timing of stopping the rotation.

The time memory part 131 of the EEPROM 13 stores, as a predetermined period of time, ½ of time having elapsed from the magnet 62 entering the switch-on area to the magnet 62 leaving the switch-on area (namely, time having elapsed from the magnet 62 entering the switch-on area to the magnet 62 reaching the center in the circumferential direction of the switch-on area). The predetermined period of time is calculated on the basis of a measurement result obtained by actually rotating the filter unit 2 by the rotation drive mechanism 4 so as to be stored in the time memory part 131, for example, before forwarding the humidifier 1 from the factory. Therefore, assuming that the filter unit 2 completes one rotation in 60 seconds and that the magnet 62 passes through the switch-on area in 1 second in accordance with the rotation of the filter unit 2, the time memory part 131 stores 0.5 second as the predetermined period of time.

As illustrated in FIGS. 1 through 4, the rotation drive mechanism 4 includes the filter motor control section 40, an electric filter motor 41, a rotation roller 42 and a coupling shaft 43. The filter motor control section 40 is controlled by the CPU 10 so as to supply a control signal corresponding to revolutions per minute [rpm] to the filter motor 41. The filter motor 41 includes an AC motor and is operated with desired revolutions per minute in accordance with the control signal supplied from the filter motor control section 40.

An output shaft of the filter motor 41 and a rotation shaft of the rotation roller 42 are coupled to each other through the coupling shaft 43, so that the rotation roller 42 can be rotated in a direction indicated by an arrow A4 in FIGS. 1 and 2 (that is, the clockwise direction in FIG. 1) through the operation of the filter motor 41.

The rotation roller 42 is disposed with the circumferential face of the rotation roller 42 in contact with the uppermost point of the outer circumferential face of the filter unit 2, and the rotation shaft part 7 and the rotation shaft of the rotation roller 42 are disposed to be parallel to each other.

Therefore, when the rotation roller 42 is rotated through the operation of the filter motor 41, the filter unit 2 is rotated in the direction indicated by an arrow A2 in FIG. 1 (that is, the counterclockwise direction in FIG. 1) in accordance with the rotation of the rotation roller 42.

In other words, the rotation drive mechanism 4 rotates the filter unit 2 in the circumferential direction.

The fan 5 includes a sirocco fan and contains the fan motor control section 50, an electric fan motor 51 and blades 52, as illustrated in FIG. 4. The fan motor control section 50 is controlled by the CPU 10 so as to supply a control signal corresponding to revolutions per minute [rpm] to the fan motor 51. The fan motor 51 includes an AC motor and is operated in accordance with the control signal supplied by the fan motor control section 50.

The blades 52 are rotated through the operation of the fan motor 51, so as to introduce air with low humidity through the intake port 101 and allow the air to pass through the air cleaning filter 17 and the filter unit 2 in this order. At this point, the air is sent to the air cleaning filter 17 and the filter unit 2 in a direction perpendicular to the air cleaning filter 17 and the filter unit 2. In other words, the fan 5 causes air to pass through the filter unit 2 in the direction crossing the filter unit 2.

The air introduced through the intake port 101 by the fan 5 passes through the air duct 103 in a direction indicated by white arrows in FIG. 3. More specifically, the air introduced through the intake port 101 is first cleaned by passing through the air cleaning filter 17. Subsequently, the cleaned air passes through the filter unit 2 so as to vaporize the water W having been absorbed by the filter unit 2, and the vaporized water W is involved in the air passing through the filter unit 2 (namely, the air is moistened with water vapor). The air thus increased in the humidity is discharged through the outlet port 102 to a room where the humidifier 1 is installed. When the filter unit 2 is dried up, however, the air passing through the filter unit 2 is never moistened.

The humidity sensor 16 of FIG. 4 detects the humidity of the room where the humidifier 1 is installed and supplies the detection result to the CPU 10. In this embodiment, the CPU 10 allows the display section 14 to display the detection result obtained by the humidity sensor 16, so as to inform a user of the humidity of the room.

The display section 14 displays, for example, the operation state of the humidifier 1, the humidity of the room and the like under control of the CPU 10, and the operation section 15 includes various function keys of hard keys. In this embodiment, a user of the humidifier 1 issues various instructions to the humidifier 1 by operating the operation section 15 while referring to the display section 14. Incidentally, the extent of the humidification and the rate of passing air may be automatically set by the CPU 10, for example, in accordance with the detection result obtained by the humidity sensor 16.

Figure 5:
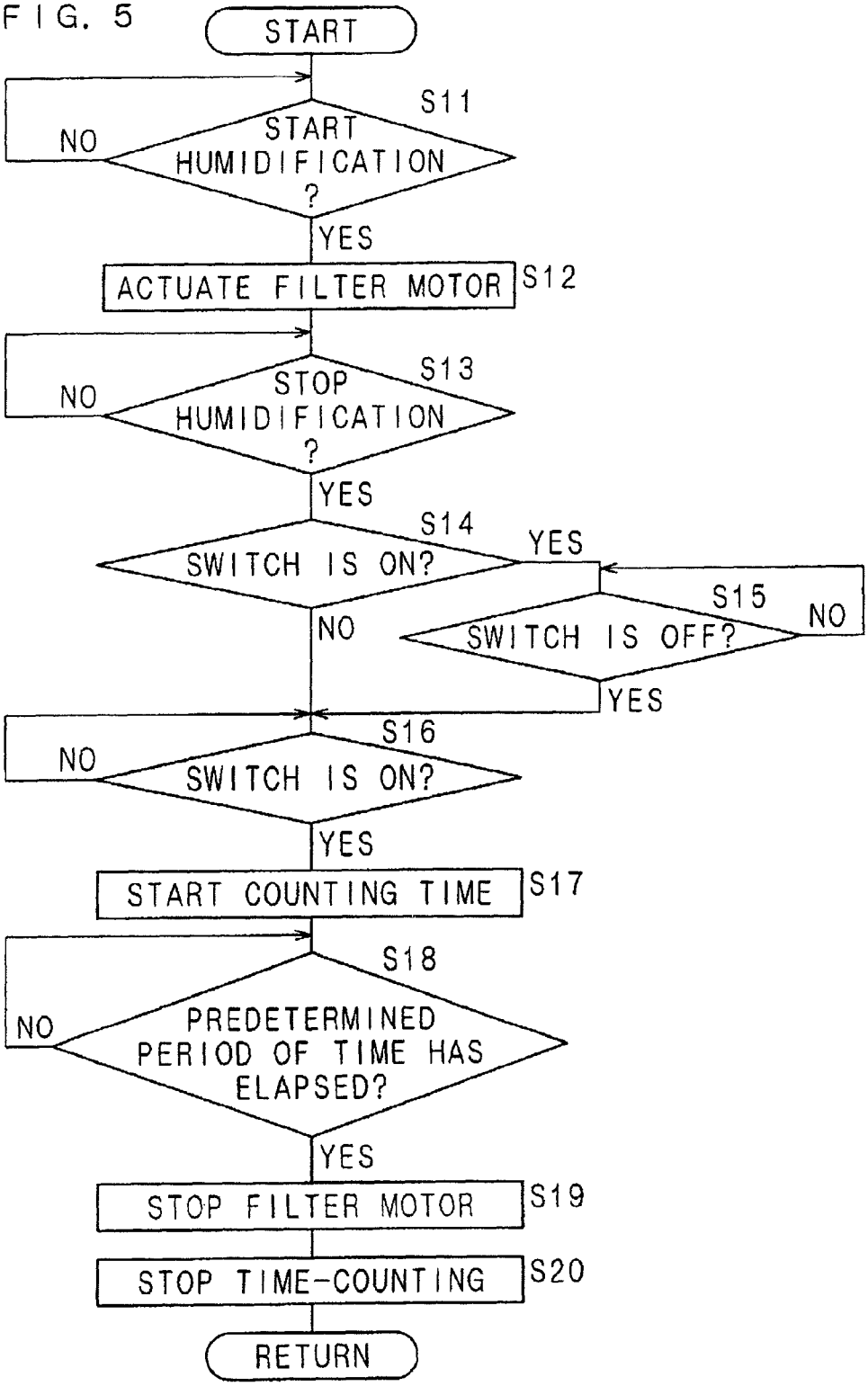
FIG. 5 is a flowchart illustrating procedures in a humidification/non-humidification switching process executed by a CPU of the humidifier according to Embodiment 1 of the invention.

FIG. 5 is a flowchart illustrating procedures in a humidification/non-humidification switching process executed by the CPU 10 of the humidifier 1.

A user makes the humidifier 1 start the humidification or stop the humidification by operating the operation section 15.

The CPU 10 determines whether or not the operation section 15 has been operated for starting the humidification (S11), and when not (NO in S11), the procedure of S11 is repeatedly executed.

When the operation section 15 has been operated for starting the humidification (YES in S11), the CPU 10 actuates the filter motor 41 by controlling the filter motor control section 40 (S12). In the case where the fan motor 51 is in a stop state when the procedure of S12 is executed, the CPU 10 actuates the fan motor 51 by controlling the fan motor control section 50, so as to start causing air to pass through the filter unit 2 through the rotation of the blades 52 of the fan 5.

The filter unit 2 is rotated through the operation of the filter motor 41 started by executing the procedure of S12, so that the filter main body 20 can absorb the water W having passed through the water-conduction holes 30*a* because the absorptive regions 2*a* are immersed in the water reserved in the water tank 18. Furthermore, the air having sent to the filter unit 2 passes through the water-conduction holes 30*a* through the filter main body 20 thus having absorbed the water, and as a result, the humidifier 1 discharges sufficiently moistened air from the outlet port 102. At this point, even when the non-absorptive regions 2*b* are immersed in the water reserved in the water tank 18 and the filter main body 20 is temporarily made watertight during the rotation of the filter unit 2, the amount of water absorbed by the filter main body 20 is never largely reduced because the non-absorptive regions 2*b* are immersed merely for 1 second out of 60 seconds necessary for completing one rotation of the filter unit 2 and the absorptive regions 2*a* are immersed for the remaining 59 seconds.

Next, the CPU 10 determines whether or not the operation section 15 has been operated for stopping the humidification (S13), and when not (NO in S13), the procedure of S13 is repeatedly executed.

When the operation section 15 has been operated for stopping the humidification (YES in S13), the CPU 10 determines whether or not the detector 61 is in an on state (S14), and when it is in an on state (YES in S14), the magnet 62 is already positioned in the switch-on area, and hence, it is determined whether or not the detector 61 is turned off (S15), and when the detector 61 remains in an on state (NO in S15), the procedure of S15 is repeatedly executed.

On the other hand, when the detector 61 is turned off (YES in S15), the magnet 62 having been positioned in the switch-on area goes out of the switch-on area, and hence, the CPU 10 proceeds the processing to following procedure of S16. When the detector 61 is in an off state (NO in S14), the magnet 62 is positioned out of the switch-on area, and hence, the CPU 10 proceeds the processing to following procedure of S16.

After completing the procedure of S14 or S15, the CPU 10 determines whether or not the detector 61 is turned on (S16), and when the detector 61 is in an off state (NO in S16), the magnet 62 is still positioned out of the switch-on area, and hence, the procedure of S16 is repeatedly executed.

When the detector 61 is turned on (YES in S16), the magnet 62 enters the switch-on area, and hence, the CPU 10 starts counting time elapsed from the detector 61 turning on (S17). The time elapsed is counted by, for example, counting clocks.

Subsequently, the CPU 10 determines, on the basis of the count of the time elapsed, whether or not the predetermined period of time stored in the time memory part 131 has elapsed (S18), and when not (NO in S18), the magnet 62 having entered the switch-on area has not reached the center in the circumferential direction of the switch-on area, and hence, the procedure of S18 is repeatedly executed.

When the predetermined period of time stored in the time memory part 131 has elapsed (YES in S18), the magnet 62 having entered the switch-on area has reached the center in the circumferential direction of the switch-on area (namely, the non-absorptive regions 2*b* are just immersed), and hence, the CPU 10 stops the filter motor 41 by controlling the filter motor control section 40 (S19), stops the time-counting started in S17 (S20) and returns the processing to S11.

In such a humidification/non-humidification switching process, the CPU 10 functions as rotation control means.

Through the aforementioned humidification/non-humidification process, when a user does not require humidification, the humidifier 1 stops the rotation of the filter unit 2 in a state where the non-absorptive regions 2*b* are immersed and the absorptive regions 2*a* are not immersed. Therefore, the filter main body 20 does not absorb water, and the filter main body 20 is naturally dried up through drop, evaporation and the like of the water W having absorbed by the filter main body 20.

When merely air is sent by the fan 5 under this condition, the air cleaning with the air cleaning filter 17 alone is executed without performing the humidification with the filter unit 2.

The humidity of the air discharged through the outlet port 102 after the filter unit 2 is dried up is substantially equal to the humidity of the room where the humidifier 1 is installed. Precisely, although the air discharged through the outlet port 102 includes slight moisture evaporated from the water tank 18, this is negligible humidification as compared with the humidification caused when the stopped filter unit 2 continuously absorbs water.

It is noted that the structure of the humidifier 1 is not limited to that described in this embodiment. For example, the air sent by the fan 5 may be heated on an upstream side of the filter unit 2 so as to further accelerate transpiration from the filter unit 2, or an ion generating device may be provided in the vicinity of the outlet port 102 so as to add positive ions or negative ions thus generated to the air to be discharged.

Alternatively, when the humidification is not performed, the fan 5 may cause air to pass through the stopped filter unit 2 at a larger rate than that in a general operation so as to forcedly dry the filter main body 20 already having absorbed water. In this case, a state of the unwanted water absorption of the filter main body 20 does not last a long period of time, and therefore, the growth of mold can be further prevented in the filter unit 2.

Embodiment 2

Figure 6:
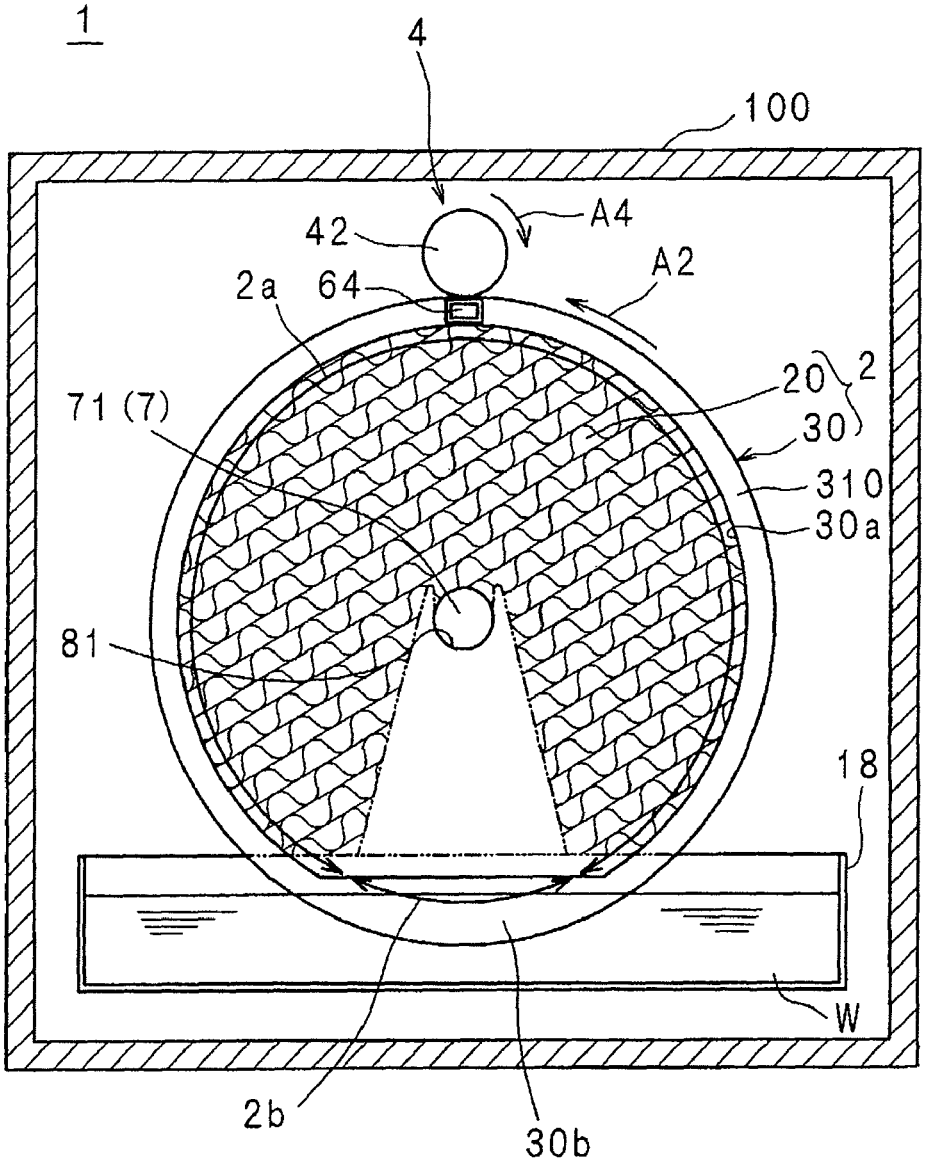
FIG. 6 is a rear view illustrating one face side of a filter unit included in a humidifier according to Embodiment 2 of the invention.
Figure 7:
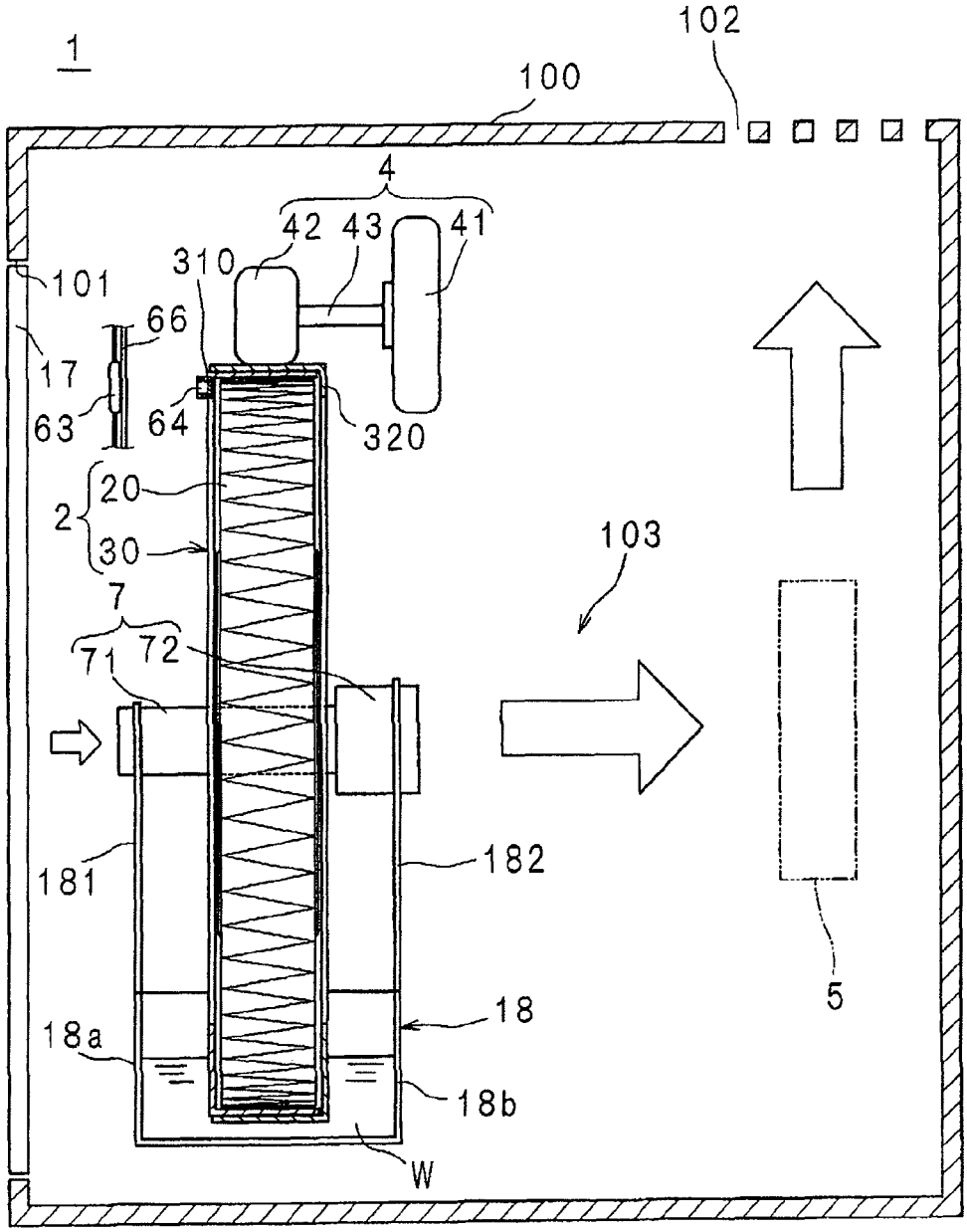
FIG. 7 is a schematic side view illustrating the internal structure of the humidifier according to Embodiment 2 of the invention.

FIG. 6 is a schematic rear view illustrating a one face side of a filter unit included in a humidifier according to Embodiment 2 of the invention and FIG. 7 is a schematic side view illustrating the internal structure of the humidifier.

The humidifier 1 of this embodiment has substantially the same structure as the humidifier 1 of Embodiment 1 and includes a detector 63, a magnet 64 and a printed board 66 respectively instead of the detector 61, the magnet 62 and the printed board 65.

Moreover, like reference numerals are used to refer to like elements of Embodiment 1 so as to omit the description.

The magnet 64 is disposed in a position of point symmetrical, about the center point of the filter unit 2, to the position where the magnet 62 of the filter unit 2 of Embodiment 1 is fixed. In other words, the magnet 64 is disposed in the center in the circumferential direction of the absorptive region 2*a* of the filter unit 2 to be fixed on the holder 30 (more specifically, on the first frame 310).

The detector 63, which is mounted on the printed board 66, is fixed within the housing 100 so as to face the uppermost point of the rotation position of the magnet 64. The detector 63 is, however, disposed nearer the filter motor 41 as compared with the detector 61 of Embodiment 1, and hence, it is necessary to secure a sufficient distance between the detector 63 and the filter motor 41 so as not to cause the malfunction of the detector 63 by the filter motor 41. Note that the detector 63 includes a lead switch or Hall 1C.

Also in this embodiment, when the magnet 64 is positioned in the center in the circumferential direction of the switch-on area, the non-absorptive regions 2*b* of the filter unit 2 are immersed without immersing the absorptive regions 2*a*, and when the magnet 64 is away from the center in the circumferential direction of the switch-on area, at least a part of the absorptive regions 2*a* is immersed.

Therefore, in using the humidifier 1 of this embodiment, the CPU 10 can execute a humidification/non-humidification switching process similar to that of Embodiment 1 for switching the execution of the humidification and the stop of the humidification merely by changing the predetermined period of time to be stored in the time memory part 131.

Embodiment 3

Figure 8:
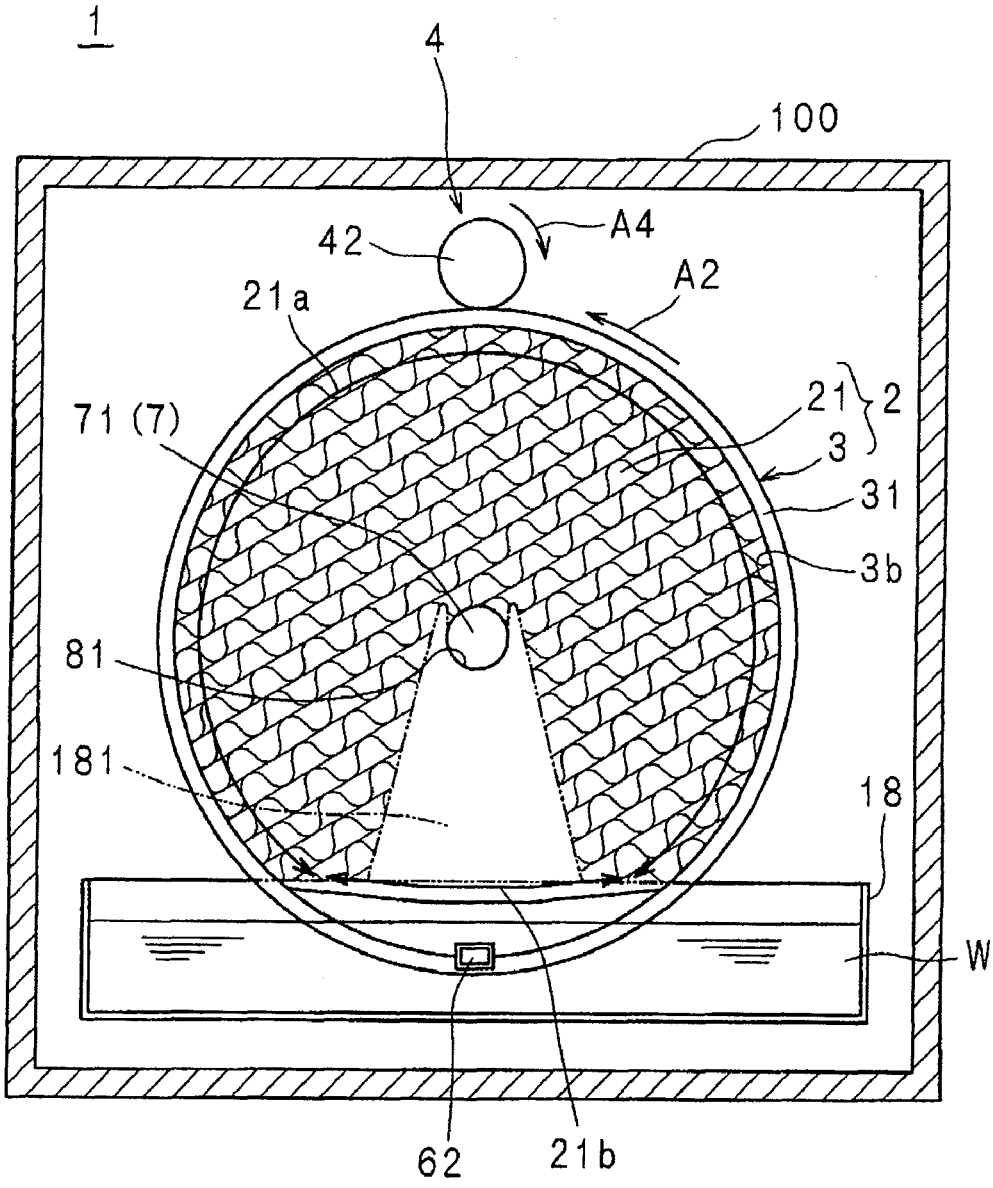
FIG. 8 is a rear view illustrating a one face side of a filter unit included in a humidifier according to Embodiment 3 of the invention.
Figure 9:
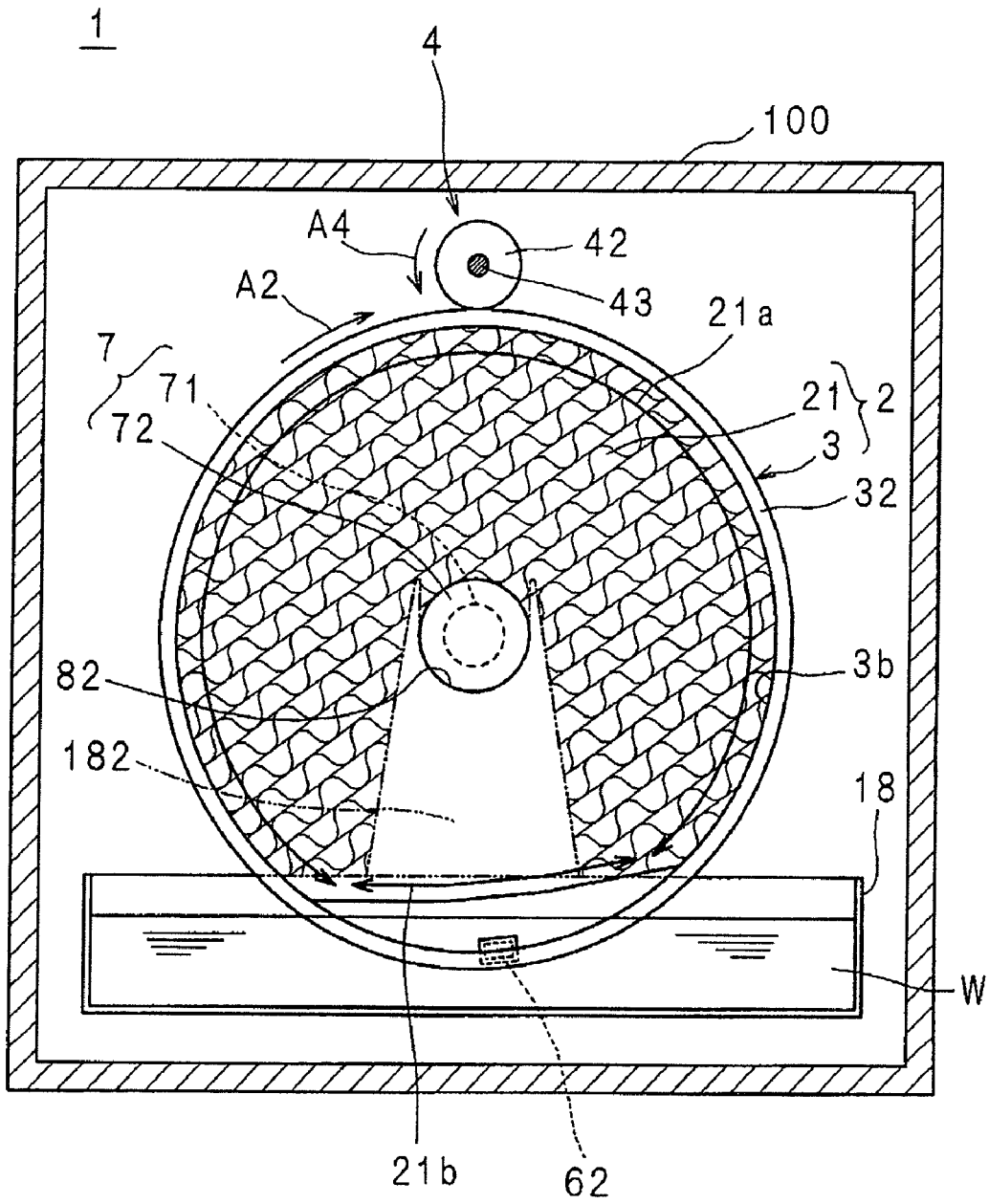
FIG. 9 is a front view illustrating the other face side of the filter unit included in the humidifier according to Embodiment 3 of the invention.
Figure 10:
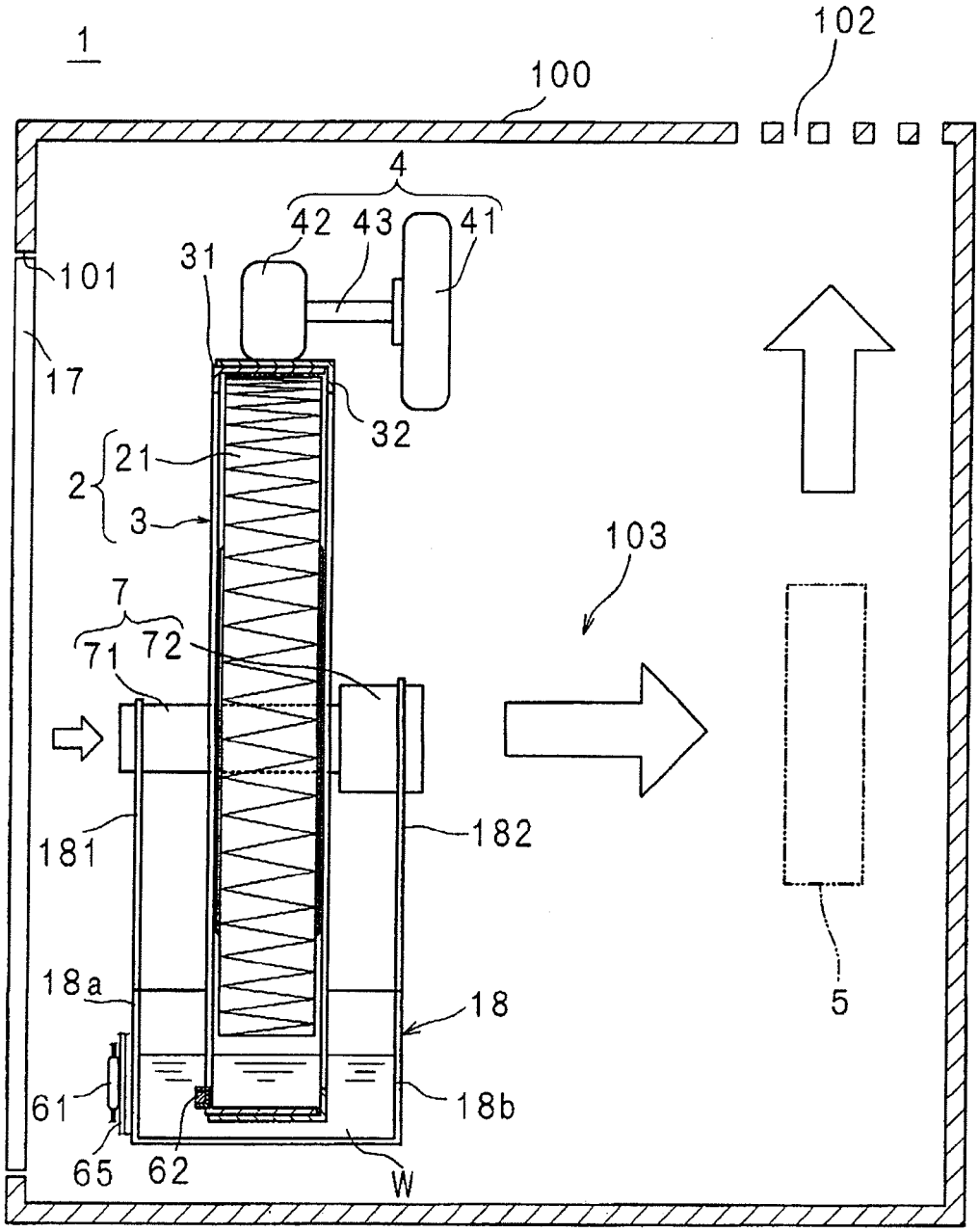
FIG. 10 is a schematic side view illustrating the internal structure of the humidifier according to Embodiment 3 of the invention.
Figure 11:
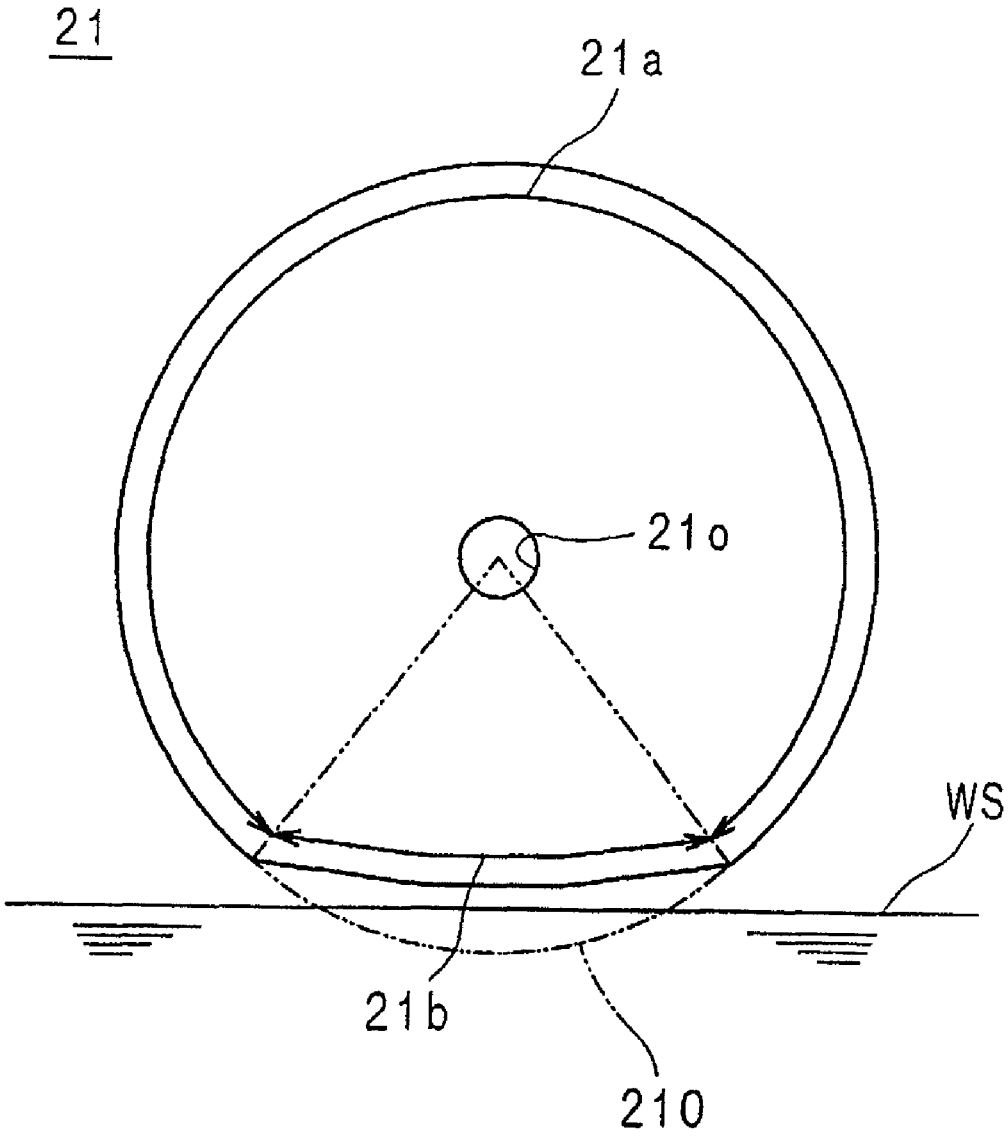
FIG. 11 is a front view illustrating a filter main body to be included in the filter unit of Embodiment 3 of the invention.

FIG. 8 is a schematic rear view illustrating a one face side of a filter unit included in a humidifier according to Embodiment 3 of the invention, and FIG. 9 is a schematic front view illustrating the other face side of the filter unit. Also, FIG. 10 is a schematic side view illustrating the internal structure of this humidifier. Furthermore, FIG. 11 is a front view of a filter main body included in the filter unit.

A block diagram illustrating the structure of a principal part of the humidifier of Embodiment 3 of the invention is substantially the same as the block diagram of FIG. 4.

In these drawings, a reference numeral 1 denotes a humidifier, and the humidifier 1 includes, as illustrated in FIGS. 4 and 8 through 10, a housing 100, a CPU 10, a ROM 11, a RAM 12, an EEPROM 13, a display section 14, an operation section 15, a humidity sensor 16, an air cleaning filter 17, a water tank 18, a filter unit 2 having a water absorbability and air permeability, a rotation drive mechanism 4, a fan 5, a detector 61 and a magnet 62. The filter unit 2 is in a disc shape with an appropriate thickness and includes a filter main body 21 with a honeycomb structure with a water absorbability and air permeability and a non-absorptive frame 3, that is, a frame-shaped holder for holding the filter main body 21. Also, the filter unit 2 is provided with a rotation shaft part 7, and the rotation shaft part 7 is supported by bearings 81 and 82.

The CPU 10 is a control center of the humidifier 1 and is connected to, as illustrated in FIG. 4, the ROM 11, the RAM 12, the EEPROM 13, the display section 14, the operation section 15, the humidity sensor 16, a filter motor control section 40 of the rotation drive mechanism 4, a fan motor control section 50 of the fan 5, and the detector 61 through internal buses or signal lines. The CPU 10 uses the RAM 12 as a work area for controlling respective parts of the humidifier and executing various processing in accordance with a control program and data stored in the ROM 11 and data stored in the EEPROM 13.

A time memory part 131 is provided as a part of a memory area of the EEPROM 13.

As illustrated in FIGS. 8 through 10, the housing 100 has a vertical rectangular parallelepiped shape to be allowed to stand on a floor, has an intake port 101 on its rear face and an outlet port 102 on its top face, includes an air duct 103 for connecting the intake port 101 to the outlet port 102, and in the air duct 103, the air cleaning filter 17, the filter unit 2, the rotation drive mechanism 4, the water tank 18 and the fan 5 are arranged in this order from upstream to downstream of air flow.

The air cleaning filter 17 includes a filter main body with air permeability working for both dust collection and deodorization and a synthetic resin frame for holding the filter main body, and is in a rectangular shape entirely covering the intake port 101, so as to filtrate air passing through the air cleaning filter 17 itself for filtering out fine floating motes and dust and for deodorizing.

The air cleaning filter 17 has a structure that the filter main body is easily manually attached to or removed from the frame by a manufacturer operator or a user of the humidifier 1.

The water tank 18 is provided on the bottom of the housing 100, is in a rectangular tray shape having an opened upper face and reserves water W supplied from a water feeding tank not shown. The water feeding tank is constructed to automatically feed water to the water tank 18 for keeping a predetermined water level in the water tank 18.

The water tank 18 is disposed to have two opposing sidewalls 18*a* and 18*b* thereof along the rear face and the front face of the humidifier 1, and the water tank 18 is in a narrow rectangular shape extending in the lateral direction in a plan view. More specifically, the inner dimension of the water tank 18 in the depth direction (that is, the lateral direction in FIG. 10) is sufficiently larger than the thickness of the filter unit 2 but is largely smaller than the outer diameter of the filter unit 2. On the other hand, the inner dimension of the water tank 18 in the lateral direction (that is, the lateral direction in FIGS. 8 and 9) is sufficiently larger than the outer diameter of the filter unit 2. Therefore, the water W dropped from the filter unit 2 is prevented from leaking out of the water tank 18.

The filter unit 2 is disposed in a vertical orientation so that a part of a circumferential portion of the filter unit 2 may be immersed in water reserved in the water tank 18. As illustrated in FIGS. 8 through 11, the filter main body 21 of the filter unit 2 is in a shape obtained by chipping a part of a disc 210 with an appropriate thickness, and a circular through hole 21*o* is formed in a position corresponding to the center of the disc 210. The filter main body 21 has an immersion region 21*a* for immersing the filter main body 21 with water W having entered inside the frame 3 holding the filter main body 21 and a non immersion region 21*b* for not immersing the filter main body 21 arranged adjacent to each other in the circumferential direction.

FIGS. 8, 10 and 11 illustrate a case where the filter unit 2 including the filter main body 21 is stopped with the center in the circumferential direction of the non immersion region 21*b* positioned directly below the center of the through hole 21*o* (hereinafter referred to as the center of the filter main body 21) (which position is hereinafter described simply as directly below).

The immersion region 21*a* and the non immersion region 21*b* are respectively provided in a part and a remaining part of the outer circumferential portion of the filter main body 21, and the immersion region 21*a* has an outer edge in an arc shape having a central angle (an internal angle) exceeding two right angles. Accordingly, a portion of the filter main body 21 including the immersion region 21*a* as its outer circumferential portion is in a fan shape having a central angle exceeding two right angles. On the other hand, the non immersion region 21*b* has an outer edge in a polygonal shape convex in the radial direction of the filter main body 21. Accordingly, a portion of the filter main body 21 including the non immersion region 21*a* as its outer circumferential portion is in a polygonal shape (that is, a pentagonal shape in this embodiment) having a central angle smaller than two right angles. Also, the filter main body 21 is in a line symmetrical shape having a symmetry axis of a virtual line extending as a straight line between the center of the filter main body 21 and the center in the circumferential direction of the non immersion region 21*b*.

Such a filter main body 21 is fabricated by cutting a part of an outer circumferential portion of a filter material in a disc shape or punching a filter material in a rectangular plate shape into a desired shape, and is substantially in a D shape in a front view.

A distance between the center of the filter main body 21 and a still water surface WS of the water tank 18 is smaller than a distance between the center of the filter main body 21 and the immersion region 21*a* and is longer than a distance between the center of the filter main body 21 and the non immersion region 21*b*. Therefore, when the filter unit is stopped with the center in the circumferential direction of the non immersion region 21*b* positioned directly below, the filter main body 21 is placed in a non-immersion state. Since the filter main body 21 does not absorb water in the non-immersion state, the filter main body 21 is dried up, and moisture absorption by air passing through the filter main body 21 is prevented.

Alternatively, when the filter unit is stopped with the center in the circumferential direction of the non immersion region 21*b* positioned directly below, a center distance between the center in the circumferential direction and the still water surface WS is small but an end distance between each end in the circumferential direction of the non immersion region 21*b* and the still water surface WS is large.

Figure 21:
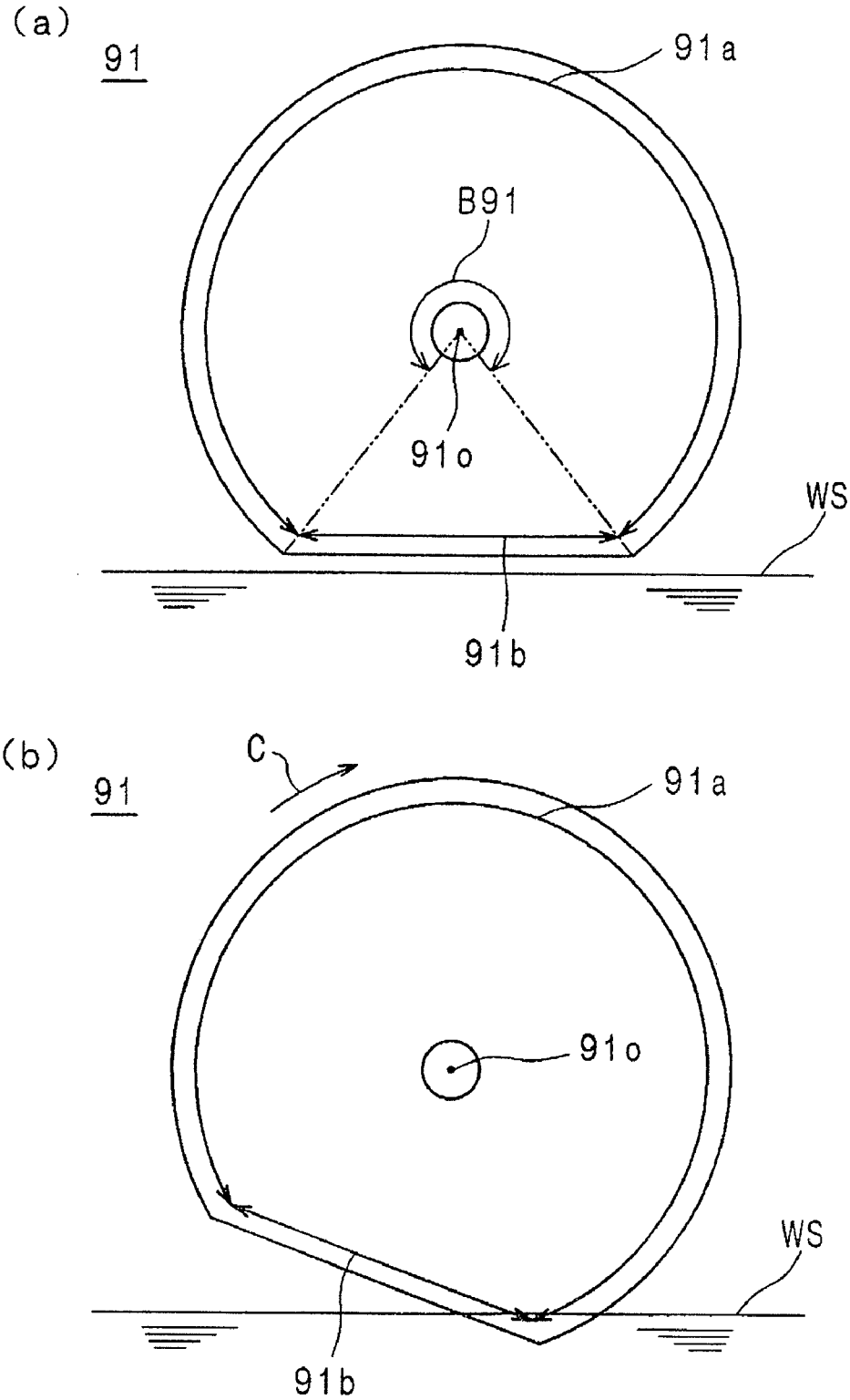
FIGS. 21A and 21B are front views schematically illustrating a shape of a filter main body having a linear outer edge to be included in a humidifier of the invention.
Figure 22:
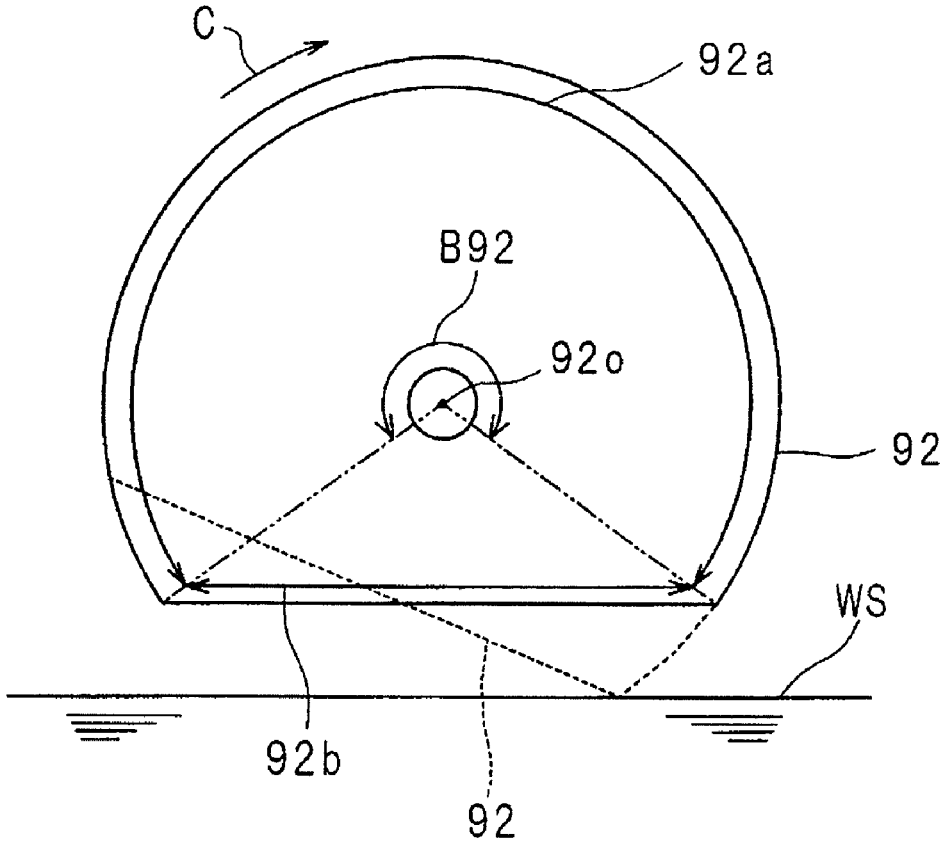
FIG. 22 is a front view schematically illustrating a shape of another filter main body having a linear outer edge to be included in the humidifier of the invention.
Figure 23:
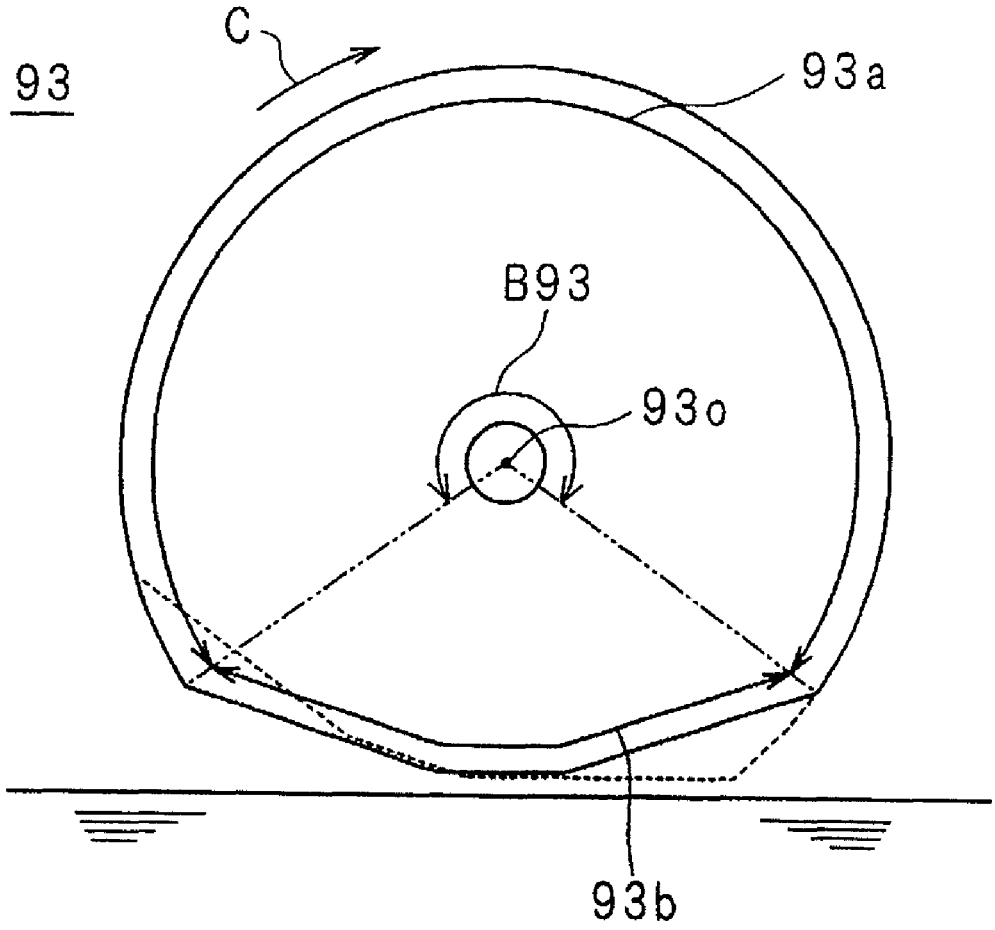
FIG. 23 is a front view schematically illustrating a shape of a filter main body having a polygonal outer edge to be included in the humidifier of the invention.
Figure 24:
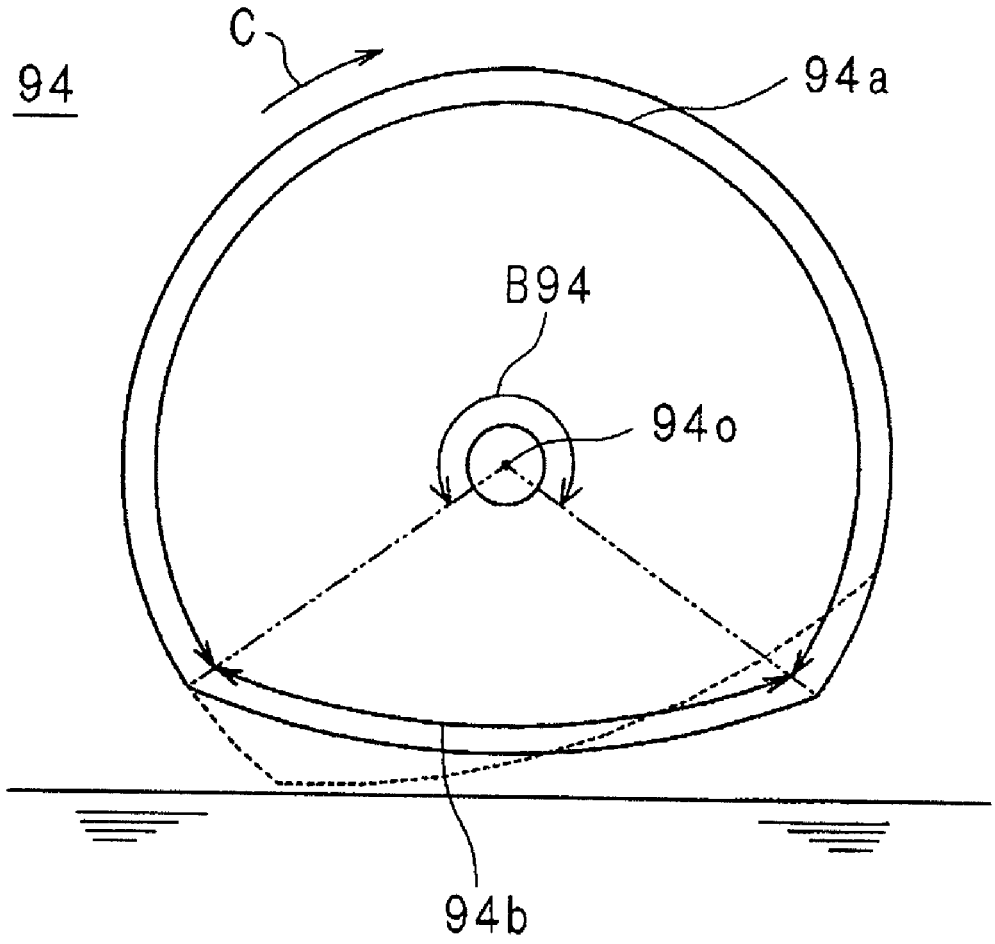
FIG. 24 is a front view schematically illustrating a shape of another filter main body to be included in the humidifier of the invention.

If the outer edge of the non immersion region 21*b* is not in a polygonal shape but in a linear shape (see FIG. 21A), the center distance and the end distance are equal to each other. In such a case, when the center distance is too small, a head in the rotation direction of the immersion region 21*a* (or a tail thereof in the rotation direction) may be immersed in the water reserved in the water tank 18 if the center in the circumferential direction of the non immersion region 21*b* is shifted in the rotation direction (or in the direction opposite to the rotation) beyond the position directly below (see FIG. 21B). In order to increase the center distance, however, the size of the filter main body 21 should be reduced (see FIG. 22).

In other words, when a sufficient space is provided between each end in the circumferential direction of the non immersion region 21*b* and the still water surface WS, unwanted immersion of the filter main body 21 is prevented so as to prevent unwanted water absorption, and in addition, the amount of water W to be absorbed by the filter main body 21 is increased.

As illustrated in FIGS. 8 through 10, the frame 3 is made of synthetic resin and is in a ring shape extending along the outer circumferential face of the immersion region 21*a* of the filter main body 21. The frame 3 for holding the filter main body 21 has a structure that can be easily manually assembled or disassemble by a manufacturer operator or a user, and therefore, a manufacturer operator or a user can easily manually attach or remove the filter main body 21 to or from the frame 3.

More specifically, the frame 3 is composed of a first frame 31 and a second frame 32, and each of the first frame 31 and the second frame 32 is in the shape of, so to speak, a circular dish having a substantially D-shaped water-conduction hole 3*b* on its bottom, and the filter main body 21 is held by covering the outer circumferential face of the filter main body 21 and a portion on the one face side in the vicinity of the outer circumferential face of the filter main body 21 with the sidewall and the bottom of the first frame 31 and by covering the outer sidewall of the first frame 31 and a portion on the other face side face in the vicinity of the outer circumferential face of the filter main body 21 with the sidewall and the bottom of the second frame 32. The water W and air having passed through the water-conduction holes 3*b* reach the filter main body 21 held inside the frame 3.

The rotation shaft part 7 in a cylindrical shape perpendicular to the filter main body 21 is provided in the center of the filter unit 2. The filter unit 2 is disposed in a vertical orientation so that a part of a circumferential portion thereof may be immersed in the water reserved in the water tank 18, and therefore, the rotation shaft part 7 is disposed in a horizontal orientation.

At this point, the rotation shaft part 7 is rotatably supported by the bearings 81 and 82 respectively provided on supporting parts 181 and 182 extending upward respectively from the sidewalls 18*a* and 18*b* of the water tank 18, and as a result, the filter unit 2 is supported rotatably around the rotation shaft part 7 in the circumferential direction. The center of the rotation shaft part 7 is fit in the through hole 21*o* of the filter main body 21 so as to be fixed with a frictional force.

The rotation shaft part 7 penetrates the center of the water-conduction holes 3*b* and has a one end 71 and the other end 72 having a larger outer diameter than the one end 71 with a central portion of the rotation shaft part 7 sandwiched there between. The outer diameter of the one end 71 is equal to the outer diameter of the central portion of the rotation shaft part 7, and the one end 71 of the rotation shaft part 7 is inserted into the through hole 21*o* of the filter main body 21 so that the one end 71 can be disposed on the one face side of the filter main body 21 (and the filter unit 2 in turn) with the other end 72 disposed on the other face side.

The bearing 81 provided on the supporting part 181 is in a U shape with a dimension according to the outer diameter of the one end 71 and rotatably supports the one end 71 inserted from above the U shape. Similarly, the bearing 82 provided on the supporting part 182 has a dimension according to the outer diameter of the other end 72 and rotatably supports the other end 72.

The filter unit 2 including the filter main body 21 attached to the frame 3 has a structure that can be easily manually attached/removed to/from the supporting parts 181 and 182 by a manufacturer operator or a user.

The detector 61 is provided on the sidewall 18*a* of the water tank 18, and the magnet 62 is provided on the one face side of the filter unit 2 (namely, the face side from which the one end 71 protrudes), and since the detector 61 detects approach/departure of the magnet 62, it is necessary for a user to attach the filter unit 2 with the face side having the magnet 62 opposing the sidewall 18*a*. Therefore, when the one end 71 is supported by the bearing 81 in the dimension according to the one end 71 and the other end 72 is supported by the bearing 82 with the dimension according to the other end 72, a user can easily and accurately attach the filter unit 2 without considering the positional relationship between the detector and the magnet 62.

If a user tries to make the one end 71 supported by the bearing 82 and the other end 72 supported by the bearing 81, the other end 72 cannot be inserted into the bearing 81, and therefore, the filter unit 2 is never set in a wrong direction.

Incidentally, the magnet 62 is fixed on the first frame 31 and rotatively moved while describing a circular path in accordance with the rotation of the filter unit 2. More specifically, the magnet 62 is disposed on a side closer to the non immersion region 21*b* of a virtual line extending between the center of the filter main body 21 and the center in the circumferential direction of the non immersion region 21*b*. Therefore, when the magnet 62 is positioned directly below, the center in the circumferential direction of the non immersion region 21*b* is also positioned directly below.

The detector 61 is fixed so as to face the lowermost point of the rotation position of the magnet 62, and specifically, the printed board 65 is fixed on the sidewall 18*a* of the water tank 18 and the detector 61 is mounted on the printed board 65 (more specifically, in a center of the printed board 65 in the lateral direction of the sidewall 18*a*).

The detector 61 is connected to the CPU 10 through a signal line formed on the printed board 65, so as to be turned on when the magnet 62 comes into a predetermined area in the vicinity of the detector 61 and to be turned off when the magnet 62 goes out of the predetermined area. In other words, when the magnet 62 comes close to the detector 61, the detector 61 is turned on, and when the magnet 62 goes away from the detector 61, it is turned off. As a result, the detector 61 detects the approach/departure of the magnet 62 to/from the detector 61. Also, the magnet 62 is provided on the filter unit 2 and functions as the detection target to be detected by the detector 61 working as the detector. Note that the detector 61 includes a lead switch or Hall 1C.

When the detector 61 is turned on, it outputs an on signal corresponding to its transition to an on state to the CPU 10, and when the detector 61 is turned off, it stops outputting the on signal. On the other hand, when the on signal is input from the detector 61, the CPU 10 determines that the detector 61 is in an on state, and when the on signal is not input, it determines that the detector 61 is in an off state.

The detector 61 is continuously in an on state while the magnet 62 is positioned within the predetermined area in the circumferential direction of the filter unit 2. The predetermined area is hereinafter designated as a switch-on area.

When the magnet 62 is positioned in the center in the circumferential direction of the switch-on area, the magnet 62 and the center in the circumferential direction of the non immersion region 21*b* in turn are positioned directly below. In this case, the filter main body 21 is not immersed. On the other hand, when the magnet 62 is positioned largely away from the center in the circumferential direction of the switch-on area, at least a part of the immersion region 21*a* is immersed in water, and the filter main body 21 is immersed in the water.

In the case where air humidification is not performed, it is necessary to stop the rotation of the filter unit 2 in a state where the filter main body 21 is not immersed, and therefore, the detector 61 and the magnet 62 are used for attaining the timing of stopping the rotation.

The time memory part 131 of the EEPROM 13 stores, as a predetermined period of time, ½ of time having elapsed from the magnet 62 entering the switch-on area to the magnet 62 leaving the switch-on area (namely, time having elapsed from the magnet 62 entering the switch-on area to the magnet 62 reaching the center in the circumferential direction of the switch-on area). The predetermined period of time is calculated on the basis of a measurement result obtained by actually rotating the filter unit 2 by the rotation drive mechanism 4 so as to be stored in the time memory part 131, for example, before forwarding the humidifier 1 from the factory. Therefore, assuming that the filter unit 2 completes one rotation in 60 seconds and that the magnet 62 passes through the switch-on area in 1 second in accordance with the rotation of the filter unit 2, the time memory part 131 stores 0.5 second as the predetermined period of time.

As illustrated in FIGS. 4 and 8 through 10, the rotation drive mechanism 4 includes the filter motor control section 40, an electric filter motor (motor) 41, a rotation roller (roller) 42 in contact with the outer circumferential face of the frame 3 for rotating the filter unit 2 and a coupling shaft 43. Although the filter main body 21 is not in a disc shape, the frame 3 is in a ring shape, and therefore, the filter unit 2 can be rotated with the rotation roller 42 in contact with the outer circumferential face of the frame 3.

The filter motor control section 40 is controlled by the CPU 10 so as to supply a control signal corresponding to revolutions per minute [rpm] to the filter motor 41. The filter motor 41 includes an AC motor and is operated with desired revolutions per minute in accordance with the control signal supplied from the filter motor control section 40.

An output shaft of the filter motor 41 and a rotation shaft of the rotation roller 42 are coupled to each other through the coupling shaft 43, so that the rotation roller 42 can be rotated in a direction indicated by an arrow A4 in FIGS. 8 and 9 (that is, the clockwise direction in FIG. 8) through the operation of the filter motor 41. In other words, the filter motor 41 rotates the rotation roller 42.

The rotation roller 42 is disposed with the circumferential face thereof in contact with the uppermost point of the outer circumferential face of the filter unit 2, and the rotation shaft part 7 and the rotation shaft of the rotation roller 42 are disposed to be parallel to each other.

Therefore, when the rotation roller 42 is rotated through the operation of the filter motor 41, the filter unit 2 is rotated in the direction indicated by an arrow A2 in FIG. 8 (that is, the counterclockwise direction in FIG. 8) in accordance with the rotation of the rotation roller 42.

In other words, the rotation drive mechanism 4 rotates the filter unit 2 in the circumferential direction.

The fan 5 includes a sirocco fan and contains the fan motor control section 50, an electric fan motor 51 and blades 52 as illustrated in FIG. 4. The fan motor control section 50 is controlled by the CPU 10 so as to supply a control signal corresponding to revolutions per minute [rpm] to the fan motor 51. The fan motor 51 includes an AC motor and is operated in accordance with the control signal supplied by the fan motor control section 50.

The blades 52 are rotated through the operation of the fan motor 51, so as to introduce air with low humidity through the intake port 101 and allow the air to pass through the air cleaning filter 17 and the filter unit 2 in this order. At this point, the air is sent to the air cleaning filter 17 and the filter unit 2 in a direction perpendicular to the air cleaning filter 17 and the filter unit 2. In other words, the fan 5 causes air to pass through the filter unit 2 in the direction crossing the filter unit 2.

The air introduced through the intake port 101 by the fan 5 passes through the air duct 103 in a direction indicated by white arrows in FIG. 10. More specifically, the air introduced through the intake port 101 is first cleaned by passing through the air cleaning filter 17. Subsequently, the cleaned air passes through the filter unit 2 so as to vaporize the water W having been absorbed by the filter unit 2, and the vaporized water W is involved in the air passing through the filter unit 2 (namely, the air is moistened with water vapor). The air thus increased in the humidity is discharged through the outlet port 102 to a room where the humidifier 1 is installed. When the filter unit 2 is dried up, however, the air passing through the filter unit 2 is never moistened.

The humidity sensor 16 of FIG. 4 detects the humidity of the room where the humidifier 1 is installed and supplies the detection result to the CPU 10. In this embodiment, the CPU 10 allows the display section 14 to display the detection result obtained by the humidity sensor 16, so as to inform a user of the humidity of the room.

The display section 14 displays, for example, the operation state of the humidifier 1, the humidity of the room and the like under control of the CPU 10, and the operation section 15 includes various functions keys of hard keys. In this embodiment, a user of the humidifier 1 issues various instructions to the humidifier 1 by operating the operation section 15 while referring to the display section 14. Incidentally, the extent of the humidification and the rate of passing air may be automatically set by the CPU 10, for example, in accordance with the detection result obtained by the humidity sensor 16.

A flowchart of procedures in a humidification/non-humidification switching process executed by the CPU of the humidifier according to Embodiment 3 of the invention is substantially the same as that illustrated in FIG. 5.

A user makes the humidifier 1 start the humidification or stop the humidification by operating the operation section 15.

The CPU 10 determines whether or not the operation section 15 has been operated for starting the humidification (S11), and when not (NO in S11), the procedure of S11 is repeatedly executed.

When the operation section 15 has been operated for starting the humidification (YES in S11), the CPU 10 actuates the filter motor 41 by controlling the filter motor control section 40 (S12). In the case where the fan motor 51 is in a stop state when the procedure of S12 is executed, the CPU 10 actuates the fan motor 51 by controlling the fan motor control section 51 so as to start causing air to pass through the filter unit 2 through the rotation of the blades 52 of the fan 5.

Through the execution of the procedure of S12, the filter motor 41 actuates to rotate the filter unit 2 in the circumferential direction, so that the water W may enter inside the frame 3 through the water-conduction holes 3*b*. Also, in accordance with the rotation in the circumferential direction of the filter unit 2, a state where a part of the circumferential portion of the filter main body 21 is immersed in the water (namely, a state where the immersion region 21*a* is immersed with the water W having entered inside the frame 3) and a state where the filter main body 21 is not immersed (namely, a state wherein the immersion region 21*a* is not immersed with the water W having entered inside the frame 3) are continuously alternated.

When the immersion region 21*a* is moved downward to be immersed in the water, the filter main body 21 is immersed so as to absorb the water W. On the other hand, when both of the immersion region 21*a* and the non immersion region 21*b* are not immersed in the water, the filter main body 21 is not immersed with and does not absorb the water. At this point, even when the filter main body 21 is temporarily placed in a non-immersion state during the rotation of the filter unit 2, the amount of water absorbed by the filter main body 21 is never largely reduced because the filter main body 21 is placed in the non-immersion state merely for 1 second out of 60 seconds necessary for completing one rotation of the filter unit 2 and the filter main body 21 is immersed in the water for the remaining 59 seconds.

The water W absorbed through the immersion region 21*a* immersed in the water is sucked up by another portion of the filter main body 21 not immersed, and hence, the water W diffuses all over the filter main body 21. In other words, the filter unit 2 efficiently absorbs water with the entire filter main body 21.

When air is sent by the fan 5 to the filter unit 2 having efficiently absorbed the water with the entire filter main body 21, the sent air passes through the water-conduction holes 3*b* and through the filter main body 21 having absorbed the water to sufficiently absorb moisture. Therefore, the humidifier 1 discharges the sufficiently moistened air through the outlet port 102.

Next, the CPU 10 determines whether or not the operation section 15 has been operated for stopping the humidification (S13), and when not (NO in S13), the procedure of S13 is repeatedly executed.

When the operation section 15 has been operated for stopping the humidification (YES in S13), the CPU 10 determines whether or not the detector 61 is in an on state (S14), and when it is in an on state (YES in S14), the magnet 62 is already positioned in the switch-on area, and hence, it is determined whether or not the detector 61 is turned off (S15), and when the detector 61 remains in an on state (NO in S15), the procedure of S15 is repeatedly executed.

On the other hand, when the detector 61 is turned off (YES in S15), the magnet 62 positioned in the switch-on area goes out of the switch-on area, and hence, the CPU 10 proceeds the processing to following procedure of S16. When the detector 61 is in an off state (NO in S14), the magnet 62 is positioned out of the switch-on area, and hence, the CPU 10 proceeds the processing to following procedure of S16.

After completing the procedure of S14 or S15, the CPU 10 determines whether or not the detector 61 is turned on (S16), and when the detector 61 is in an off state (NO in S16), the magnet 62 is still positioned out of the switch-on area, and hence, the procedure of S16 is repeatedly executed.

When the detector 61 is turned on (YES in S16), the magnet 62 enters the switch-on area, and hence, the CPU 10 starts counting time elapsed from the detector 61 turning on (S17). The time elapsed is counted by, for example, counting clocks.

Subsequently, the CPU 10 determines, on the basis of the count of the time elapsed, whether or not the predetermined period of time stored in the time memory part 131 has elapsed (S18), and when not (NO in S18), the magnet 62 having entered the switch-on area has not reached the center in the circumferential direction of the switch-on area, and hence, the procedure of S18 is repeatedly executed.

When the predetermined period of time stored in the time memory part 131 has elapsed (YES in S18), the magnet 62 having entered the switch-on area has reached the center in the circumferential direction of the switch-on area (namely, the center in the circumferential direction of the non immersion regions 21 has come to the position directly below), and hence, the CPU 10 stops the filter motor 41 by controlling the filter motor control section 40 (S19), stops the time counting started in S17 (S20) and returns the processing to S11.

In such a humidification/non-humidification switching process, the CPU 10 functions as rotation control means.

Through the aforementioned humidification/non-humidification process, when a user does not require humidification, the rotation of the filter unit 2 is stopped with the filter main body 21 not immersed in the humidifier 1. Therefore, the filter main body 21 does not absorb water, and the filter main body 21 is naturally dried up through drop, evaporation and the like of the water W having absorbed by the filter main body 21.

When merely air is sent by the fan 5 under this condition, the air cleaning with the air cleaning filter 17 alone is executed without performing the humidification with the filter unit 2.

The humidity of the air discharged through the outlet port 102 after the filter main body 21 is dried up is substantially equal to the humidity of the room where the humidifier 1 is installed. Precisely, although the air discharged through the outlet port 102 includes slight moisture evaporated from the water tank 18, this is negligible humidification as compared with the humidification caused when the stopped filter main body 21 continuously absorbs water.

Incidentally, due to a detection error of the magnet 62 by the detector 61 or variation in the revolutions per minute of the filter unit 2 caused by the rotation drive mechanism 4, the filter unit 2 may be stopped with the position of the magnet 62 slightly shifted from the center in the circumferential direction of the switch-on area. In other words, the filter unit 2 may be stopped in S19 with the center in the circumferential direction of the non immersion region 21*b* not positioned directly below but slightly shifted in the circumferential direction.

Even when such shift is caused, since there is a sufficient space between each end in the circumferential direction of the non immersion region 21*b* and the still water surface WS, the problem of the unwanted immersion of the filter main body 21 is avoided. Similarly, even when the filter unit 2 is stopped with the non immersion region 21*b* and the still water surface WS relatively inclined against each other because the humidifier 1 is installed in an inclined orientation, the problem of the immersion of the filter main body 21 in water is avoided.

It is noted that the structure of the humidifier 1 is not limited to that described in this embodiment. For example, the air sent by the fan 5 may be heated on an upstream side of the filter unit 2 so as to further accelerate transpiration from the filter unit 2, or an ion generating device may be provided in the vicinity of the outlet port 102 so as to add positive ions or negative ions thus generated to the air to be discharged.

Alternatively, when the humidification is not performed, the fan 5 may cause air to pass through the stopped filter unit 2 at a larger rate than that in a general operation so as to forcedly dry the filter main body 21 already having absorbed water. In this case, a state of the unwanted water absorption of the filter main body 21 does not last a long period of time, and therefore, the growth of mold can be further prevented in the filter unit 2.

Further alternatively, the magnet 62 may be disposed on a side closer to the immersion region 21*a* of a vertical line extending between the center of the filter main body 21 of the frame 3 and the center in the circumferential direction of the non immersion region 21*b*, or the lead switch 61 and the printed board 65 may be disposed in a position other than the position on the water tank 18. Also in this case, the CPU 10 can execute processing similar to the aforementioned humidification/non-humidification switching process for switching the execution of the humidification and the stop of the humidification merely by changing the predetermined period of time to be stored in the time memory part 131.

Moreover, the shape of the filter main body included in the filter unit 2 is not limited to a bilaterally symmetrical shape.

Figure 12:
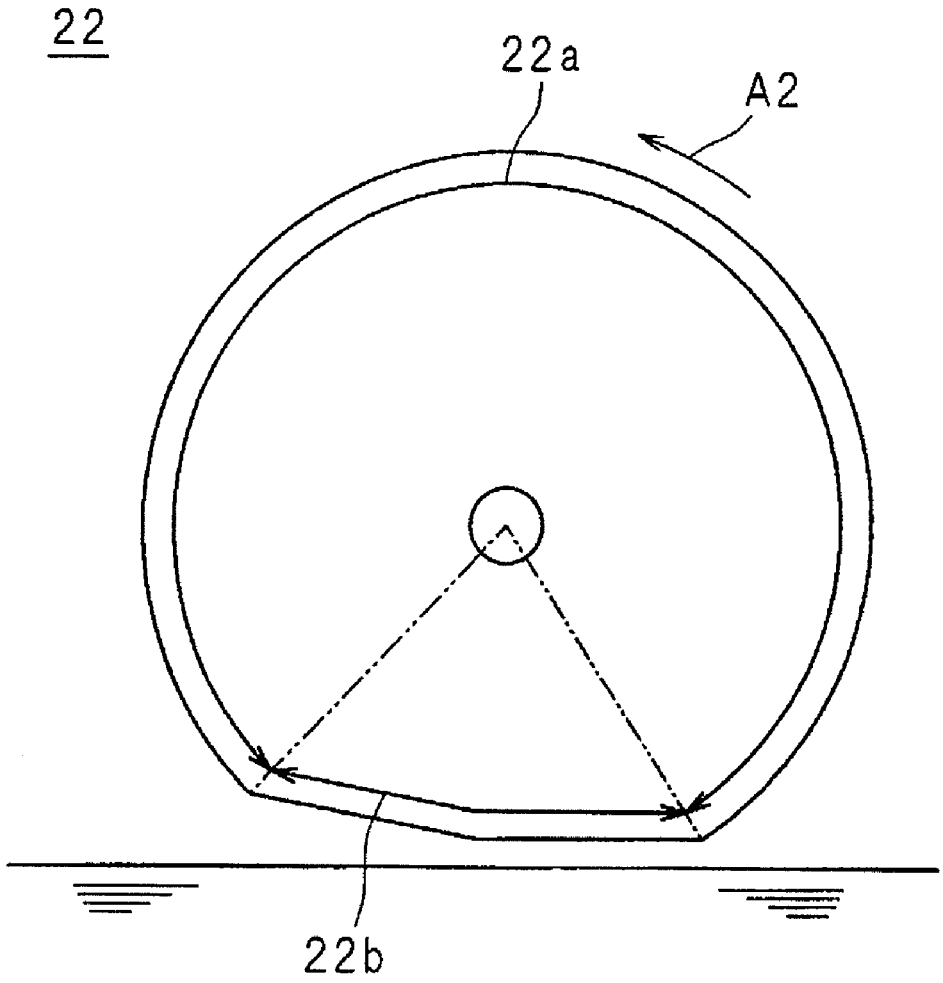
FIG. 12 is a front view illustrating another filter main body to be included in the filter unit of Embodiment 3 of the invention.

FIG. 12 is a front view of another filter main body to be included in the filter unit 2.

In the drawing, a reference numeral 22 denotes a filter main body, the filter main body 22 has a structure similar to the filter main body 21, and an immersion region 22*a* corresponding to the immersion region 21*a* and a non immersion region 22*b* corresponding to the non immersion region 21*b* are arranged adjacent to each other in the circumferential direction.

The non immersion region 22*b* has an outer edge in a polygonal shape similar to the outer edge of the non immersion region 21*b*. However, although the outer edge of the non immersion region 21*b* includes a horizontal portion in the center and inclined portions at both ends as illustrated in FIG. 11, the outer edge of the non immersion region 22*b* has a horizontal portion on the side of a head in the rotation direction (that is, a direction indicated by an arrow A2) and an inclined portion on the side of a tail as illustrated in FIG. 12.

When the filter unit 2 including the non immersion region 22*b* is stopped, if there is a possibility of positional shift in the rotation direction but there is no possibility of positional shift in the direction opposite to the rotation, there is no need for the non immersion region 22*b* to have an inclined portion on the side of the head in the rotation direction. As a result, the filter main body 22 thus attains a larger size.

Embodiment 4

Figure 13:
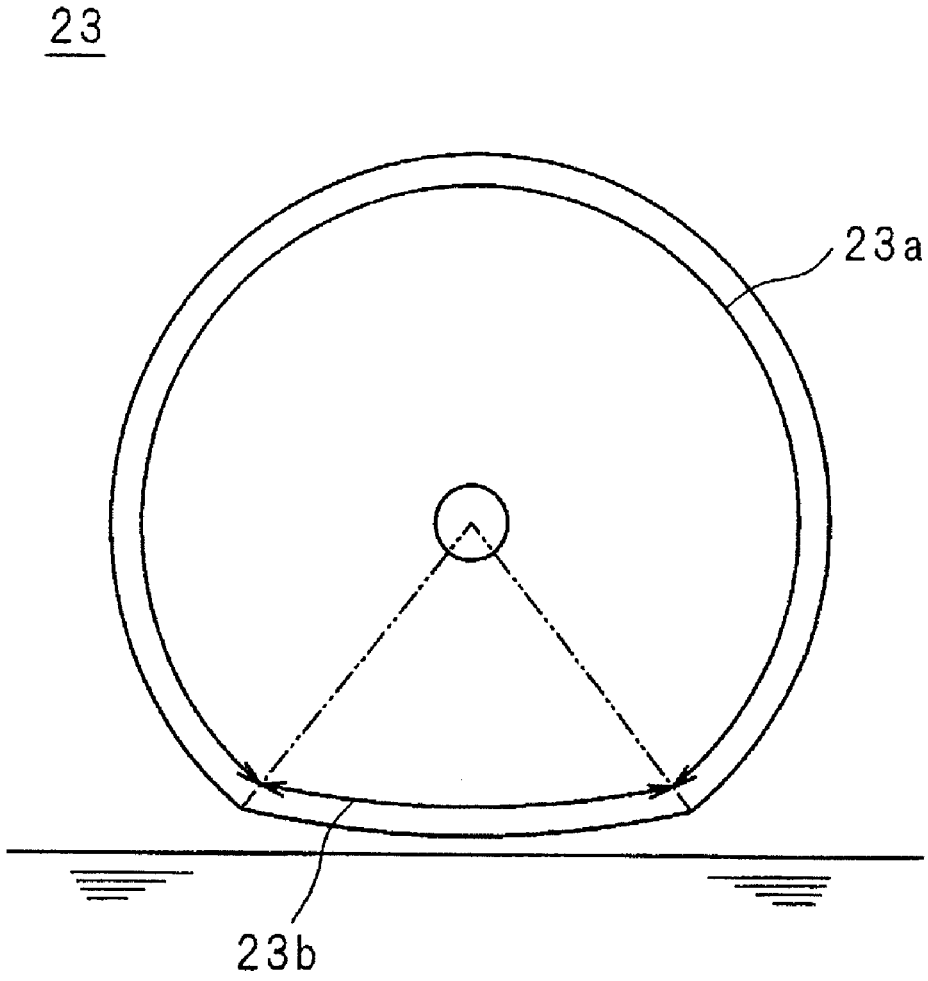
FIG. 13 is a front view illustrating a filter main body to be included in a filter unit according to Embodiment 4 of the invention.

FIG. 13 is a front view of a filter main body included in a filter unit according to Embodiment 4 of the invention.

In this drawing, a reference numeral 23 denotes a filter main body, the filter main body 23 has a structure similar to the filter main body 21, and an immersion region 23*a* corresponding to the immersion region 21*a* and a non immersion region 23*b* corresponding to the non immersion region 21*b* are arranged adjacent to each other in the circumferential direction.

The non immersion region 23*b* has an outer edge in a shape of an arc having a larger radius (namely, smaller curvature) than the outer edge of the immersion region 23*a*. The filter main body 23 is fabricated, in the same manner as the filter main body 21, by cutting a part of an outer circumferential portion of a filter material in a disc shape or punching a filter material in a rectangular shape into a desired shape, and is substantially in a D shape in a front view.

When such a filter main body 23 is used for obtaining the filter unit 2, the same effects as those attained by the filter unit 2 including the filter main body 21 can be attained.

Embodiment 5

Figure 14:
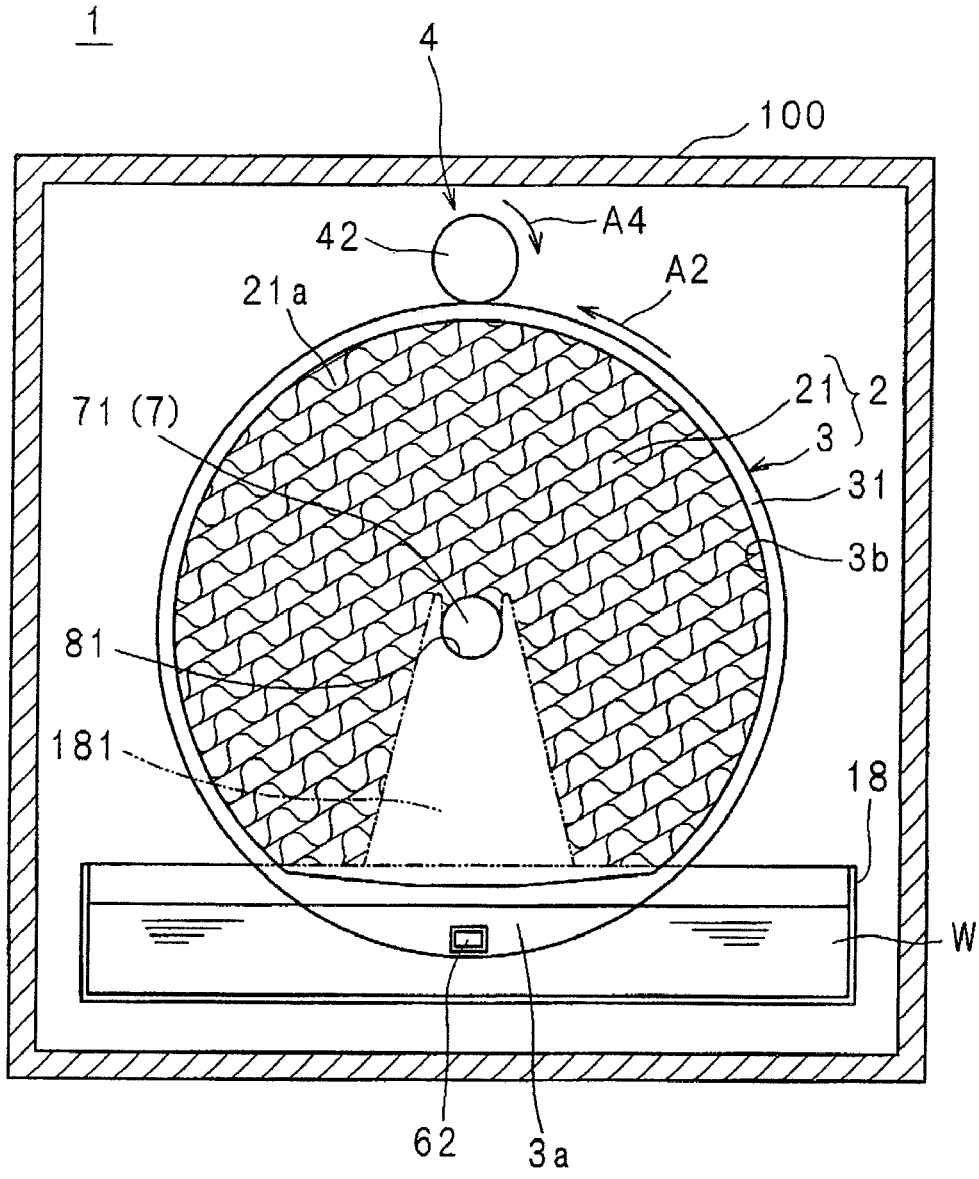
FIG. 14 is a rear view illustrating a one face side of a filter unit included in a humidifier according to Embodiment 5 of the invention.
Figure 15:
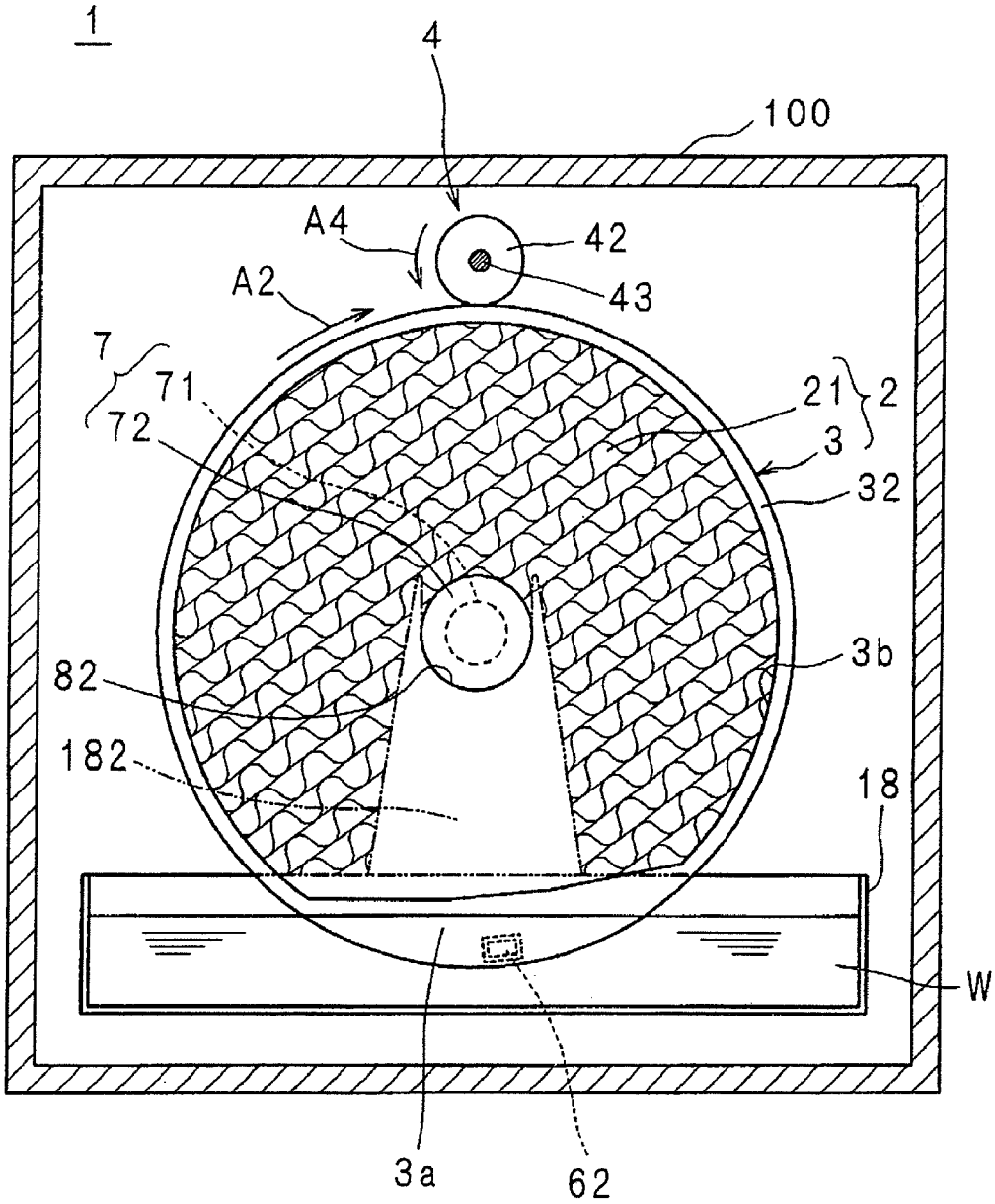
FIG. 15 is a schematic front view illustrating the other face side of the filter unit included in the humidifier according to Embodiment 5 of the invention.
Figure 16:
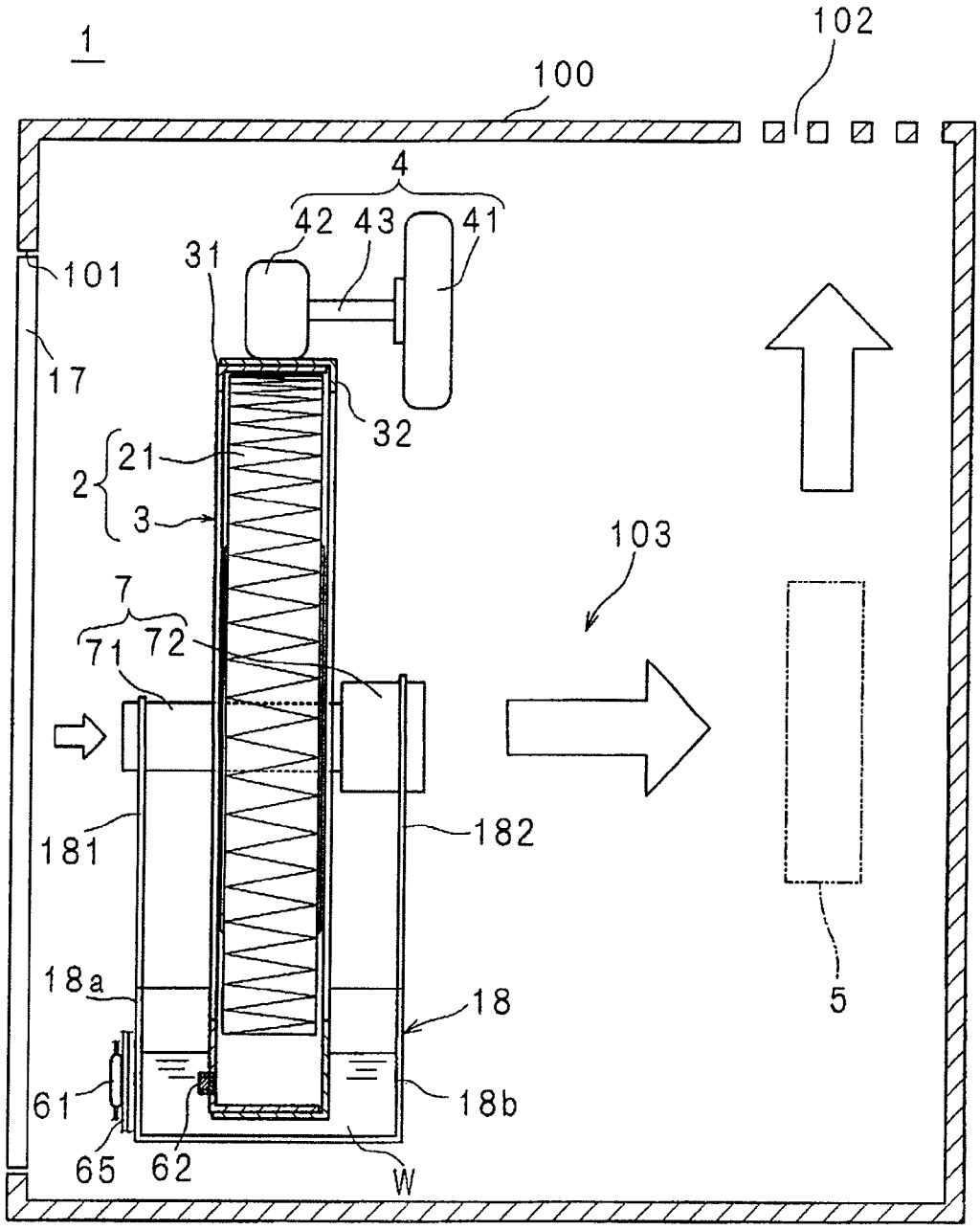
FIG. 16 is a schematic side view illustrating the internal structure of the humidifier according to Embodiment 5 of the invention.

FIG. 14 is a schematic rear view illustrating a one face side of a filter unit included in a humidifier according to Embodiment 5 of the invention and FIG. 15 is a schematic front view illustrating the other face side of the filter unit. Also, FIG. 16 is a schematic side view illustrating the internal structure of the humidifier.

The humidifier 1 of Embodiment 5 has a similar structure to the humidifier 1 of Embodiment 3, and on a synthetic resin frame 3 having a non water absorbability, watertight sections 3*a* each in a substantially bow shape in a front view for preventing water entering inside the frame 3 are formed correspondingly to a non immersion region 21*b*.

Moreover, like reference numerals are used to refer to like elements used in Embodiment 3 so as to omit the description.

Each watertight section 3*a* is integrally formed on a portion of a first frame 31 (or a second frame 32) covering a one face side (or the other face side) of a filter main body 21 and is in a plate shape extending along the one face (the other face) of the filter main body 21. The watertight section 3*a* has an outer edge in an arc shape and an inner edge in a polygonal shape similar to the shape of the outer edge of the non immersion region 21*b*. Therefore, when the filter unit is stopped with the center in the circumferential direction of the non immersion region 21*b* positioned directly below, although a center distance between the center in the circumferential direction of the watertight section 3*a* and a still water surface WS is small, an end distance between each end in the circumferential direction of the watertight section 3*a* and the still water surface WS is large. It is noted that the shape of the inner edge of the watertight section 3*a* is not limited to the polygonal shape but may be in an arc shape similar to the shape of the outer edge of the non immersion region 23*b*.

When the filter unit 2 is stopped with the center in the circumferential direction of the non immersion region 21*b* positioned directly below as illustrated in FIG. 14, a watertight vessel for making the inside of the frame 3 watertight is formed by the watertight sections 3*a* and the outer circumferential face of the frame 3, and therefore, even when the outer face of the frame 3 is immersed with water, the water W never enters inside the frame 3.

Furthermore, even when the filter unit 2 is stopped without the center in the circumferential direction of the non immersion region 21*b* positioned directly below but with the positional shift in the circumferential direction caused as illustrated in FIG. 15, the water W never enters inside the frame 3 because a sufficient space is provided between each end in the circumferential direction of the watertight section 3*a* and the still water surface WS.

At this point, although the water W dropped from the filter main body 21 may be collected in the watertight vessel, the amount of the collected water is too small to immerse the non immersion region 21*b*.

The magnet 62 is fixed in the center in the circumferential direction of the watertight section 3*a* of the first frame 31. If the watertight sections 3*a* are not provided as in Embodiment 3, a margin for attaching the magnet 62 on the frame 3 is small, but when the magnet 62 is fixed on the watertight section 3*a* as in this embodiment, the margin for attaching the magnet 62 is sufficiently large for preventing the magnet 62 from falling off.

Furthermore, since the filter main body 21 is not in a complete disc shape, the appearance of the humidifier 1 may be degraded if the non immersion region 21*b* is conspicuous, but since the non immersion region 21*b* is covered with the watertight sections 3*a*, the design of the humidifier 1 is improved.

Embodiment 6

Embodiment 6 in which the rotation drive structure of the present invention is applied to a humidifier will now be described with reference to the accompanying drawings. The humidifier of Embodiment 6 humidifies a room where the humidifier is installed by using a filter main body with a water absorbability. Specifically, water reserved in a bottom portion of a main body of the humidifier is absorbed by a filter main body, air introduced from the room is made to absorb moisture by allowing the air to pass through the filter main body. Thereafter, the moistened air is sent to the room for humidifying the room.

Figure 17:
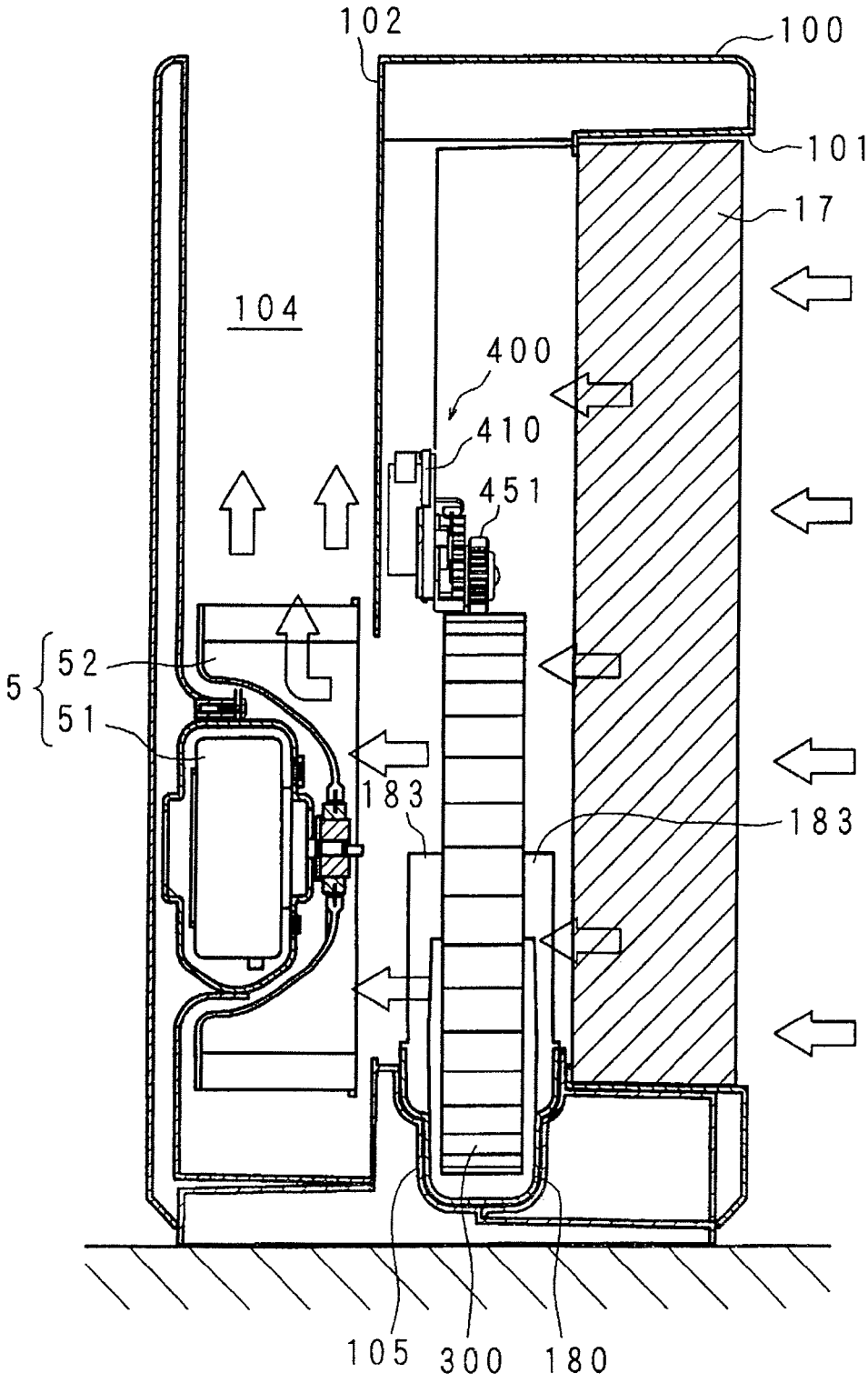
FIG. 17 is a side cross-sectional view of a humidifier according to Embodiment 6 of the invention.
Figure 18:
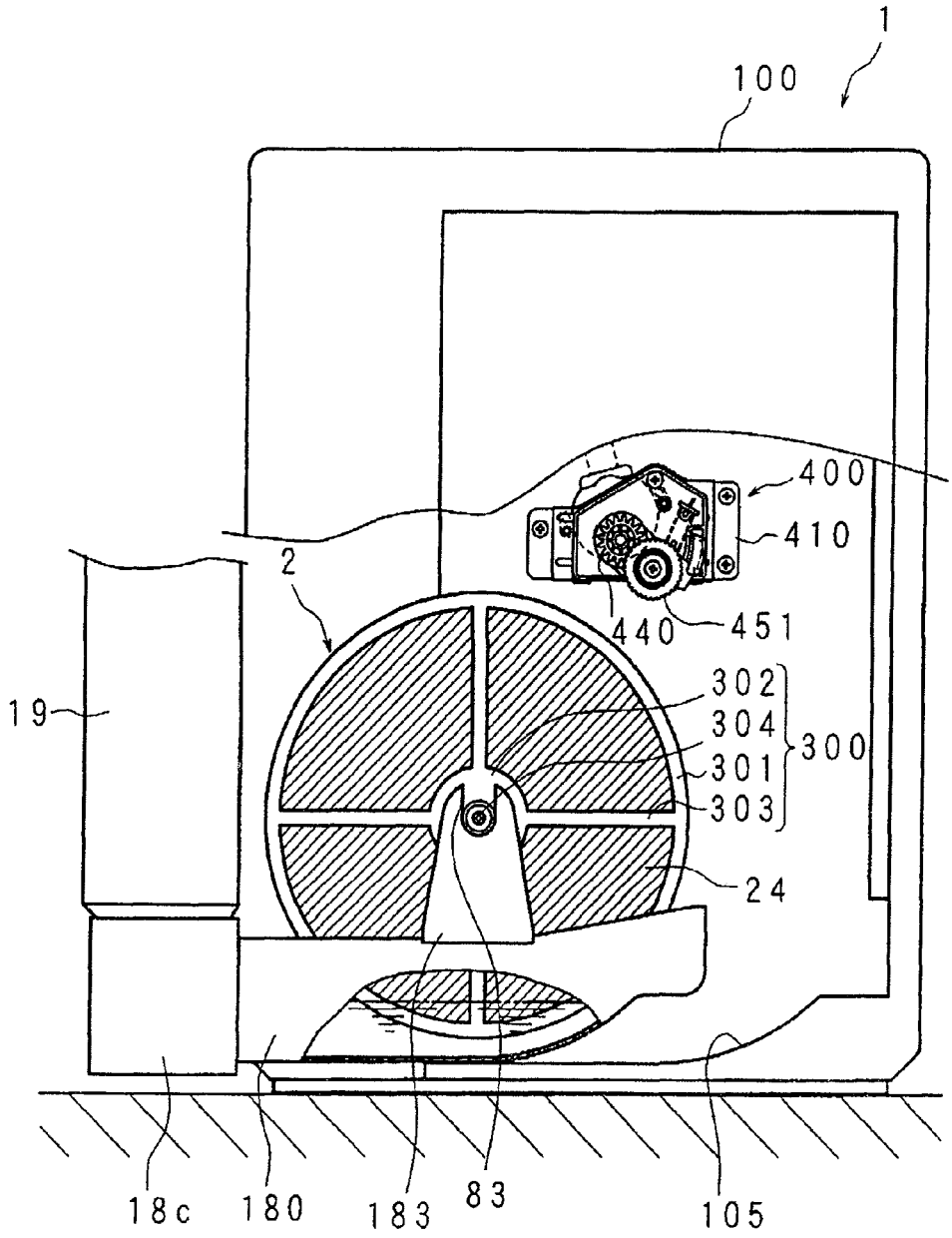
FIG. 18 is a partially perspective front view of the humidifier according to Embodiment 6 of the invention.
Figure 19:
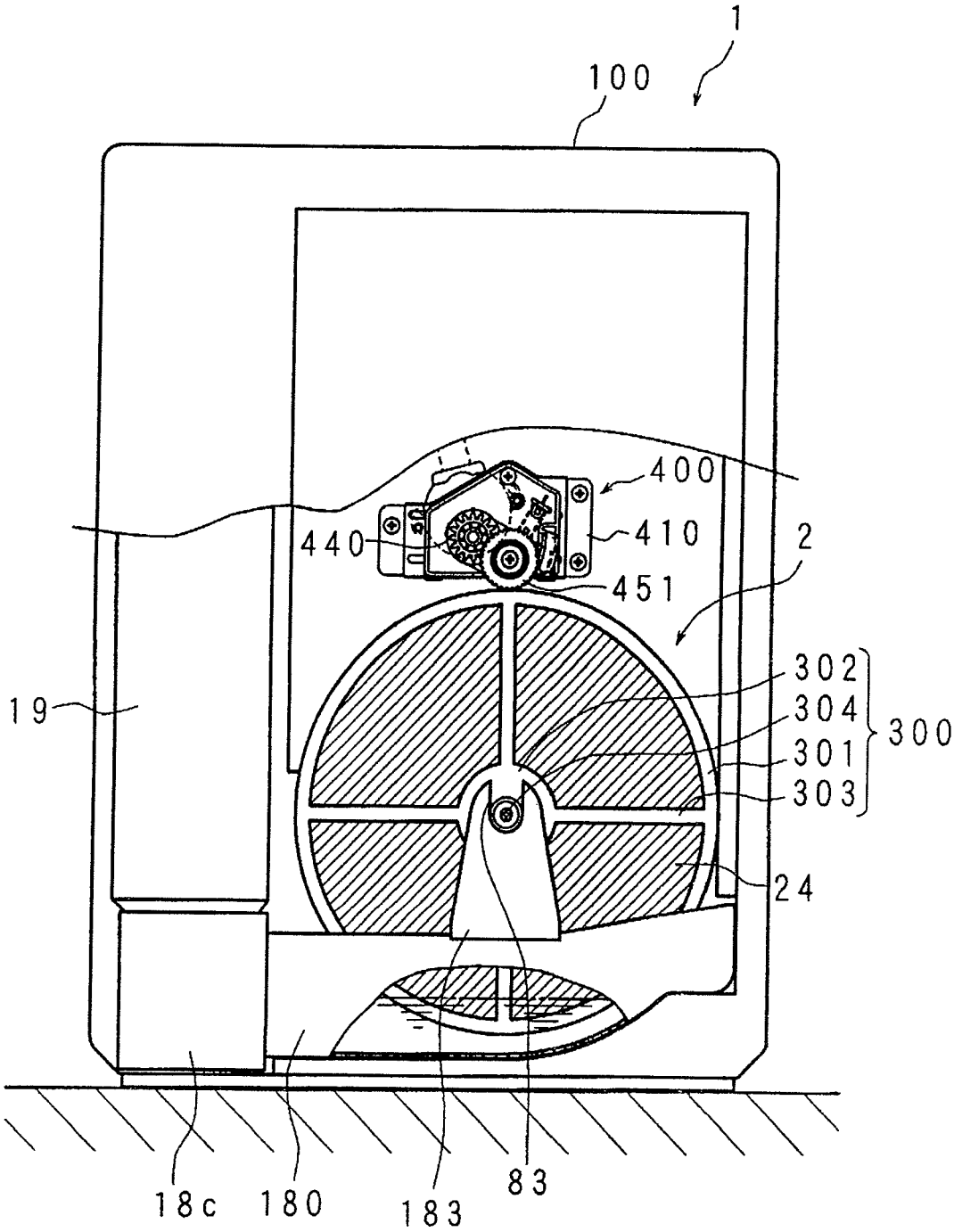
FIG. 19 is a partially perspective front view of the humidifier according to Embodiment 6 of the invention.

FIG. 17 is a schematic cross-sectional side view of the humidifier of Embodiment 6. FIGS. 18 and 19 are partially perspective front views of the humidifier.

The humidifier 1 includes a housing 100 corresponding to an external structure of the humidifier 1. The housing 100 includes a front face, a rear face, side faces, an upper face and a bottom face. On the rear face of the housing 100, an intake port 101, that is, an inlet for introducing external air is formed. An air cleaning filter 17 is attached on the intake port 101. The air cleaning filter 17 removes dust included in air in introducing the air through the intake port 101.

Within the housing 100, an air duct 104 is formed along the front face. The air duct 104 is formed in a portion upward from a substantially center of the housing 100 and is communicated with an outlet port 102, that is, an air outlet port formed on the upper face of the housing 100.

Furthermore, a fan 5 is provided in a position opposing the air cleaning filter 17 below the air duct 104. The fan 5 includes a fan motor 51 and blades 52. The fan 5 introduces air through the intake port 101 and sends the introduced air to the air duct 104 by rotating the blades 52. The air sent to the air duct 104 is blown out through the outlet port 102.

A water vessel 180 (water reservoir) corresponding to a water tank is removably mounted in the housing 100 between the air cleaning filter 17 and the fan 5. The water vessel 180 is a vessel that is cable of reserving a predetermined amount of water, has a length substantially the same as the length of the front and rear faces of the housing 100, has an opened upper face and has a cross-section in substantially a bowl shape. Furthermore, on the bottom of the housing 100, a groove 105 to be engaged with the water vessel 180 is formed to extend horizontally along the front and rear faces of the housing 100. The water vessel 180 is slidable along the groove 105. Moreover, an opening not shown is formed on the side face of the housing 100, so that the water vessel 180 can be horizontally moved along the groove 105 and taken out through the opening on the side face of the housing 100. Thus, the water vessel 180 is removably mounted in the housing 100.

A tank attaching part 18*c* on which a water feeding tank 19 is removably provided from above is disposed at one end of the water vessel 180. The water feeding tank 19 is a box type tank capable of reserving water therein and feeds water to the water vessel 180 by attaching it to the tank attaching part 18*c*, so as to reserve a substantially constant amount of water in the water vessel 180.

A pair of arms 183 working as supporting parts are provided so as to oppose each other on the both side faces in the lengthwise direction of the water vessel 180. Each of the pair of arms 183 is in a substantially triangle shape having a U-shaped notch 83 (supporting section) on the apex. A rotation drum 300 (rotating body) is fit in the notch 83.

The rotation drum 300 includes a rim 301, a hub 302 and connecting bars 303. The rim 301 is a ring-shaped body made of synthetic resin and applied with the knurling processing. The hub 302 is positioned in the center of the rim 301 and has a protruding rotation shaft 304. The connecting bars 303 connect the rim 301 and the hub 302 to each other and are provided at intervals of approximately 90 degrees. Due to the connecting bars 303, a space is formed between the rim 301 and the hub 302. A filter main body 24 is held in the space. The filter main body 24 is made of a material having a water absorbability such as a polystyrene foam. The filter main body 24 is rotated together with the rotation drum 300 and the filter main body 24 is held within the rotating drum 300 with a rotation axis of the filter main body 24 according with the rotation shaft 304 of the rotating drum 300. The rotation drum 300 also works as a frame-shaped holder for holding the filter main body 24, and a filter unit 2 of the humidifier 1 is composed of the filter main body 24 and the rotation drum 300 holding the filter main body 24.

The rotation drum 300 is removably attached to the arms 183 by fitting the rotation shaft 304 in the notches of the arms 183 from above. Also, the rotation drum 300 and the arms 183 are designed so that a lower portion of the rotation drum 300 can be slightly away from the bottom of the water vessel 180 when the rotation drum 300 is attached to the arms 183. Thus, a lower portion of the filter main body 24 held by the rotation drum 300 is immersed in water reserved in the water vessel 180. The rotation drum 300 holding the filter main body 24 is rotatable, and the entire circumference of the filter main body 24 is successively immersed in the water reserved in the water vessel 180 through the rotation, so as to moisten the entire filter main body 24. Under this condition, air passes through a portion of the filter main body 24 having absorbed the water, so that the air can absorb moisture.

The arms 183 supporting the rotation drum 300 as described above are provided on the water vessel 180 horizontally moved. Accordingly, the rotation drum 300 is removable from the housing 100 by moving vertically to the rotation shaft 304 in the horizontal direction from the side face of the housing 100 as illustrated in FIGS. 18 and 19. It is noted that FIG. 18 illustrates a front view of the housing in which the rotation drum is not mounted. FIG. 19 illustrates a front view of the housing in which the rotation drum is mounted. Also, the rotation drum 300 mounted in the housing 100 is disposed between the air cleaning filter 17 and the fan 5 as illustrated in FIG. 17, so that the air having passed through the air cleaning filter 17 can pass through the filter main body 24.

Figure 20:
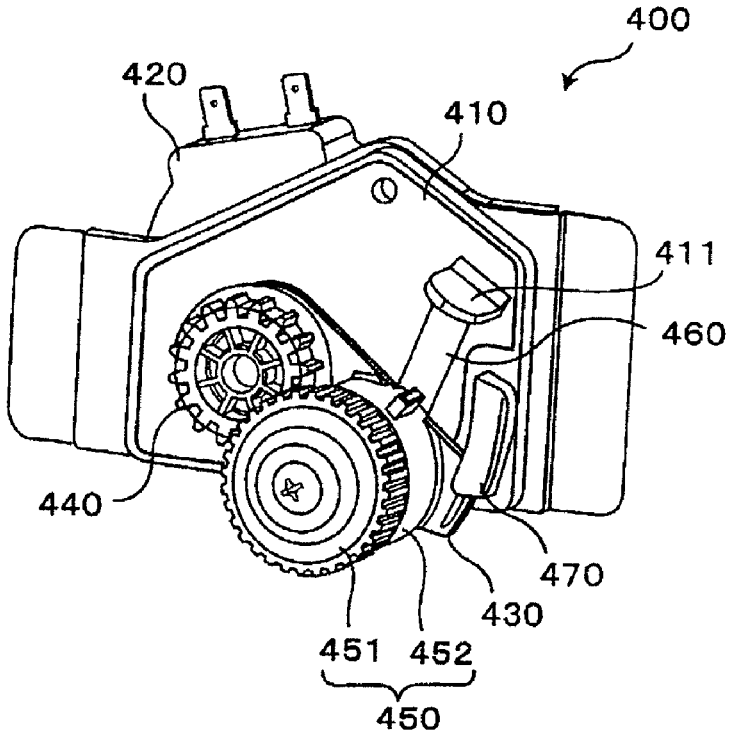
FIG. 20A is a front view of a rotation drive mechanism when a rotation drum included in the humidifier of Embodiment 6 of the invention is not mounted in a housing.
FIG. 20B is a front view of the rotation drive mechanism when the rotation drum included in the humidifier of Embodiment 6 is mounted in the housing.
Figure 20:
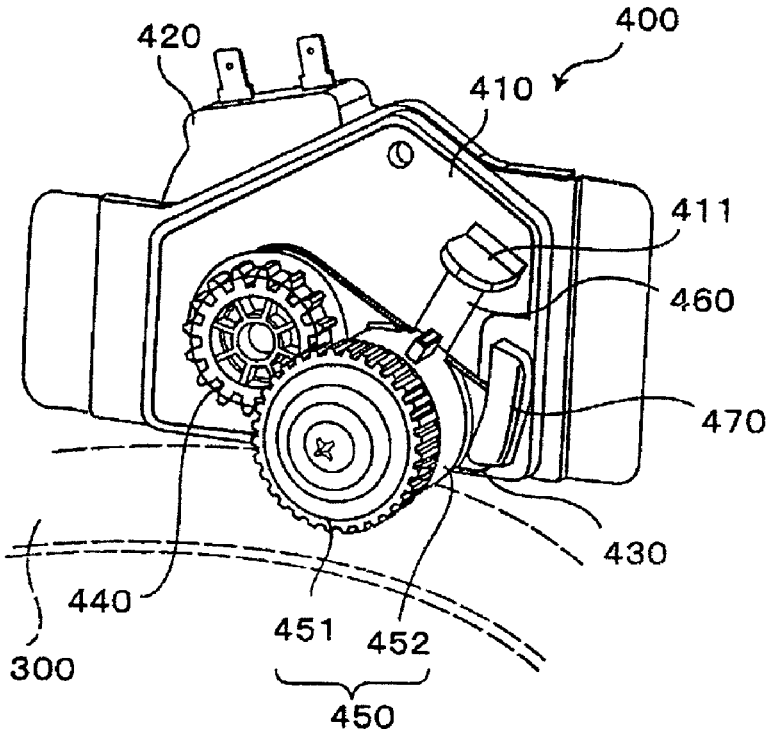

In the housing 100, a rotation drive mechanism 400 for rotatively driving the rotation drum 300 is provided substantially vertically above the rotation drum 300 mounted in the housing 100. FIG. 20A is a front view of the rotation drive mechanism 400 when the rotation drum 300 is not mounted in the housing 100. FIG. 20B is a front view of the rotation drive mechanism 400 when the rotation drum is mounted in the housing 100.

The rotation drive mechanism 400 includes a plate-shaped base 410. The base 410 is fixed on the housing 100 in a position opposing the air cleaning filter 17 above the rotation drum 300. A driving motor 420 is fixed on a face of the base 410 not opposing the air cleaning filter 17 (which face is hereinafter referred to as the rear face). The driving motor 420 has a motor shaft (not shown) protruding beyond the front face of the base 410.

Furthermore, a supporting plate 430 is provided on the front face of the base 410. The supporting plate 430 has one end through which the motor shaft of the driving motor 420 protruding from the front face of the base 410 is inserted and has another end (hereinafter referred to as the lower end) supported around the motor shaft so as to swing by using the motor shaft as a fulcrum.

Moreover, a spring bearing 411 is provided on the front face of the base 410 in a position above the supporting plate 430. A spring 460 (pressurizing part) is disposed in a shrunk state between the spring bearing 411 and the lower end of the supporting plate 430. The spring 460 applies a downward pressure to the supporting plate 430. The supporting plate 430 is swung, against the pressure applied by the spring 460, by a predetermined angle by using, as a fulcrum, its end through which the motor shaft of the driving motor 420 is inserted.

In addition, a guide 470 to be engaged with the lower end of the supporting plate 430 to be swung is provided on the front face of the base 410. The guide 470 prevents the positional shift of the supporting plate 430 while it is swinging.

The rotation drive mechanism 400 further includes a driving gear 440 and a roller part 450. The driving gear 440 is attached to the tip of the motor shaft of the driving motor 420 protruding from the base 410 and the supporting plate 430. The driving gear 440 is rotated through the rotation of the motor shaft.

Furthermore, the roller part 450 includes a roller 451 and is axially supported in the vicinity of the lower end of the supporting plate 430. The roller 451 is made of rubber and has an outer circumferential face subjected to the knurling processing. Also, the roller part 450 includes a gear (not shown) coaxially rotating with the roller 451 and engaged with the driving gear 440. In FIGS. 20A and 20B, the gear is covered with a gear cover 452. The gear is rotated in accordance with the rotation of the driving gear 440, so as to rotate the coaxial roller 451.

Since the driving gear 440 is fit in the motor shaft of the driving motor 420 and the roller part 450 is attached to the supporting plate 430 swung around the motor shaft, even when the supporting plate 430 is swung by using the motor shaft of the driving motor 420 as a fulcrum, the engagement between the driving motor 420 and the gear of the roller part 450 is kept so as to make the roller 451 rotatable.

In the rotation drive mechanism 400 having the aforementioned structure, when the rotation drum 300 not mounted in the housing 100 is horizontally moved close to the roller 451, the lowermost portion of the roller 451 comes into contact with the uppermost portion of the rotation drum 300 as illustrated in FIG. 19. Furthermore, when the rotation drum 300 is mounted in the housing 100, the rotation drive mechanism 400 is disposed so that the rotation shaft of the roller 451 and the rotation shaft of the rotation drum 300 mounted in the housing are positioned on substantially the same vertical line as illustrated in FIG. 19.

Accordingly, in mounting the rotation drum 300 in the housing 100, the rotation drum 300 is horizontally moved to come into contact with the lower portion of the roller 451 of the rotation drive mechanism 400. Then, the rotation drum 300 is further horizontally moved, so as to push the roller 451 upward and have the rotation shaft of the rotation drum 300 positioned on substantially the same vertical line as the rotation shaft of the roller 451. In this case, the roller 451 and the rotation drum 300 are strongly in contact with each other owing to the elastic force of the spring 460. Therefore, when the motor shaft of the driving motor 420 of the rotation drive mechanism 400 is rotated, the driving gear 440 is rotated, so as to also rotate the gear of the roller part 450 and the roller 451. Owing to the rotation of the roller 451, the rotation drum 300 is also rotated.

As described above, the rotation drum 300 and the roller 451 for rotating the rotation drum 300 are not directly connected to each other but in contact with each other on their outer circumferential faces, and therefore, in mounting the rotation drum 300 in the housing 100, the rotation drum 300 can be easily brought to contact with the roller 451, so as to rotate the rotation drum 300.

Next, in the humidifier 1 having the above-described structure, an operation for mounting/unmounting the rotation drum 300 in the housing 100 and an operation performed in using the humidifier 1 will be described.

The humidifier 1 is placed in an operable state when the rotation drum 300 is attached to the arms 183 and the water vessel 180 reserves water. When the rotation drum 300 is mounted in the housing 100, the rotation drum 300 is in contact, on a portion of its outer circumferential face positioned substantially vertically above, with the roller 451 of the rotation drive mechanism 400 for rotating the rotation drum 300. When the humidifier 1 is driven under this condition, the driving motor 420 of the rotation drive mechanism 400 and the fan 5 are driven.

The motor shaft is rotated by driving the driving motor 420 of the rotation drive mechanism 400. Accordingly, the driving gear 440, and the gear and the roller 451 of the roller part 450 are rotated. Then, the rotation drum 300 in rotative contact with the roller 451 is rotated. When the rotation drum 300 is rotated, the filter main body 24 held by the rotation drum 300 is also rotated. The filter main body 24 has the lower portion immersed in the water reserved in the water vessel 180 and hence is rotated while absorbing the water reserved in the water vessel 180.

Furthermore, when the fan 5 is driven, air is introduced through the intake port 101 and passes through the air cleaning filter 17 and the filter main body 24 having absorbed the water. The air absorbs moisture while passing through the filter main body 24 having absorbed the water. Then, the thus moistened air is sent to the aid duct 104 and blown out through the outlet 102. As a result, the room is humidified.

Incidentally, since the rotation drum 300 is immersed in the water reserved in the water vessel 180, its outer circumferential face becomes slippery due to the water, but the outer circumferential face of the rotation drum 300 and/or the roller 451 is subjected to the knurling processing, so as to reduce slip on the contact face between the rotation drum 300 and the roller 451 and to stably rotate.

Furthermore, in taking the rotation drum 300 out of the housing 100, the water vessel 180 is horizontally moved. In this case, since the water vessel 180 is provided with the arms 183 for supporting the rotation drum 300, the rotation drum 300 is horizontally moved together with the water vessel 180. Thereafter, since the rotation drum 300 is disposed on substantially the same vertical line with and in contact with the roller 451 of the rotation drive mechanism 400, the rotation drum 300 is removed from the roller 451 in contact by horizontally moving. Thus, the rotation drum 300 can be taken out of the housing 100 together with the water vessel 180 supporting it with the arms 183. As a result, the rotation drum 300 can be removed from the arms 183, so that the filter main body 24 held by the rotation drum 300 can be exchanged or cleaned for the maintenance.

Moreover, in mounting the rotation drum 300 in the housing 100, the rotation drum 300 is attached to the arms 183, and the water vessel 180 is horizontally moved so as to be mounted in the housing 100. The rotation drum 300 is horizontally moved together with the water vessel 180 and comes into contact with the lower portion of the roller 451 of the rotation drive mechanism 400. Then, when the rotation drum 300 is further horizontally moved, it pushes the roller 451 upward, so that the rotation shaft of the rotation drum 300 can be positioned on substantially the same vertical line as the rotation shaft of the roller 451. Thus, the rotation drum 300 is placed in a rotatable state in rotative contact with the roller 451 for rotating the rotation drum 300. Under this condition, the humidifier 1 becomes usable.

As described so far, in the humidifier 1 of Embodiment 6, the rotation drum 300 for holding the filter main body 24 is in contact with the roller 451 of the rotation drive mechanism 400 in its outer circumferential face, and hence, when the roller 451 is rotatively driven, the turning force is transmitted for rotating the rotation drum 300. In other words, since the rotation drum 300 is not directly connected to the roller 451, the rotation drum 300 can be easily attached/removed to/from the roller 451.

Furthermore, the rotation drum 300 is mounted, through the horizontal movement, in the housing 100 so as to have its rotation shaft positioned substantially vertically below the rotation shaft of the roller 451. In other words, the rotation drum 300 is in contact with the roller 451 in the portion directly above, and hence, the rotation drum 300 can be brought into rotative contact with the roller 451 even when the rotation drum 300 is mounted in the housing 100 with slight positional shift in the horizontal direction.

Furthermore, since the roller 451 is positioned substantially directly above the rotation drum 300, the pressure of the roller 451 to the rotation drum 300 is applied substantially directly downward, and therefore, the roller 451 can apply the pressure uniformly to the rotation drum 300. As a result, the roller 451 can transfer a stable turning force to the rotation drum 300 so as to stably rotate the rotation drum 300.

Moreover, since the outer circumferential face of the rotation drum 300 is subjected to the knurling processing, slip on the roller 451 in contact can be reduced, so as to definitely rotate the rotation drum 300. In addition, since the rotation drive mechanism 400 is disposed substantially directly above the rotation drum 300, the water having been reserved in the water vessel 180 and adhered to the rotation drum 300 does not drop onto the rotation drive mechanism 400, resulting in preventing damage of the rotation drive mechanism 400 otherwise caused by the water.

Although the rotation drive structure of the present invention is applied to the humidifier in Embodiment 6 described above, it is applicable, apart from the humidifier, to an air cleaner in which an air cleaning filter is automatically cleaned. In such an air cleaner, the air cleaning filter is rotated so as to shake off dust having adhered onto the air cleaning filter or to brush off the dust with a brush brought into contact with the air cleaning filter. In this case, the air cleaning filter is held by a removable rotation drum as in the aforementioned structure. When the air cleaning filter is seriously dusty, the rotation drum is taken out of the housing as described above for the maintenance of the filter main body.

Moreover, the structure of the rotation drive mechanism 400 for rotating the rotation drum 300 is not limited to that described in Embodiment 6 above. For example, although the lowermost portion of the roller 451 is disposed below the uppermost portion of the rotation drum 300 mounted in the housing 100, the lowermost portion of the roller 451 may be on the same horizontal line as the uppermost portion of the rotation drum 300 instead. Also, although the rotation drum 300 is attached to the arms 183 and the arms 183 are removably provided in the housing 100, the rotation drum 300 alone may be removably provided in the housing 100.

Although the preferred embodiments of the invention have been specifically described so far, the structures, the operations and the like may be appropriately modified and the invention is not limited to the aforementioned embodiments.

What is claimed:

1. A humidifier comprising:

a roller to be rotatively driven;

a rotating body that holds a filter main body with a part thereof immersed in water reserved in a water reservoir, has a circular outer circumferential face, and rotates about a rotation shaft; and a supporting section for removably supporting the rotating body, wherein the rotation shaft of the rotating body is positioned substantially directly below a rotation axis of the roller by moving the rotating body substantially horizontally relative to the rotation shaft of the rotating body, and the rotating body is rotated by rotatively driving the roller with the outer circumferential face of the rotating body in contact with an outer circumferential face of the roller, and a fan causes air to pass through the filter main body to be blown out.

2. The humidifier according to claim 1, further comprising:

a housing for housing the rotating body and the roller, wherein the fan allows air introduced from the outside of the housing to pass through the filter main body, the filter main body is held within the rotating body with a rotation axis of the filter main body according with the rotation shaft of the rotating body, and the supporting part is provided on the water reservoir, holds the rotating body with a lower portion of the filter main body immersed in the water reserved in the water reservoir and is removably provided on the housing.

3. A rotation drive structure comprising:

a roller to be rotatively driven;

a rotating body which has a circular outer circumferential face, holds a filter main body, and rotates about a rotation shaft; and a supporting section for removably supporting the rotating body, wherein the rotation shaft of the rotating body is positioned substantially directly below a rotation axis of the roller by moving the rotating body substantially horizontally relative to the rotation shaft of the rotating body, and the rotating body is rotated with the outer circumferential face of the rotating body in contact with an outer circumferential face of the roller.

4. The rotation drive structure according to claim 3, wherein the outer circumferential face of the rotating body and/or the outer circumferential face of the roller are subjected to knurl processing.

5. The rotation drive structure according to claim 3, wherein the roller is held vertically movably.

6. The rotation drive structure according to claim 5, further comprising a pressurizing part for applying a downward pressure to the roller.

* * * * *